US010920800B2

(12) United States Patent
Sergeev

(10) Patent No.: US 10,920,800 B2
(45) Date of Patent: Feb. 16, 2021

(54) TENSILE ACTUATOR

(71) Applicant: Alexander Sergeev, San Francisco, CA (US)

(72) Inventor: Alexander Sergeev, San Francisco, CA (US)

( * ) Notice: Subject to any disclaimer, the term of this patent is extended or adjusted under 35 U.S.C. 154(b) by 0 days.

(21) Appl. No.: 15/888,004

(22) Filed: Feb. 3, 2018

(65) Prior Publication Data

US 2018/0372132 A1 Dec. 27, 2018

Related U.S. Application Data

(63) Continuation-in-part of application No. 15/149,167, filed on May 8, 2016, now Pat. No. 10,422,359.

(60) Provisional application No. 62/456,946, filed on Feb. 9, 2017.

(51) Int. Cl.
*F15B 15/10* (2006.01)

(52) U.S. Cl.
CPC ..... *F15B 15/103* (2013.01); *F15B 2215/30* (2013.01)

(58) Field of Classification Search
CPC ..... F15B 15/103
USPC ..... 92/90–92
See application file for complete search history.

(56) References Cited

U.S. PATENT DOCUMENTS 4,819,547 A 4/1989 Kukolj
5,337,754 A 8/1994 Heaven et al.
5,604,945 A 2/1997 Fisher et al.
6,302,653 B1 10/2001 Bryant et al.
6,423,166 B1 7/2002 Simhaee
6,485,263 B1 11/2002 Bryant et al.
6,663,359 B2 12/2003 Gray
6,810,751 B2 11/2004 Moreno et al.
6,919,039 B2 7/2005 Lang et al.
7,914,487 B2 3/2011 Davies et al.
9,464,642 B2 10/2016 Ilievski et al.
9,494,150 B2 11/2016 Gray et al.
2005/0081711 A1* 4/2005 Kerekes ..... B62D 35/005 92/48
2008/0183132 A1 7/2008 Davies et al.

FOREIGN PATENT DOCUMENTS

EP 1171712 12/2005
JP 2005027163 1/2005

* cited by examiner

*Primary Examiner* — Thomas E Lazo
*Assistant Examiner* — Daniel S Collins
(74) *Attorney, Agent, or Firm* — Patrick Reilly

(57) ABSTRACT

A method is disclosed wherein two sheets of a flexible, inelastic substance are sealed along a periphery thereof, creating an interior reservoir preferably containing two or more elongate chambers, organized normal to an axis of traction. The disclosed axis of traction is an axis along which the disclosed device reduces length as a medium is introduced into the reservoir. Further disclosed is a method by which one or more bladders of flexible, inelastic substance are woven through two or more preferably parallel strips or strings. The bladders are adapted to receive a preferably gaseous or liquid medium. As the medium is moved into the bladders, the flexible strips or stings are deformed to cause the strips or strings to have a reduced length along the axis of traction.

20 Claims, 47 Drawing Sheets

TRUE SIDE VIEW — EXTENDED POSITION

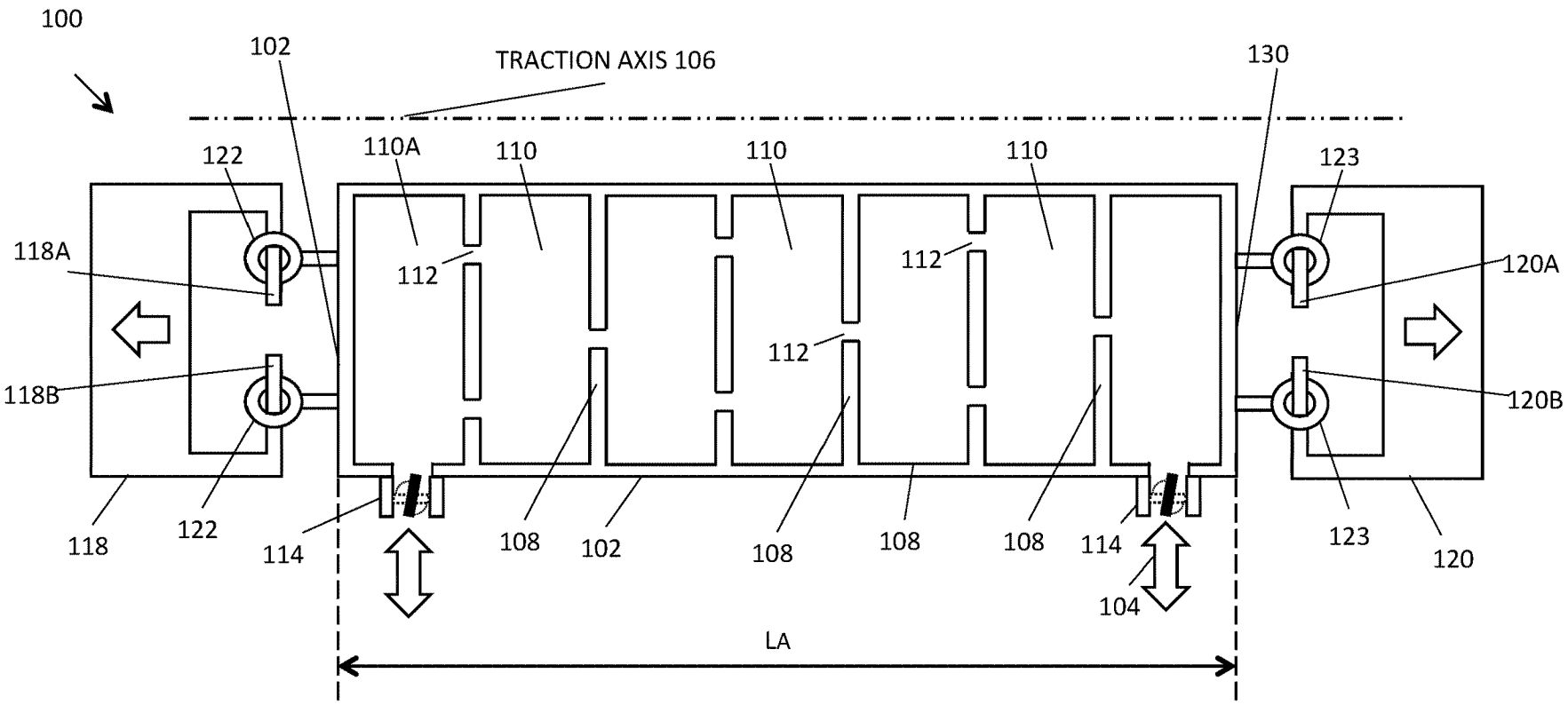
FIGURE 1A - TOP VIEW, EXTENDED

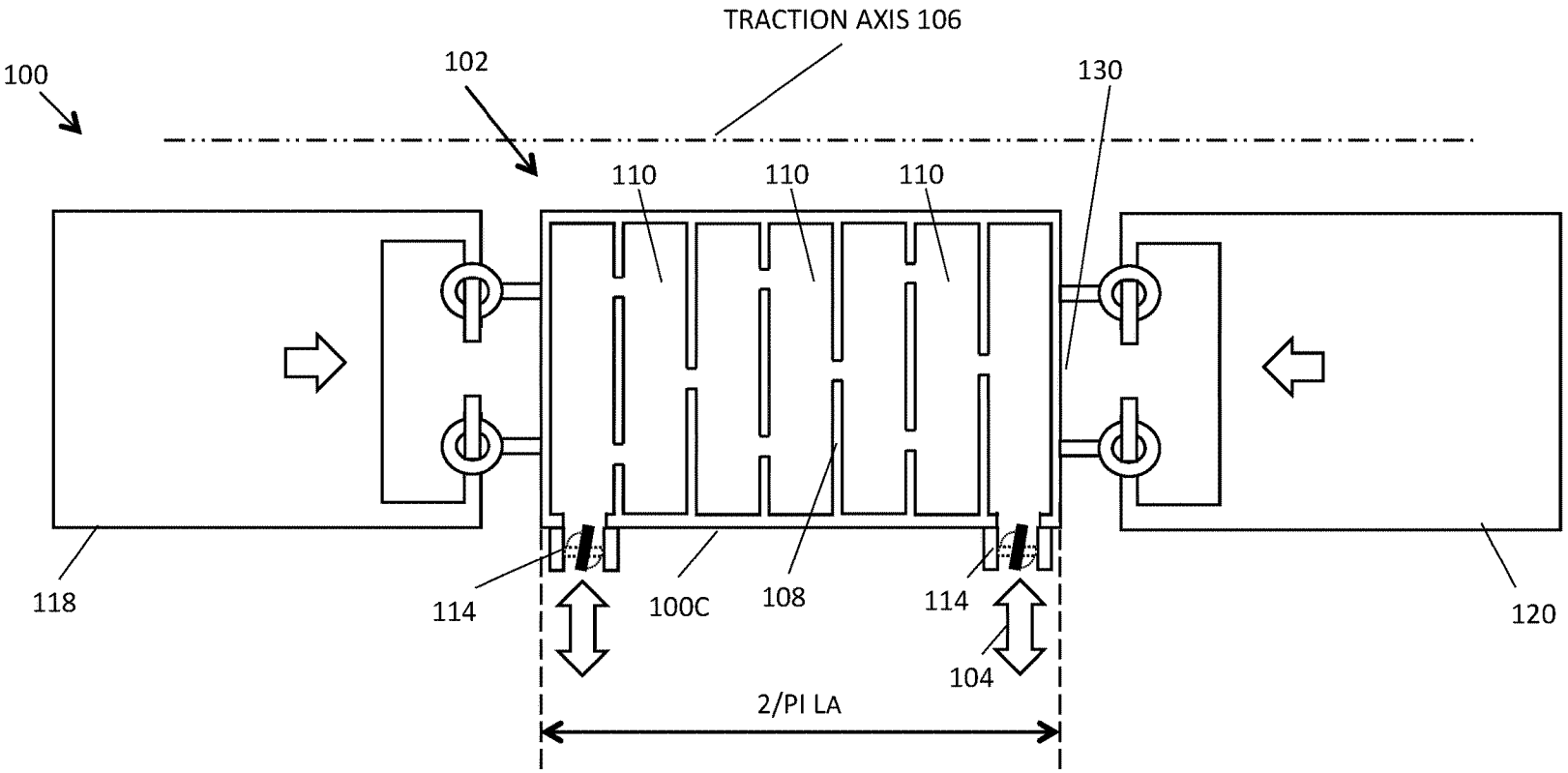
FIG 1B - TOP VIEW, FILLED

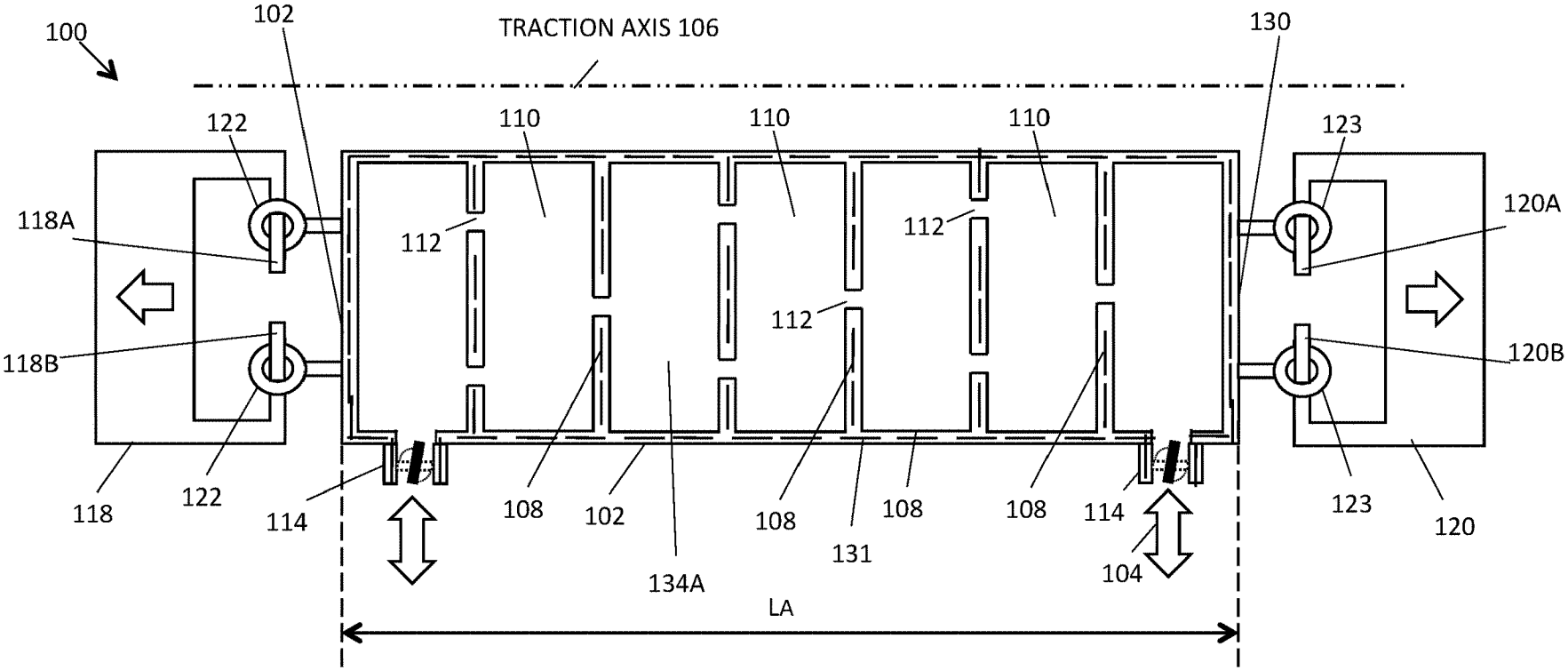
FIGURE 1C - TOP VIEW, TEXTILE, EXTENDED

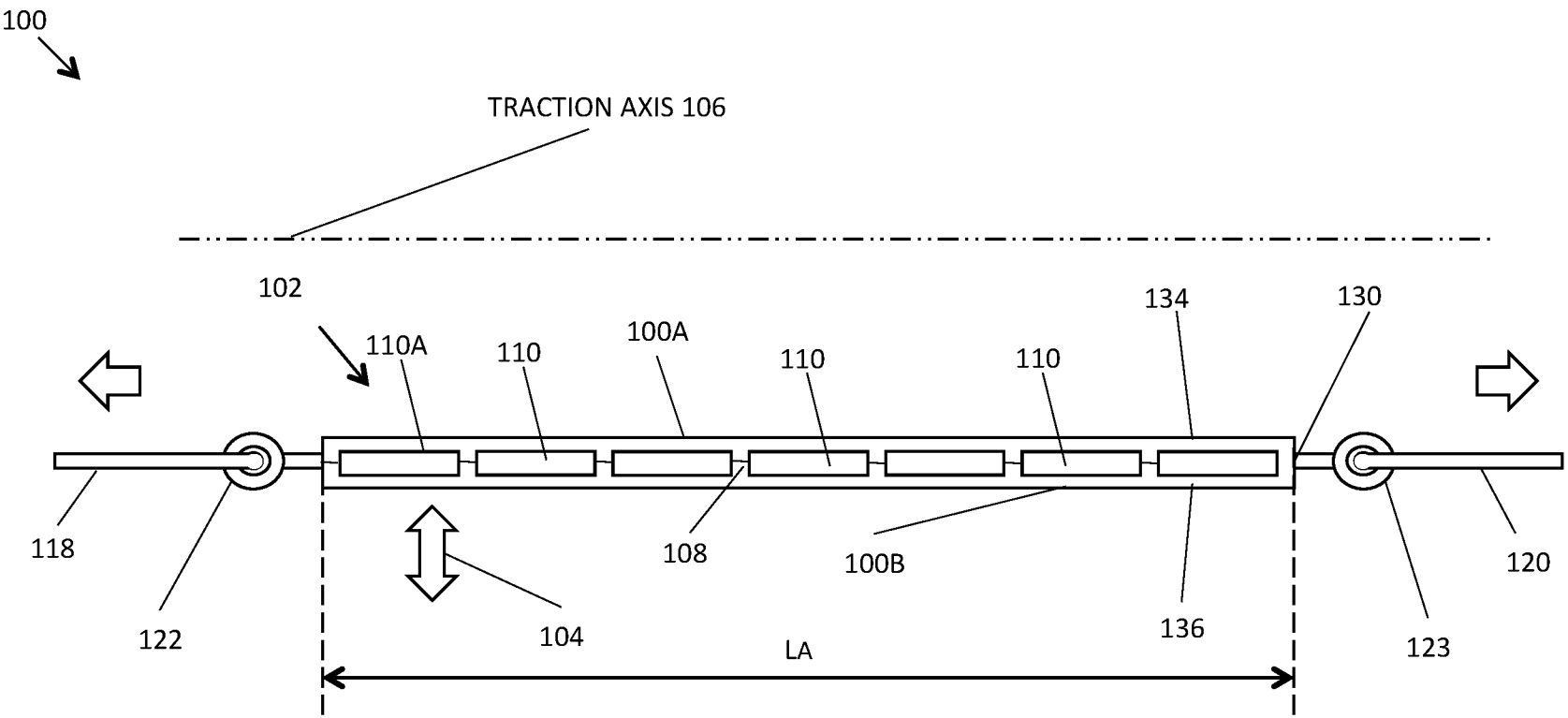
FIGURE 2A - SIDE VIEW EXTENDED

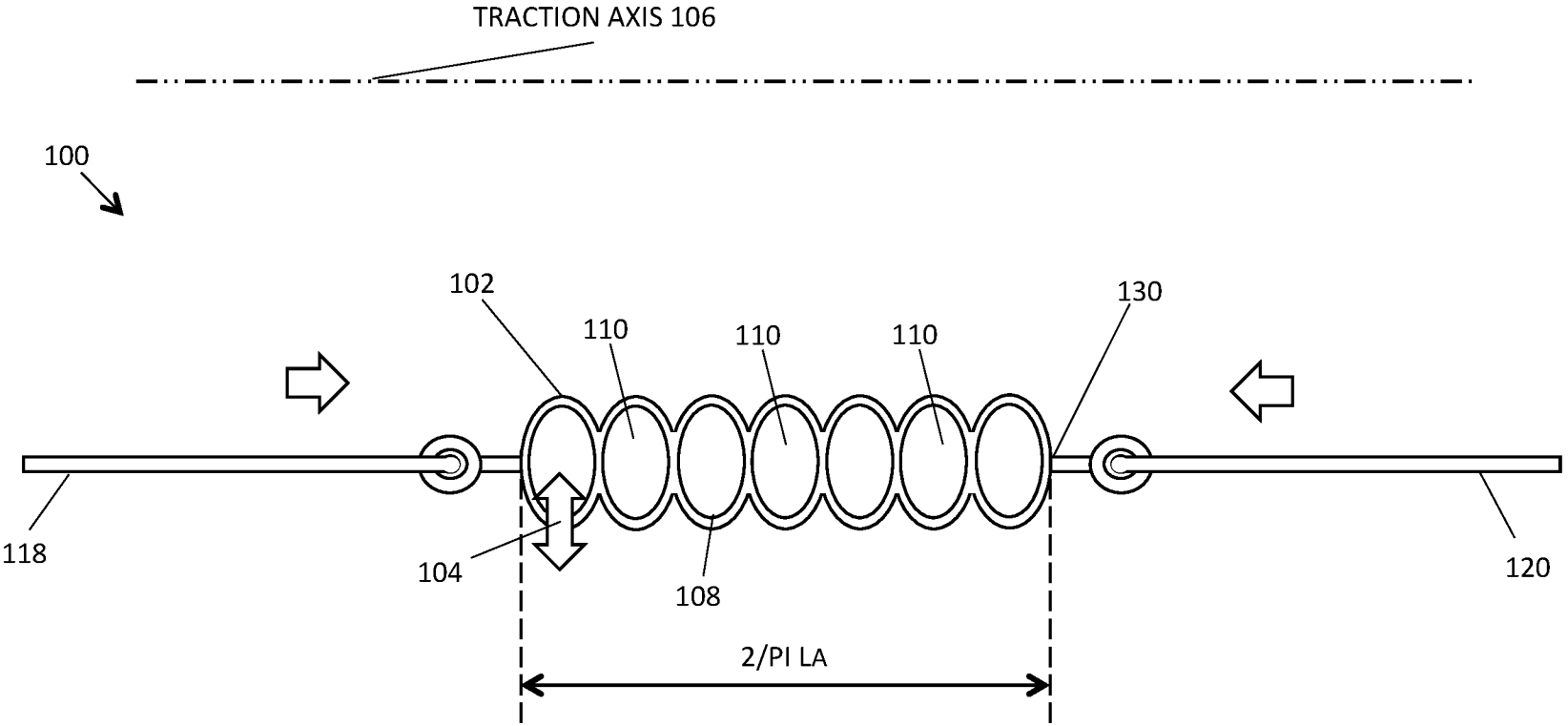
FIGURE 2B - SIDE VIEW, FILLED

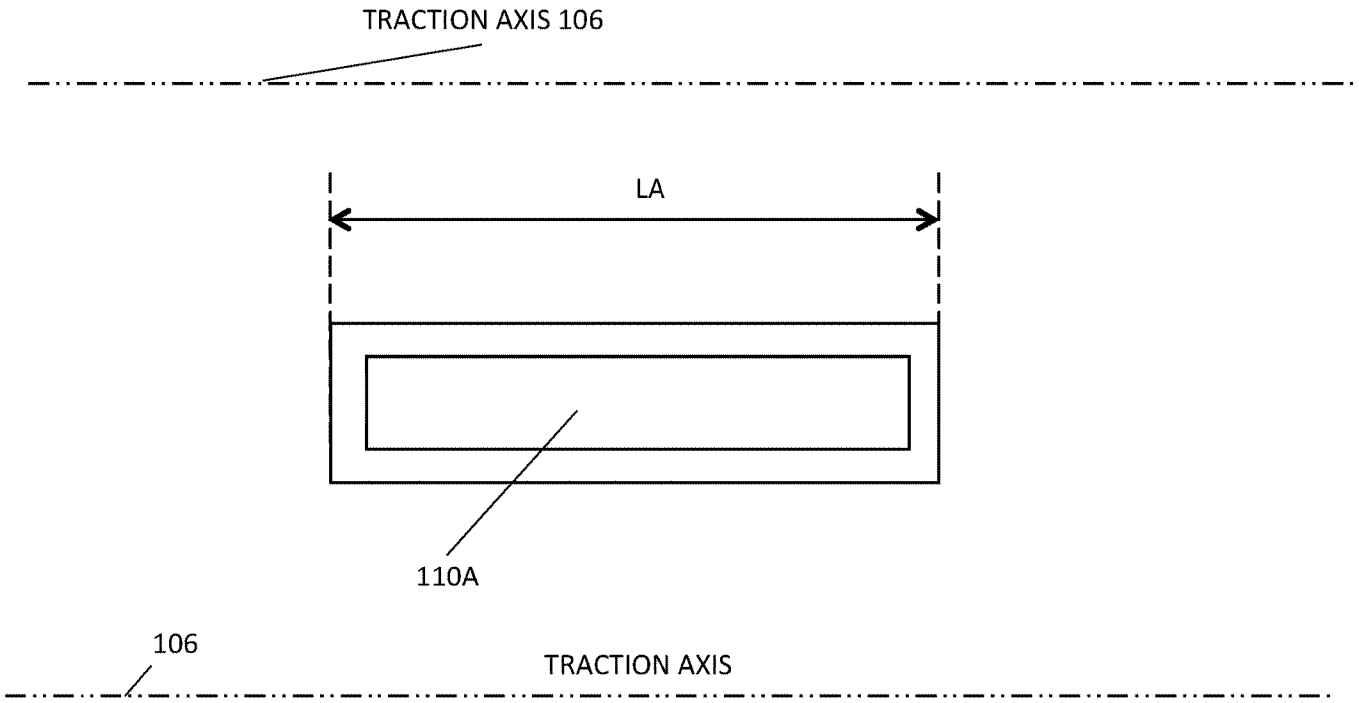
FIGURE 2C - DETAIL, SIDE VIEW, EXTENDED

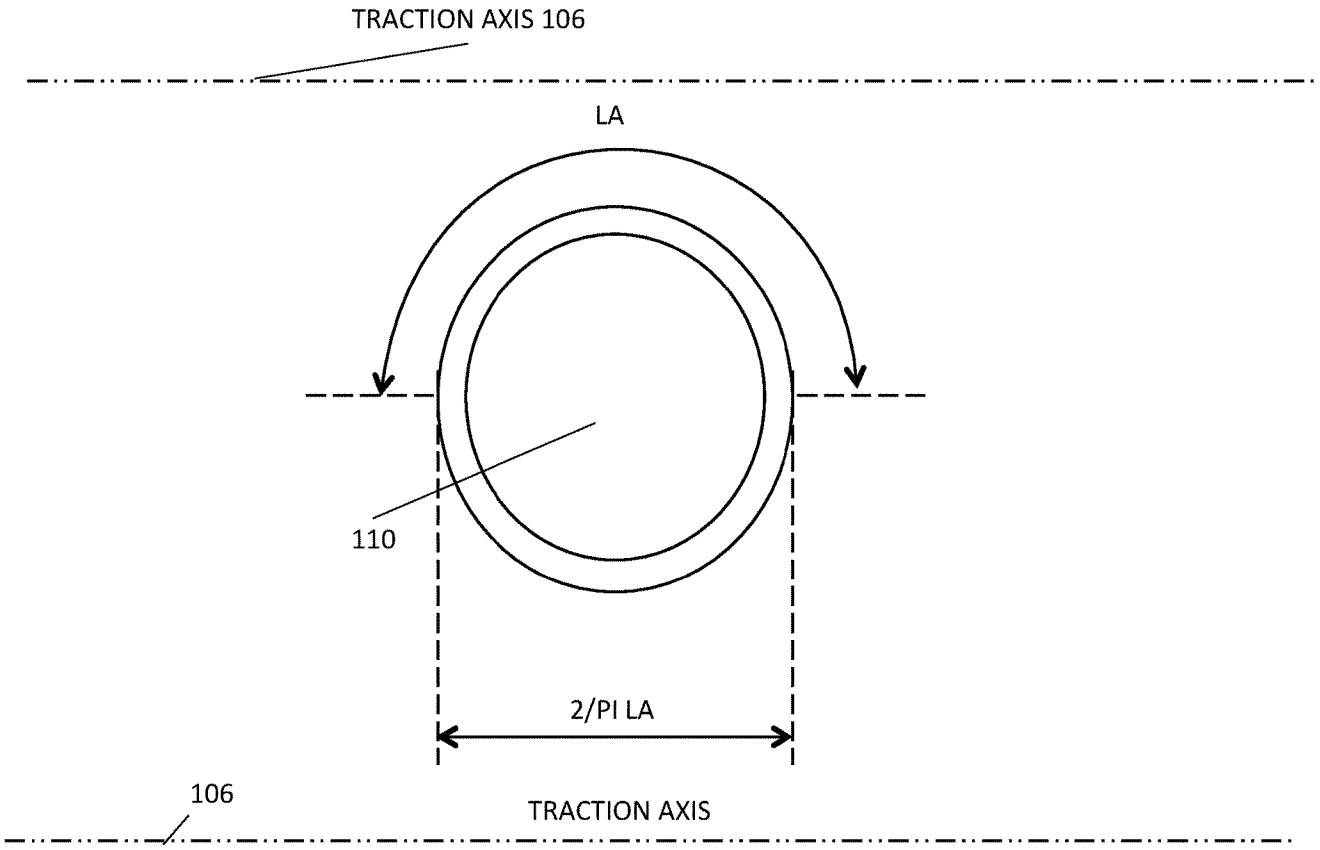
FIGURE 2D – DETAIL, SIDE VIEW, FILLED

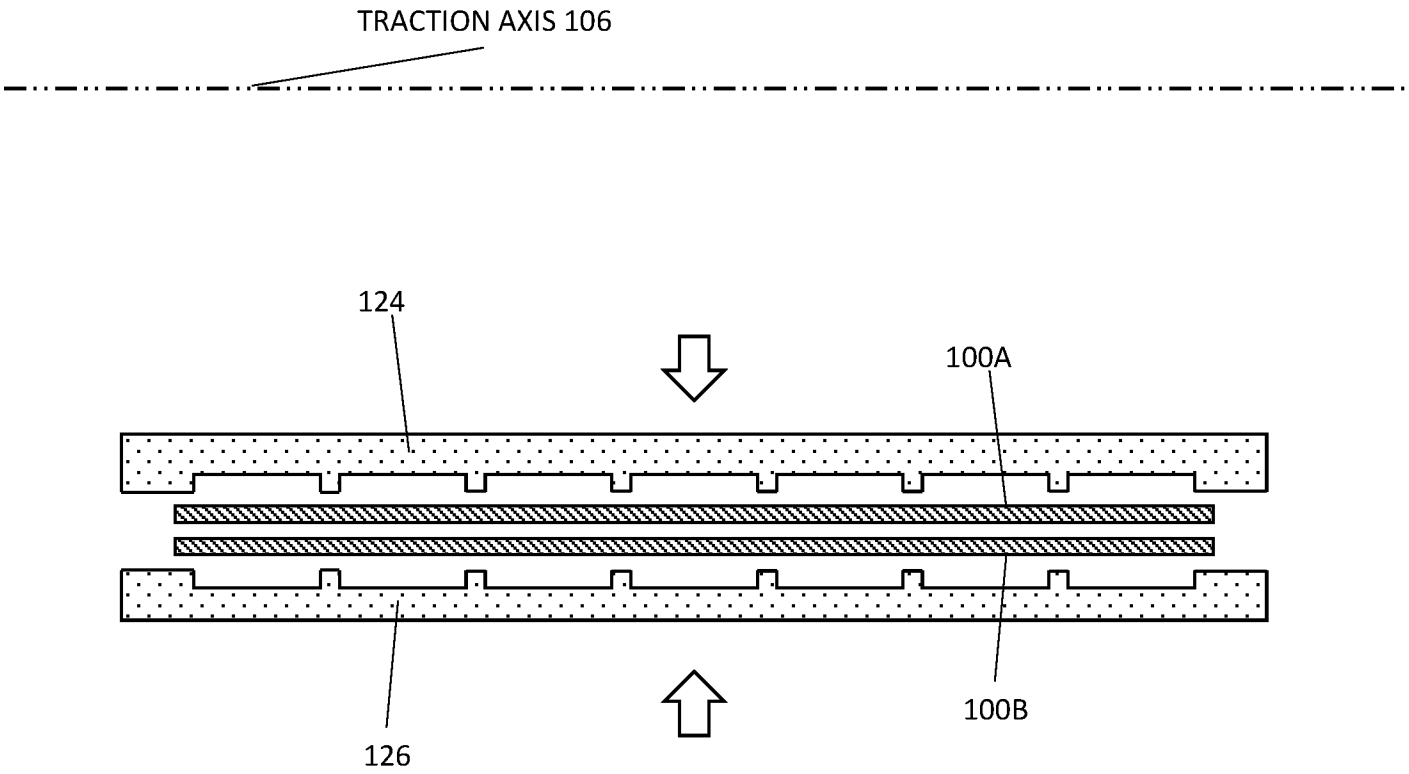
FIGURE 3A - DIE: SIDE W/PATTERN, BOTTOM W/ PATTERN

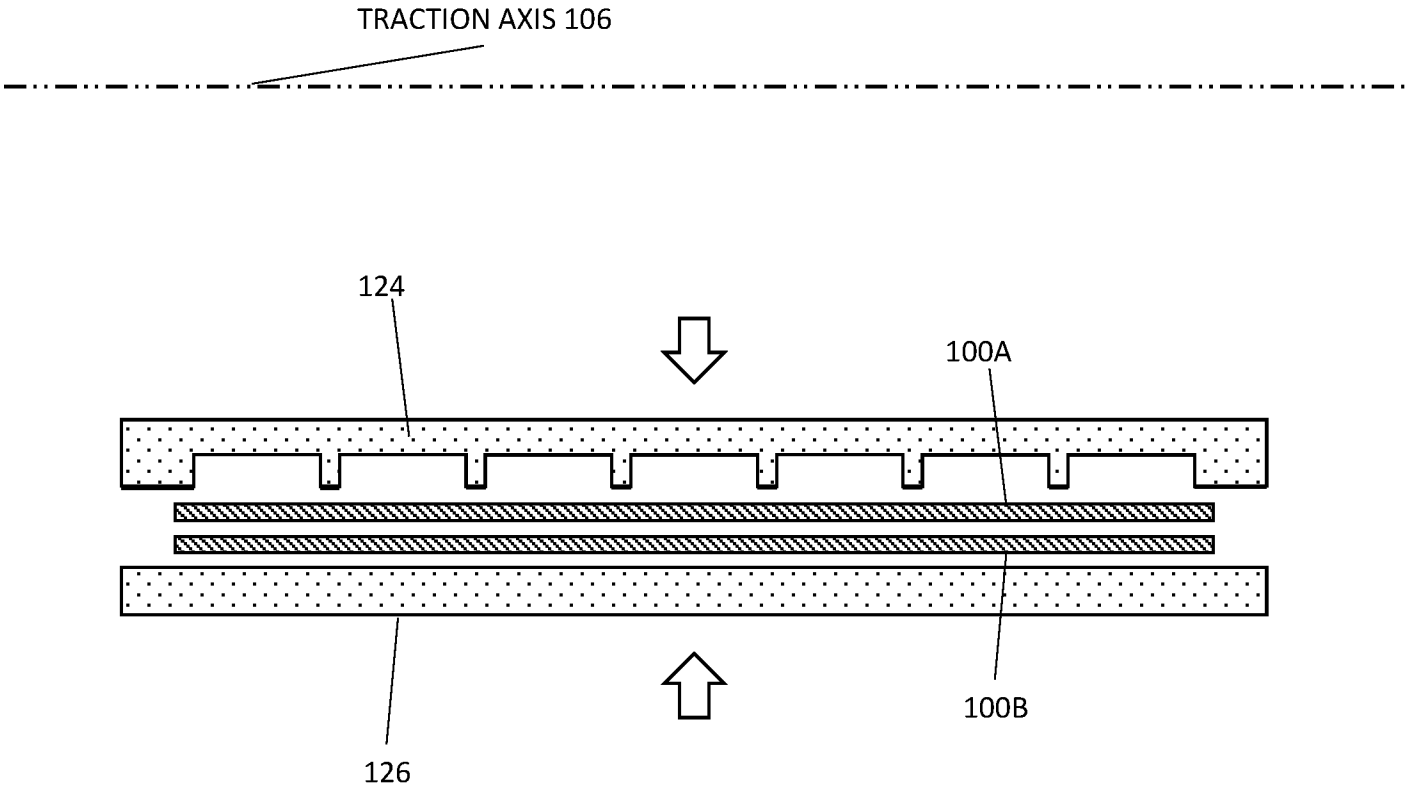
FIGURE 3B - DIE: SIDE W/PATTERN, BOTTOM BLANK

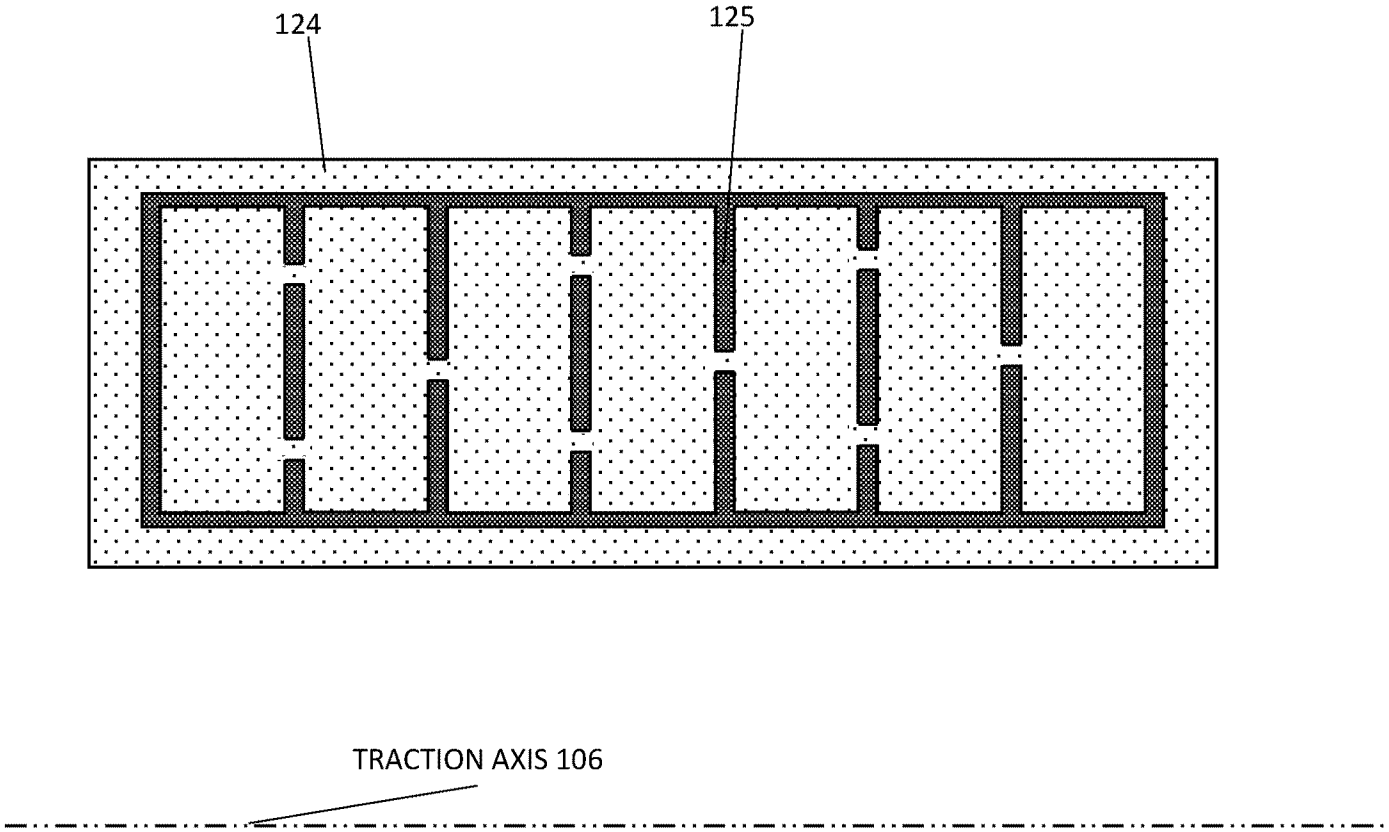
FIGURE 3C - DIE: TOP W/PATTERN

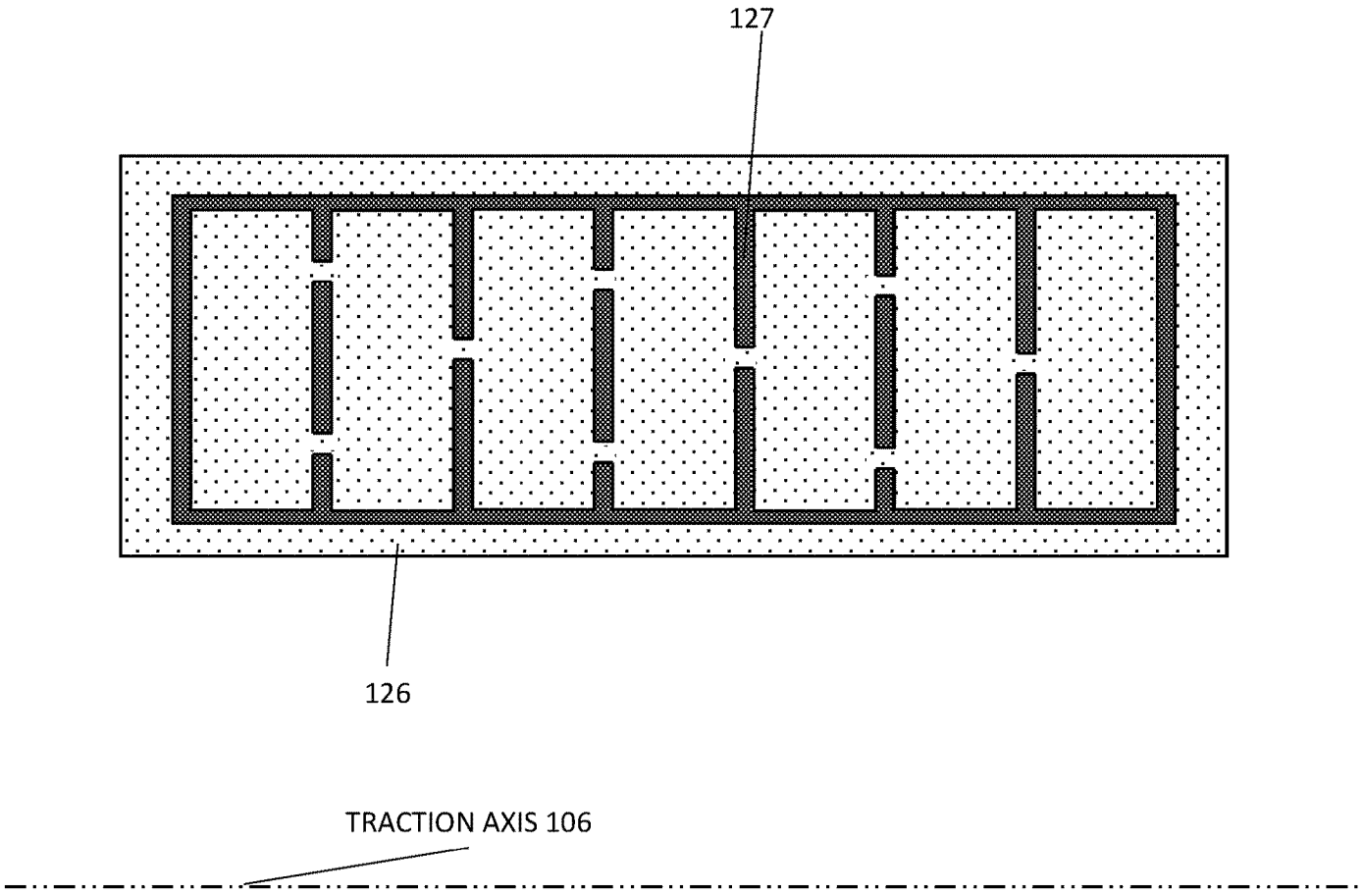
FIGURE 3D - DIE: BOTTOM W/PATTERN

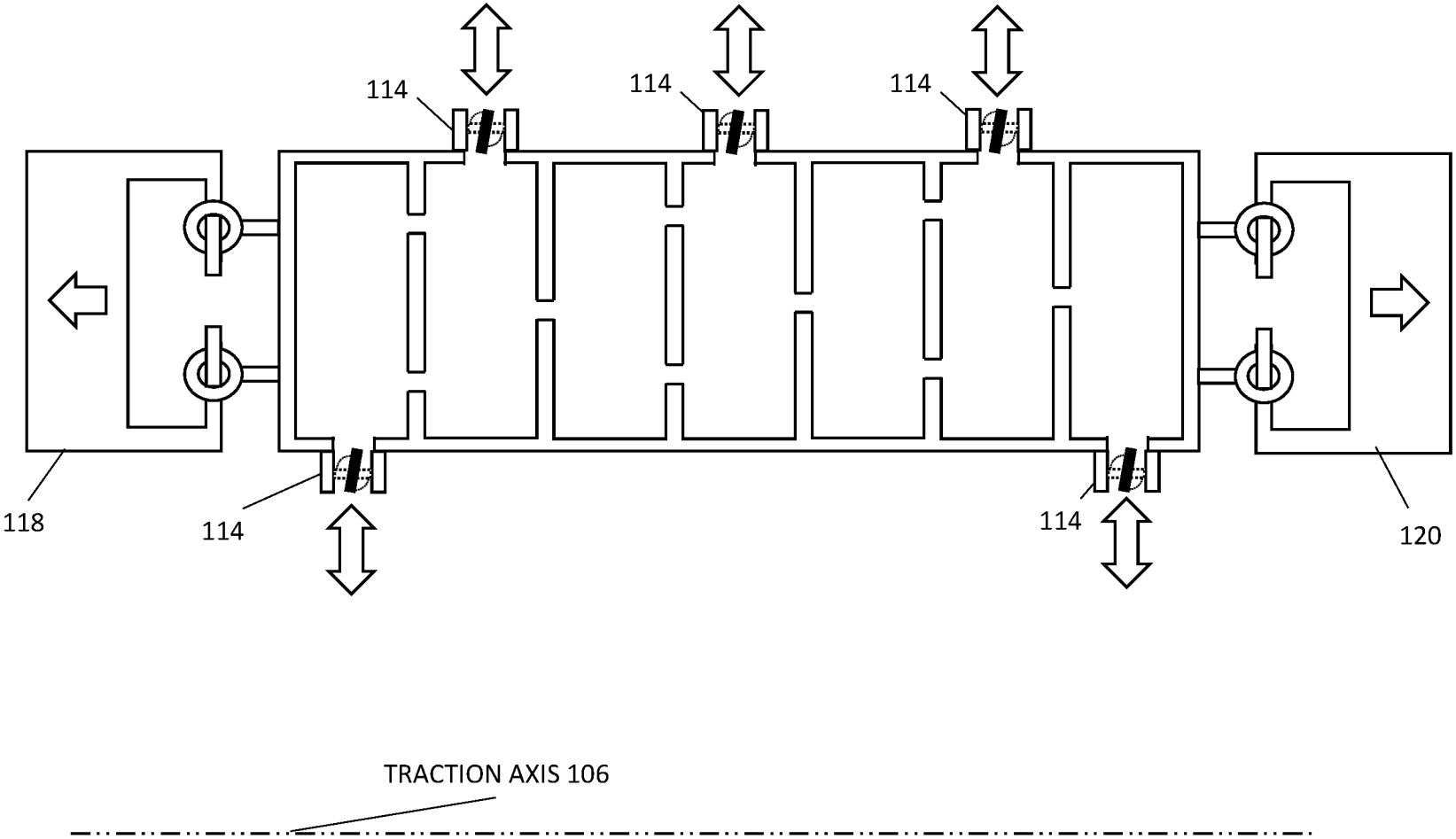
FIGURE 4 - MULTI-PORTS

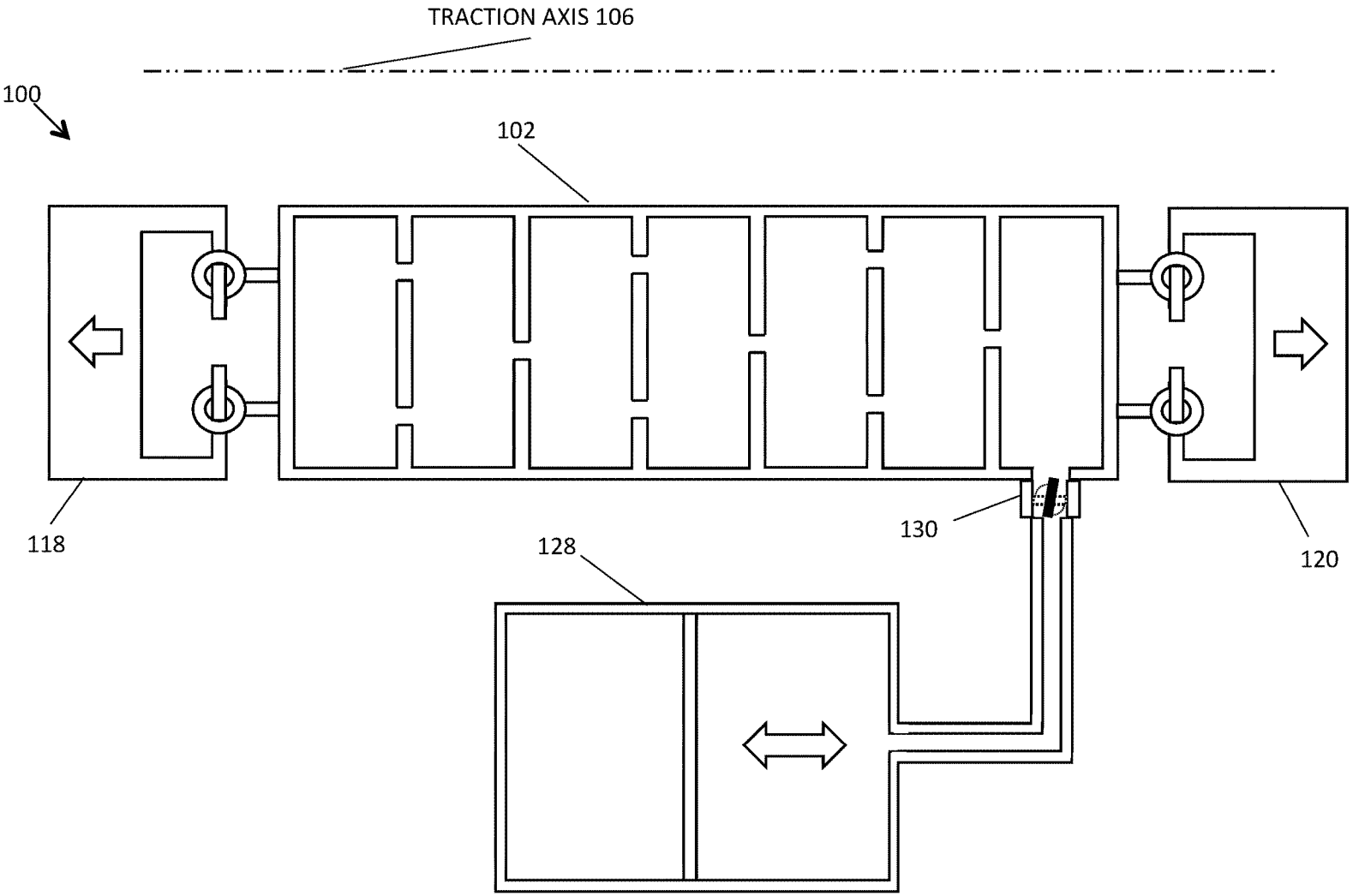
FIGURE 5A – RESERVOIR WITH PUMP

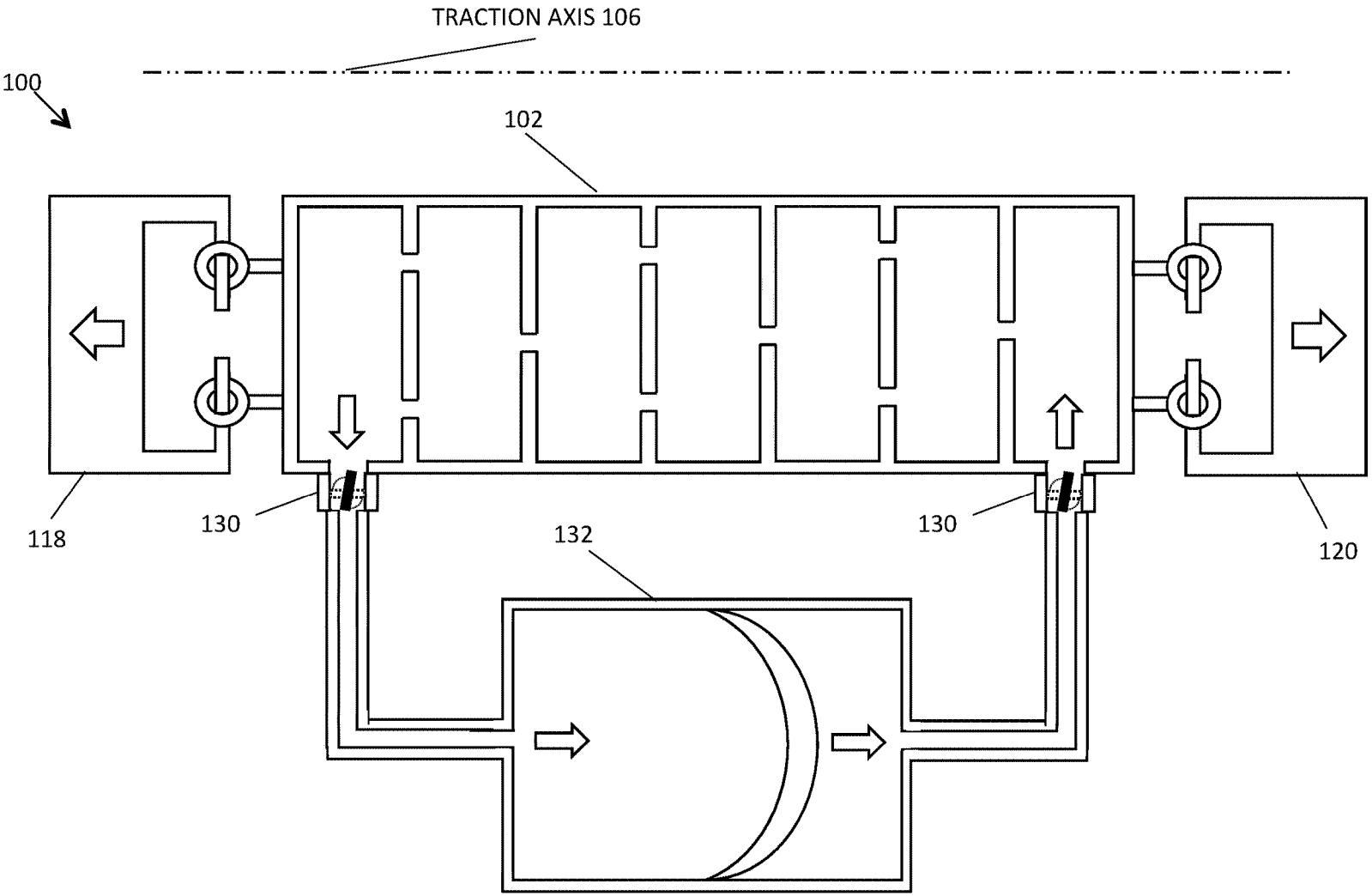
FIGURE 5B – RESERVOIR WITH A MEMBRANE

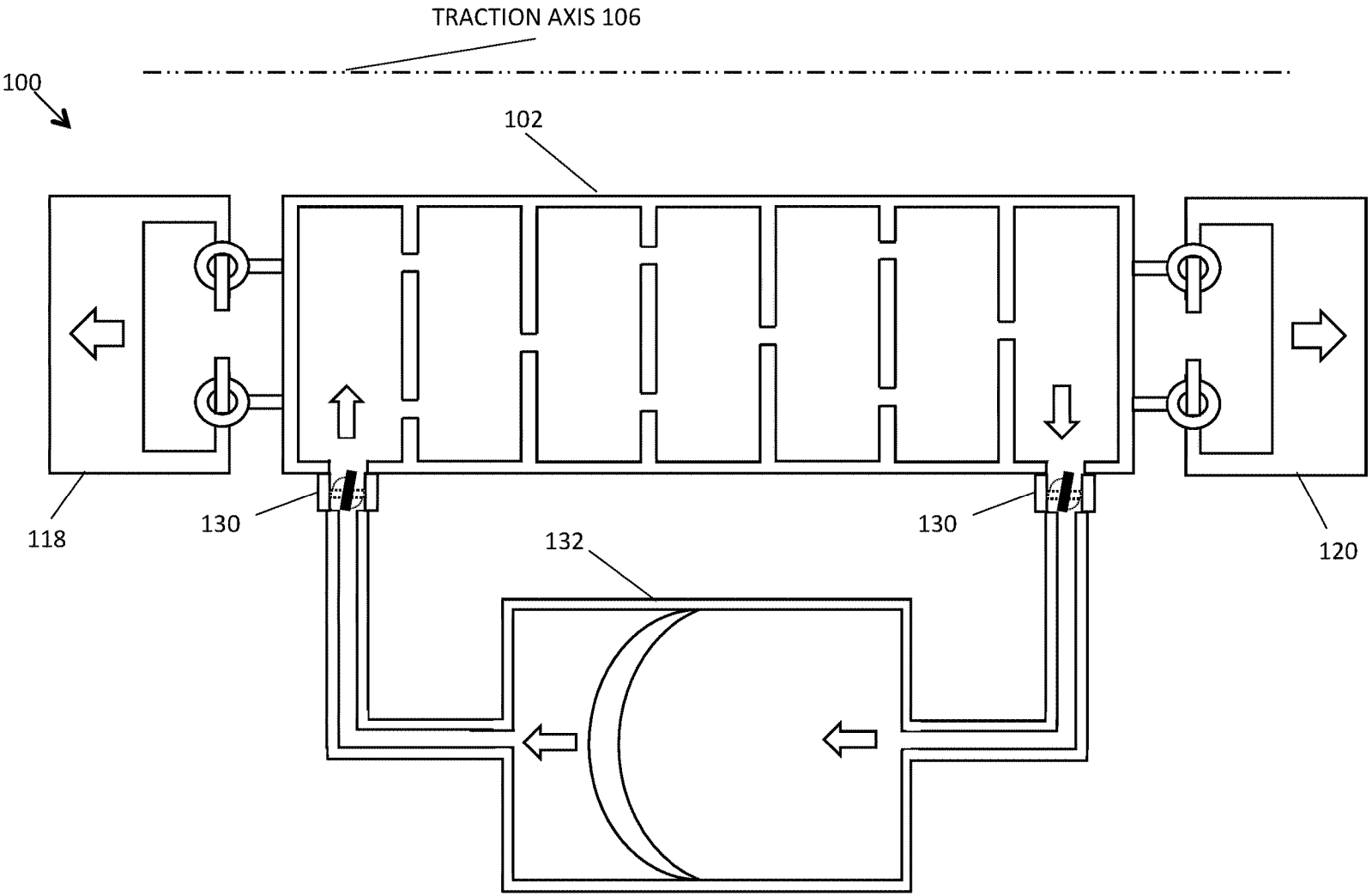
FIGURE 5C – RESERVOIR WITH A MEMBRANE

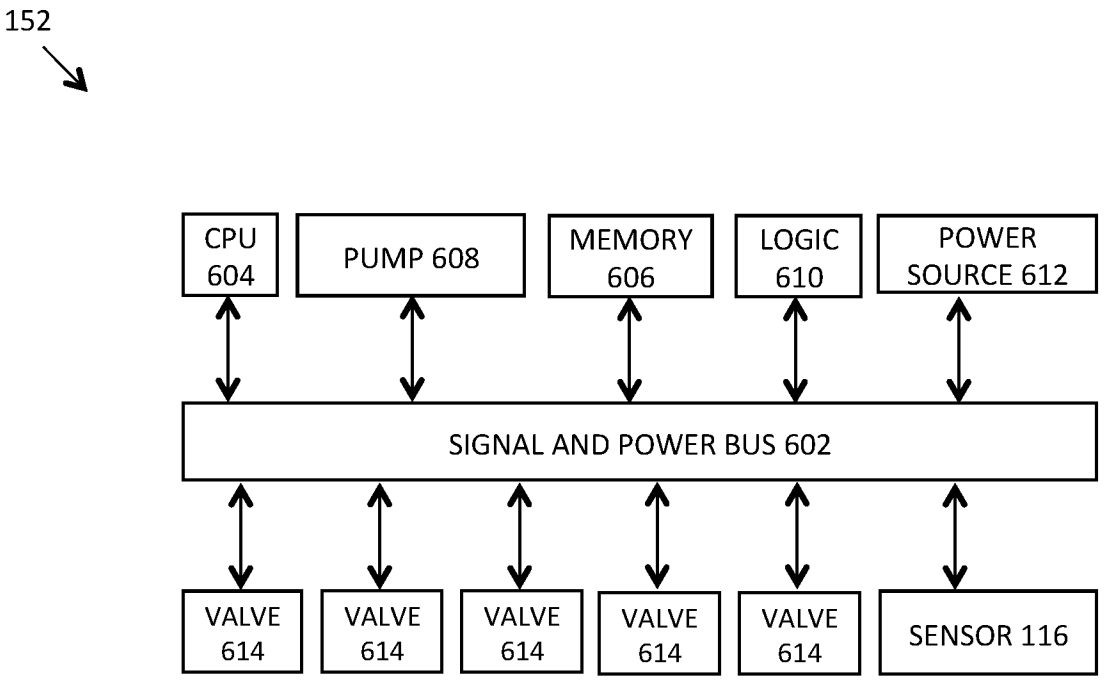
FIG 6 - CONTROL SCHEMATIC

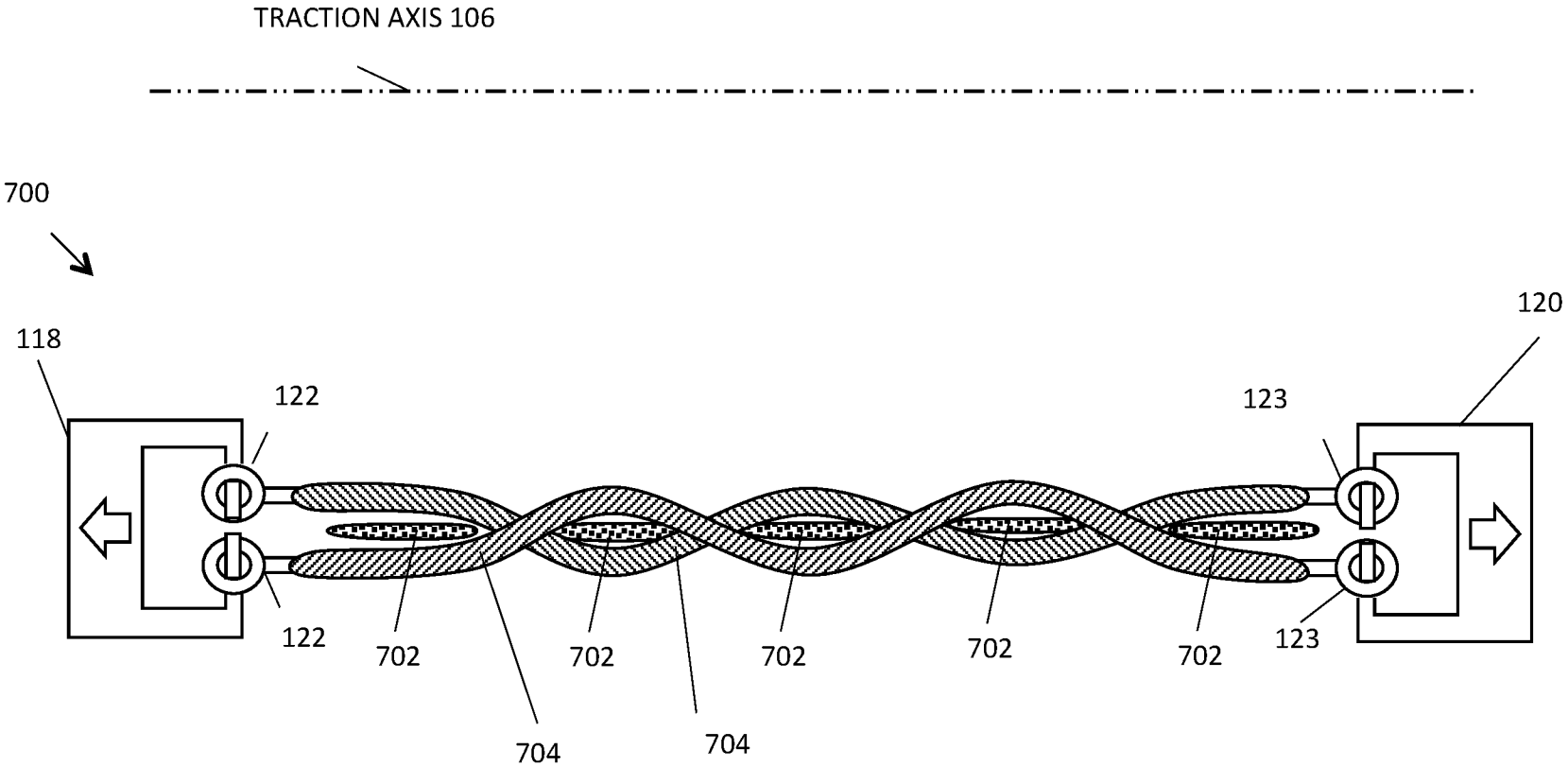
FIGURE 7A: TRUE SIDE VIEW — EXTENDED POSITION

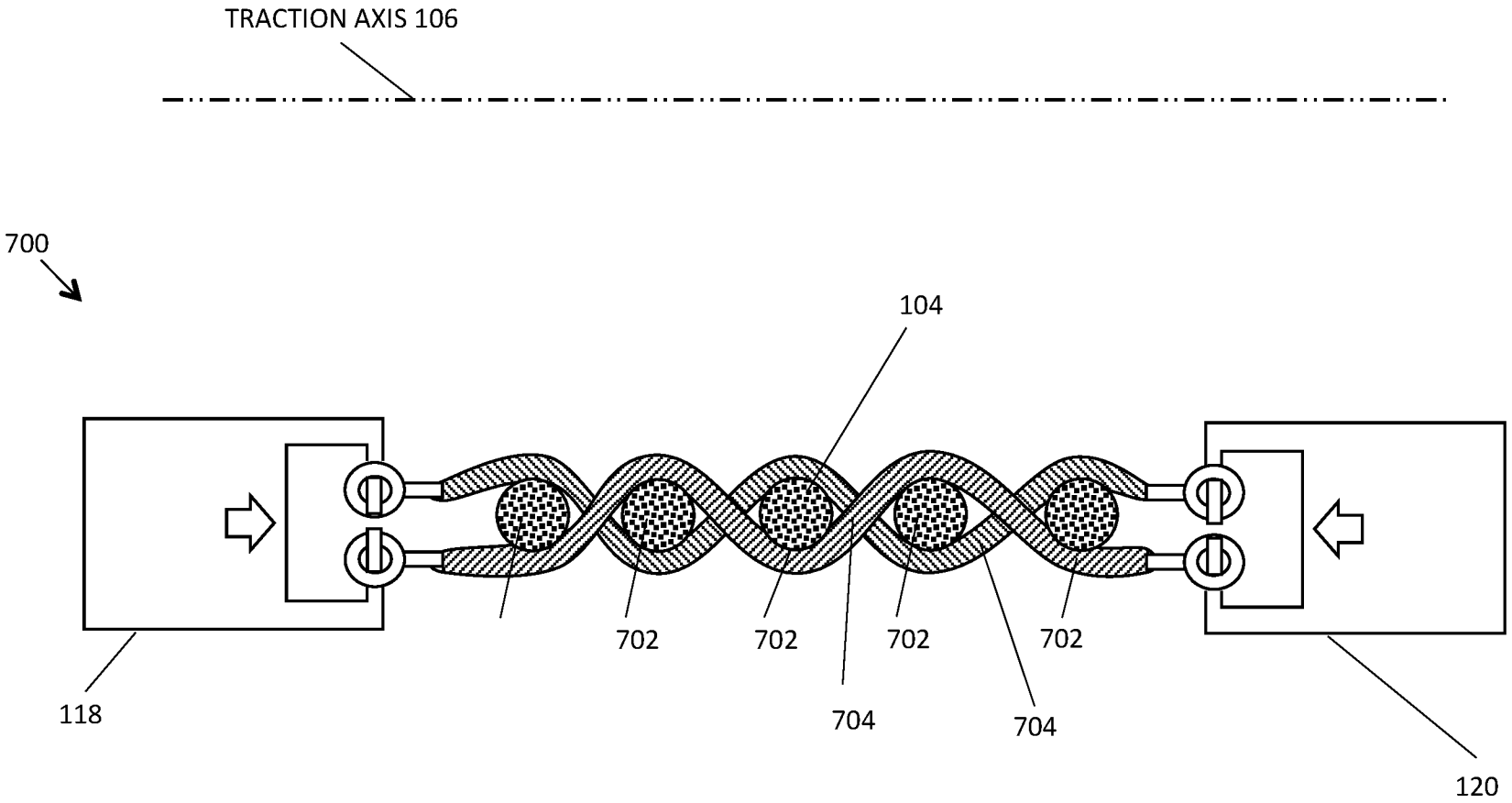
FIGURE 7B: TRUE SIDE VIEW, COMPRESSED POSITION

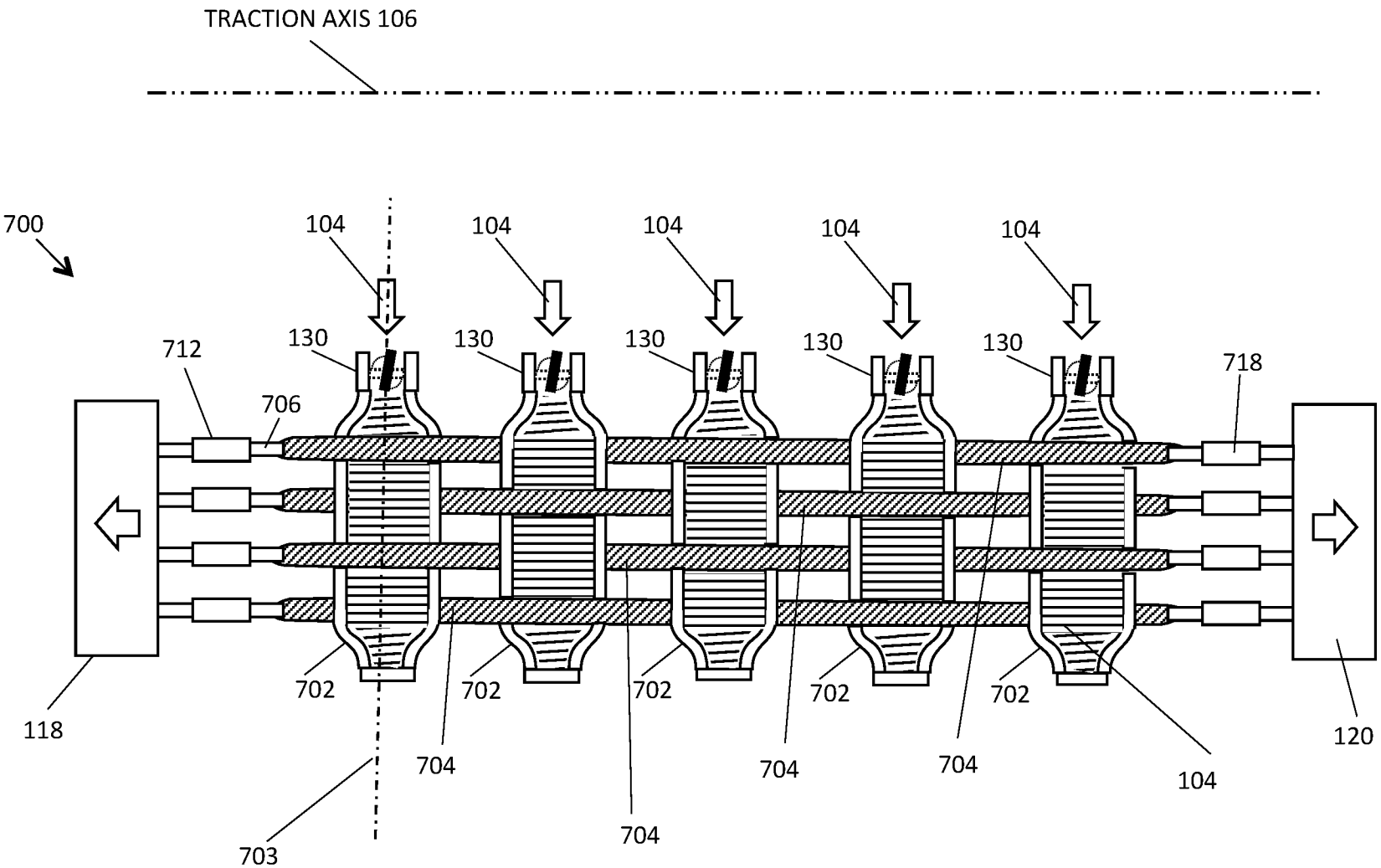
FIGURE 7C: TRUE TOP VIEW, EXTENDED POSITION

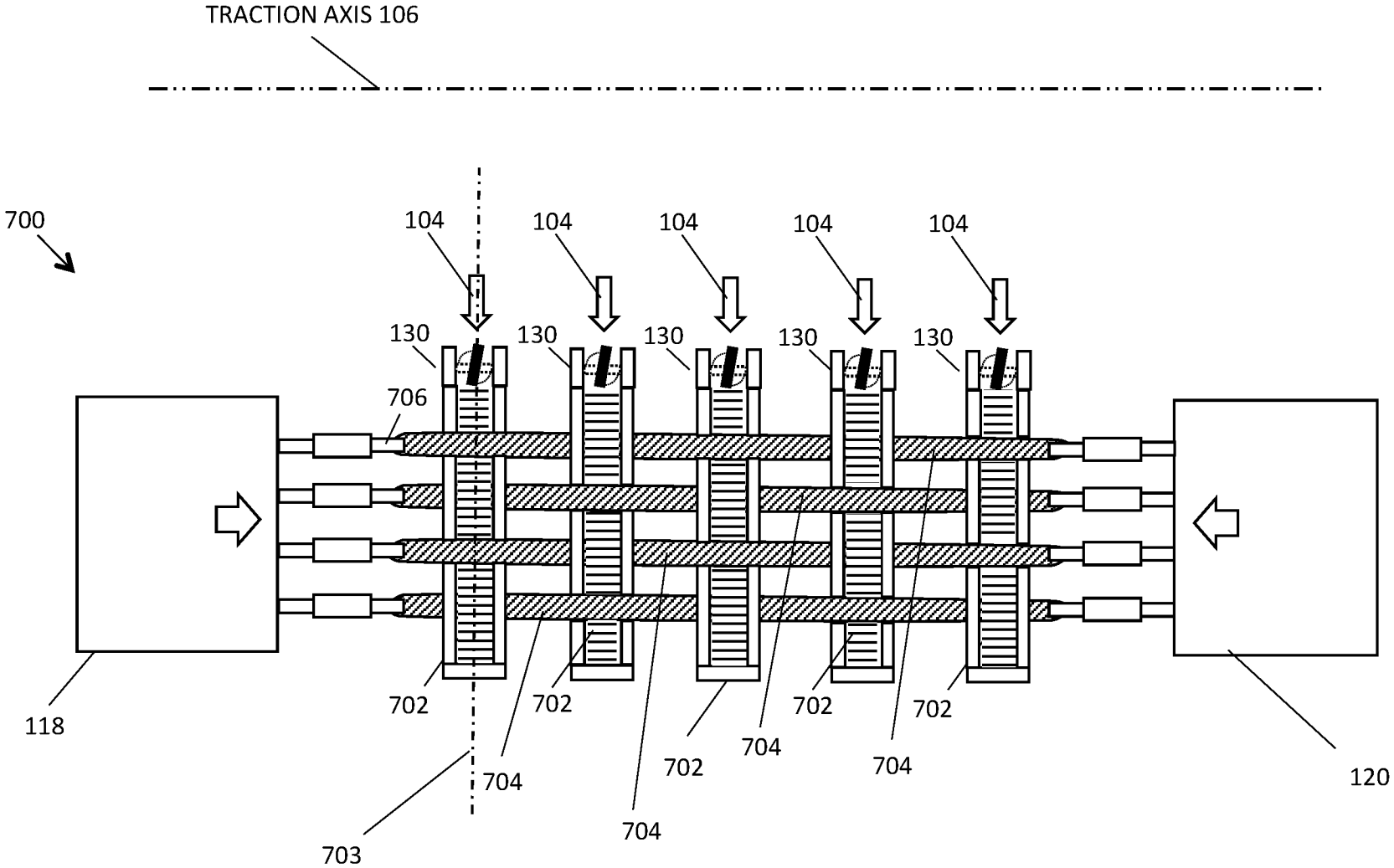
FIGURE 7D: TRUE TOP VIEW, COMPRESSED POSITION

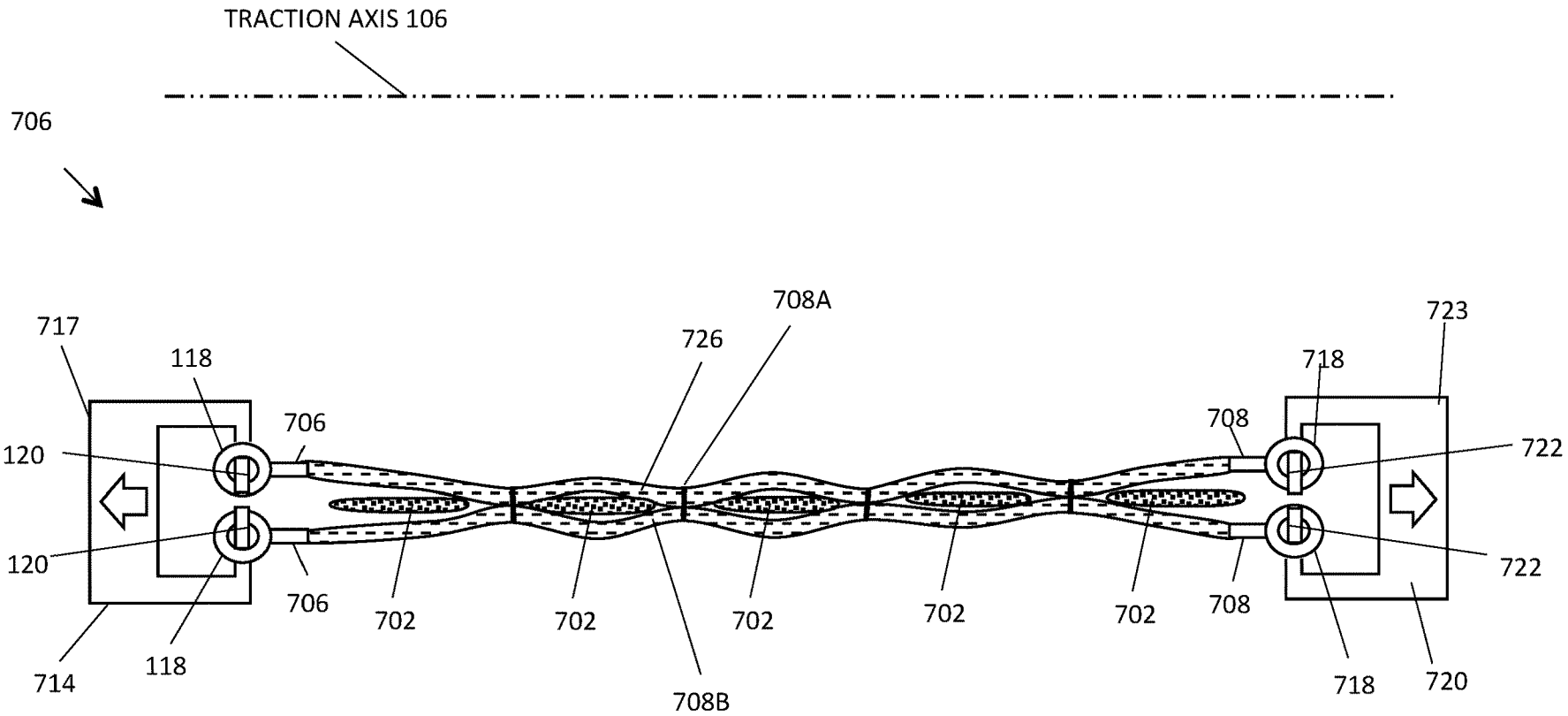
FIGURE 7E: TEXTILE MATERIAL, TRUE SIDE VIEW - EXTENDED POSITION

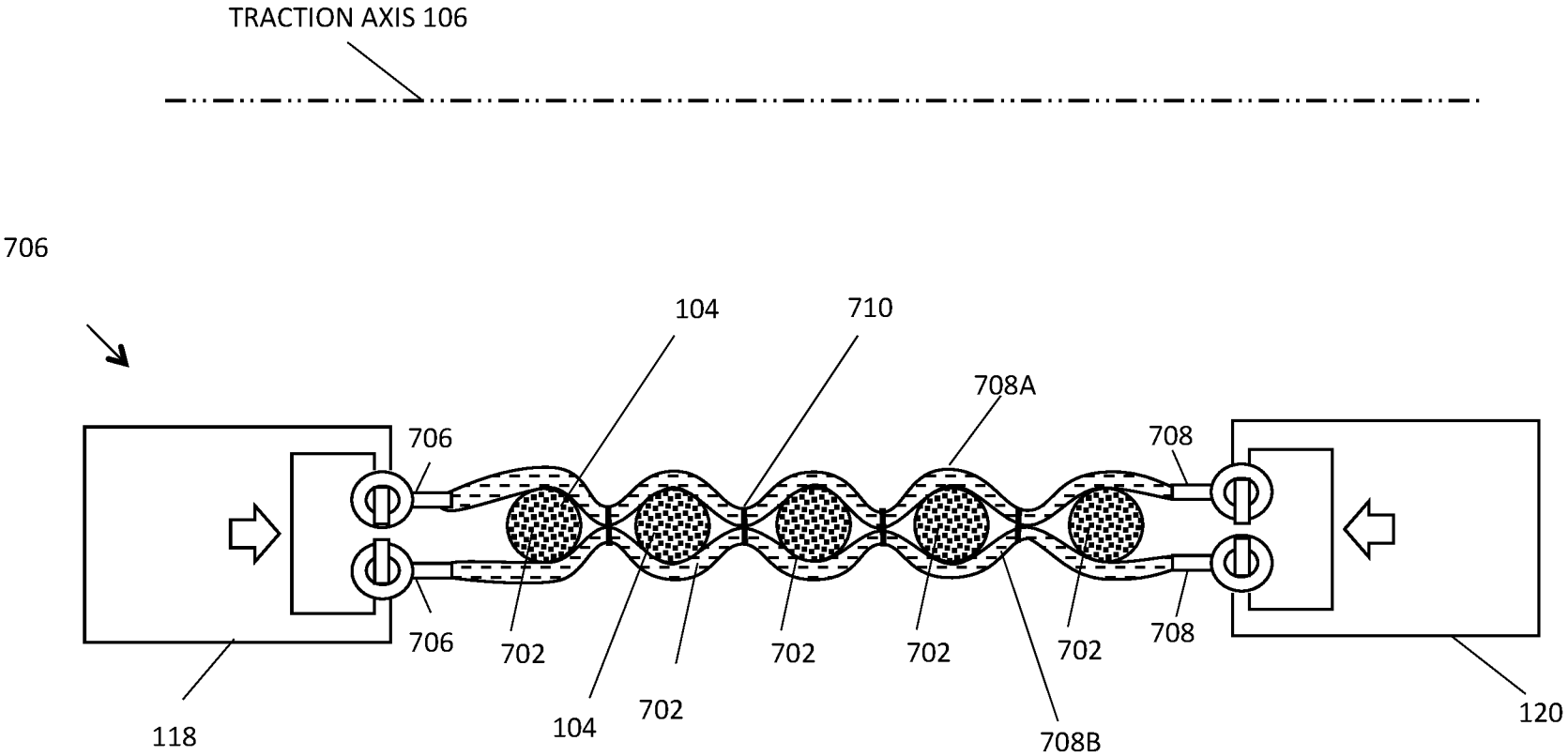
FIGURE 7F: TEXTILE MATERIAL, TRUE SIDE VIEW - COMPRESSED POSITION

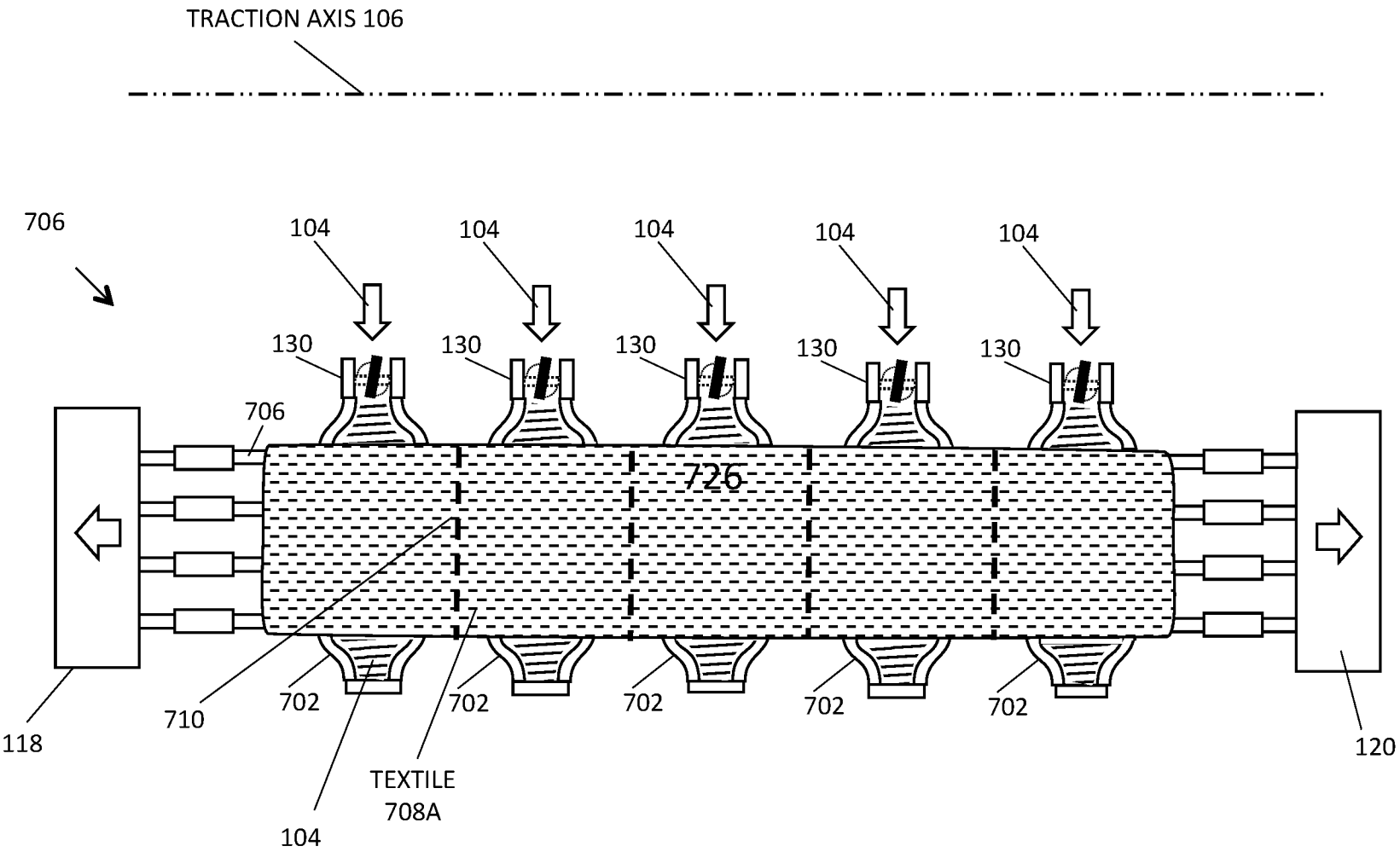
FIGURE 7G: TEXTILE MATERIAL, TRUE TOP VIEW, EXTENDED POSITION

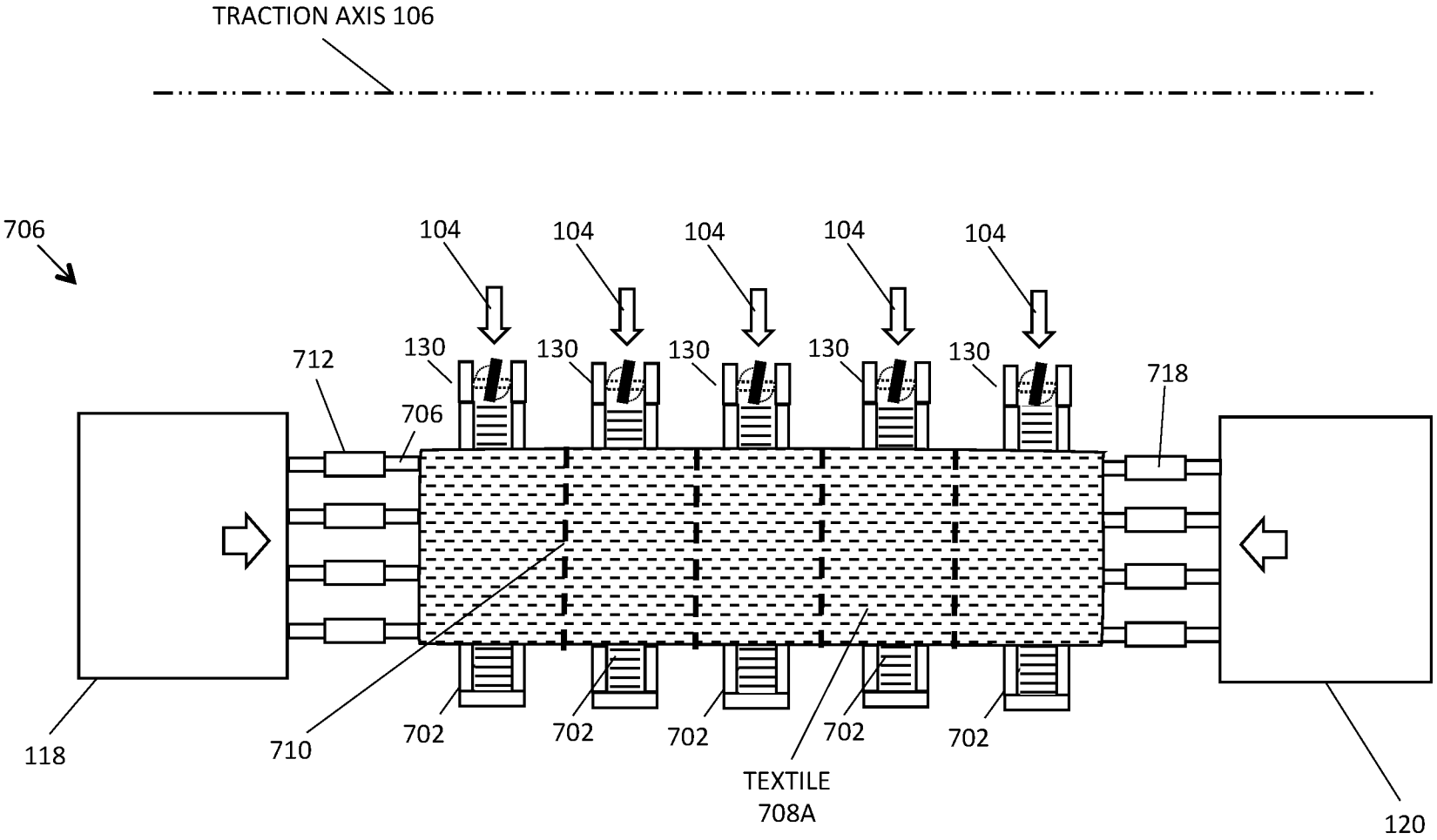
FIGURE 7H: TEXTILE MATERIAL, TRUE TOP VIEW, COMPRESSED POSITION

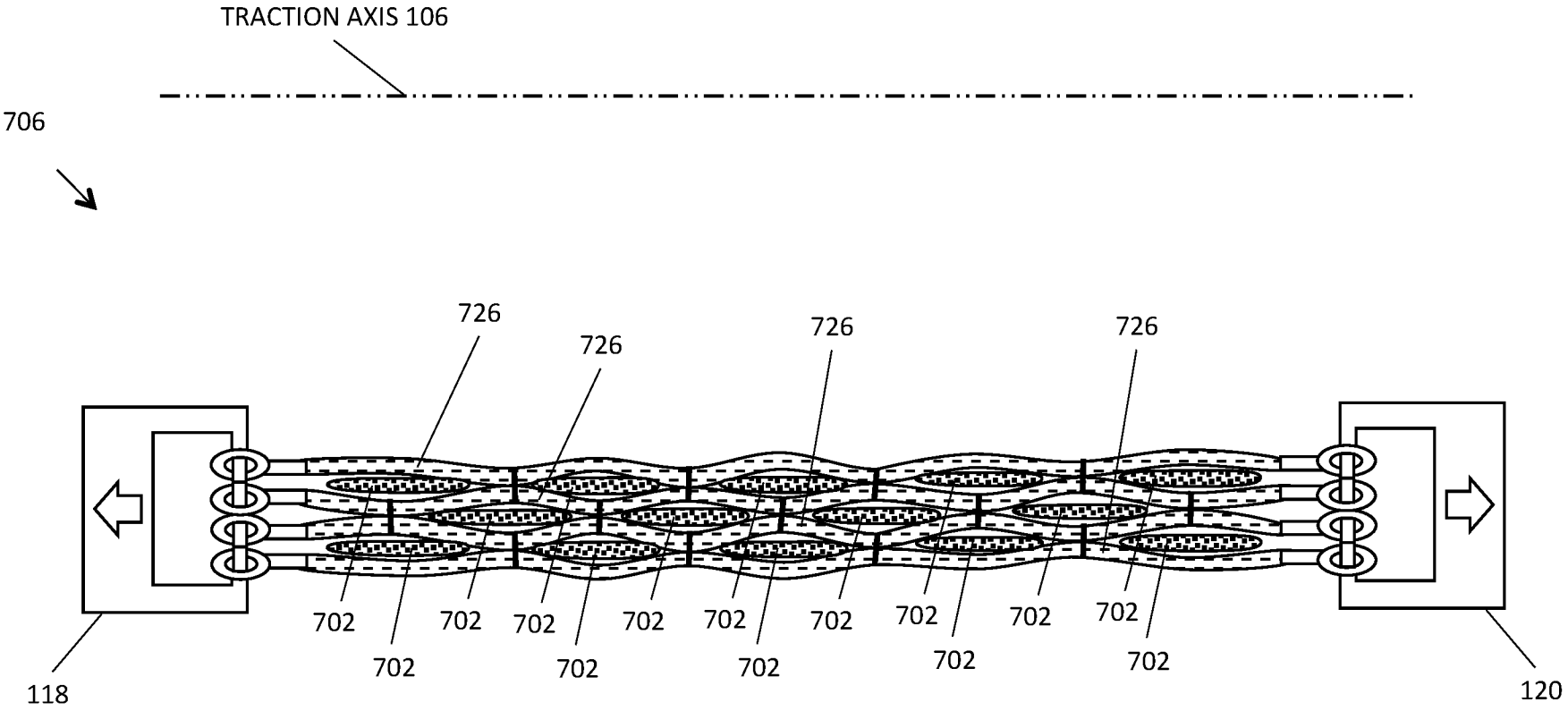
FIGURE 7I: MULTI-BLADDER DESIGN, TRUE SIDE VIEW - EXTENDED POSITION

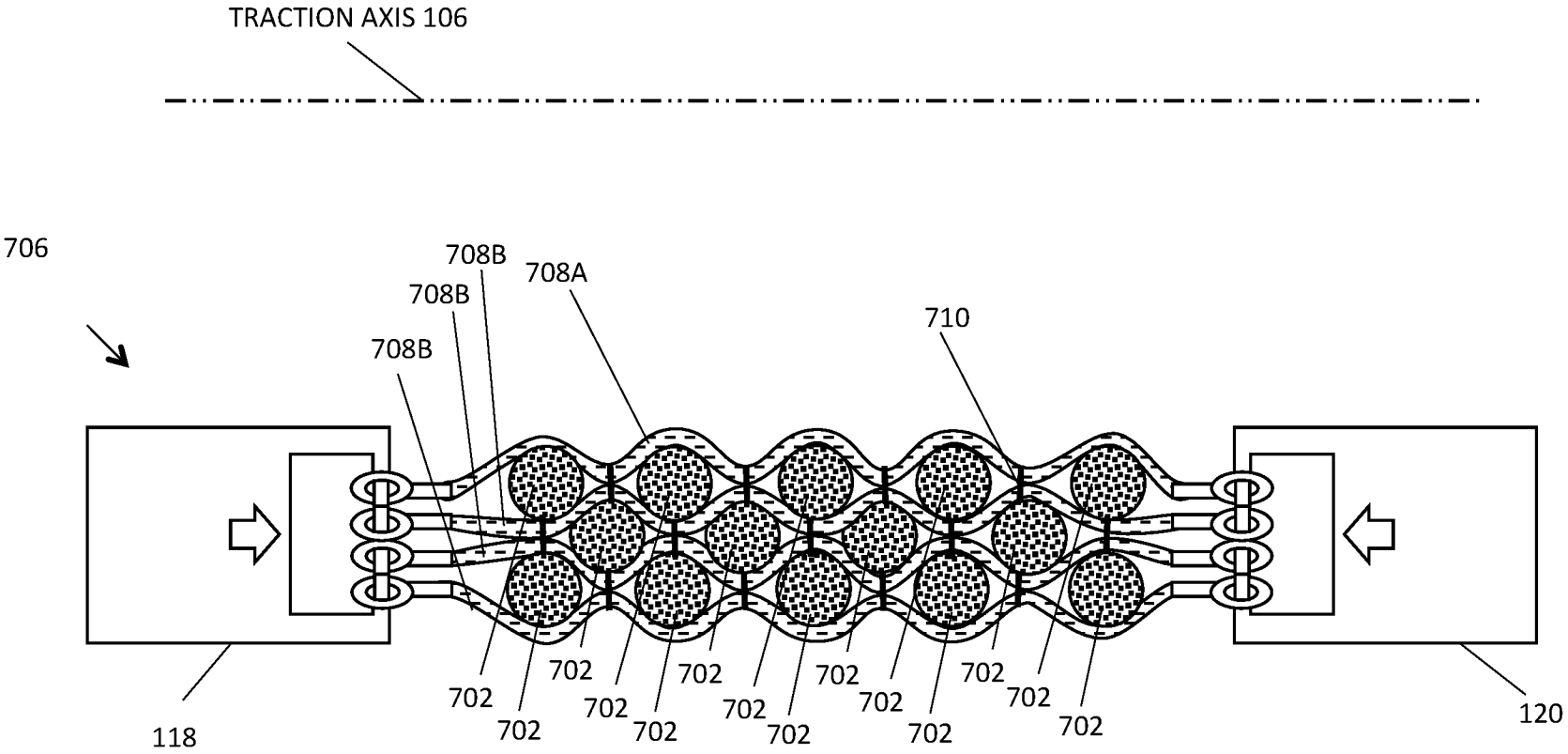
FIGURE 7J: MULTI-BLADDER DESIGN, TRUE SIDE VIEW - COMPRESSED POSITION

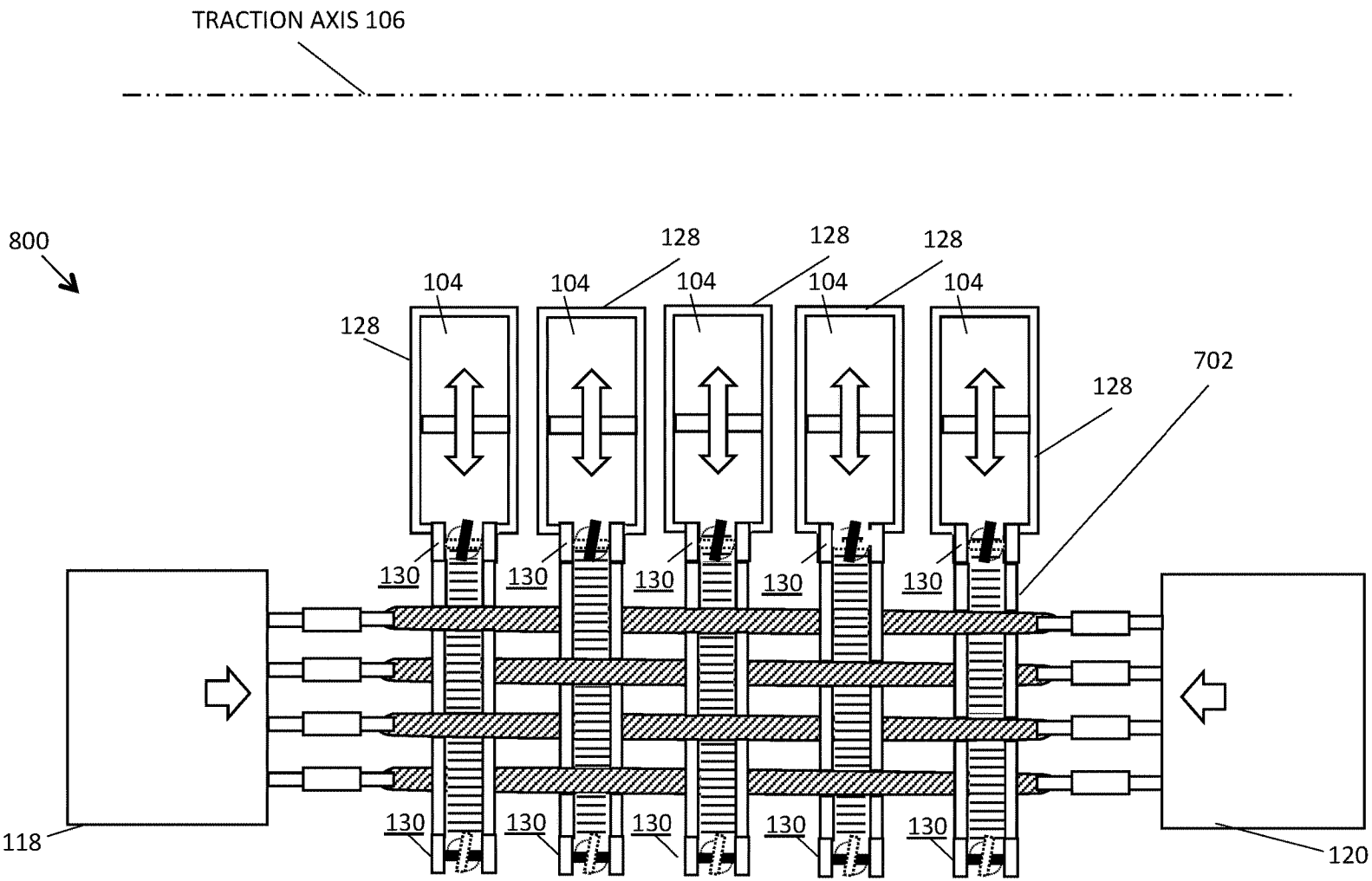
FIGURE 8A: AIR COMPRESSOR FOR EVERY BLADDER (PZT PUMP)

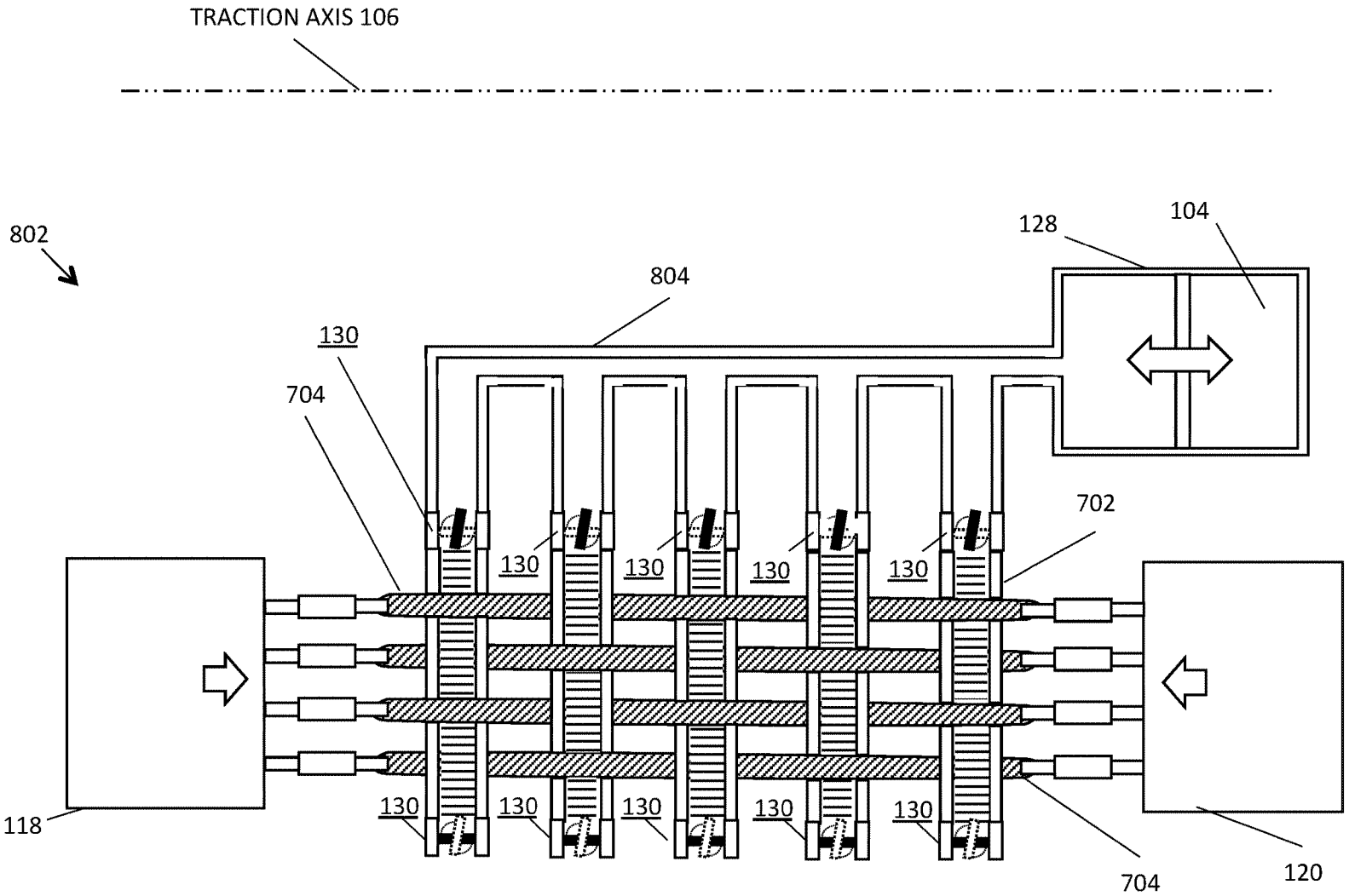
FIGURE 8B: AIR/LIQUID COMPRESSOR FOR THE WHOLE MUSCLE (PZT PUMP)

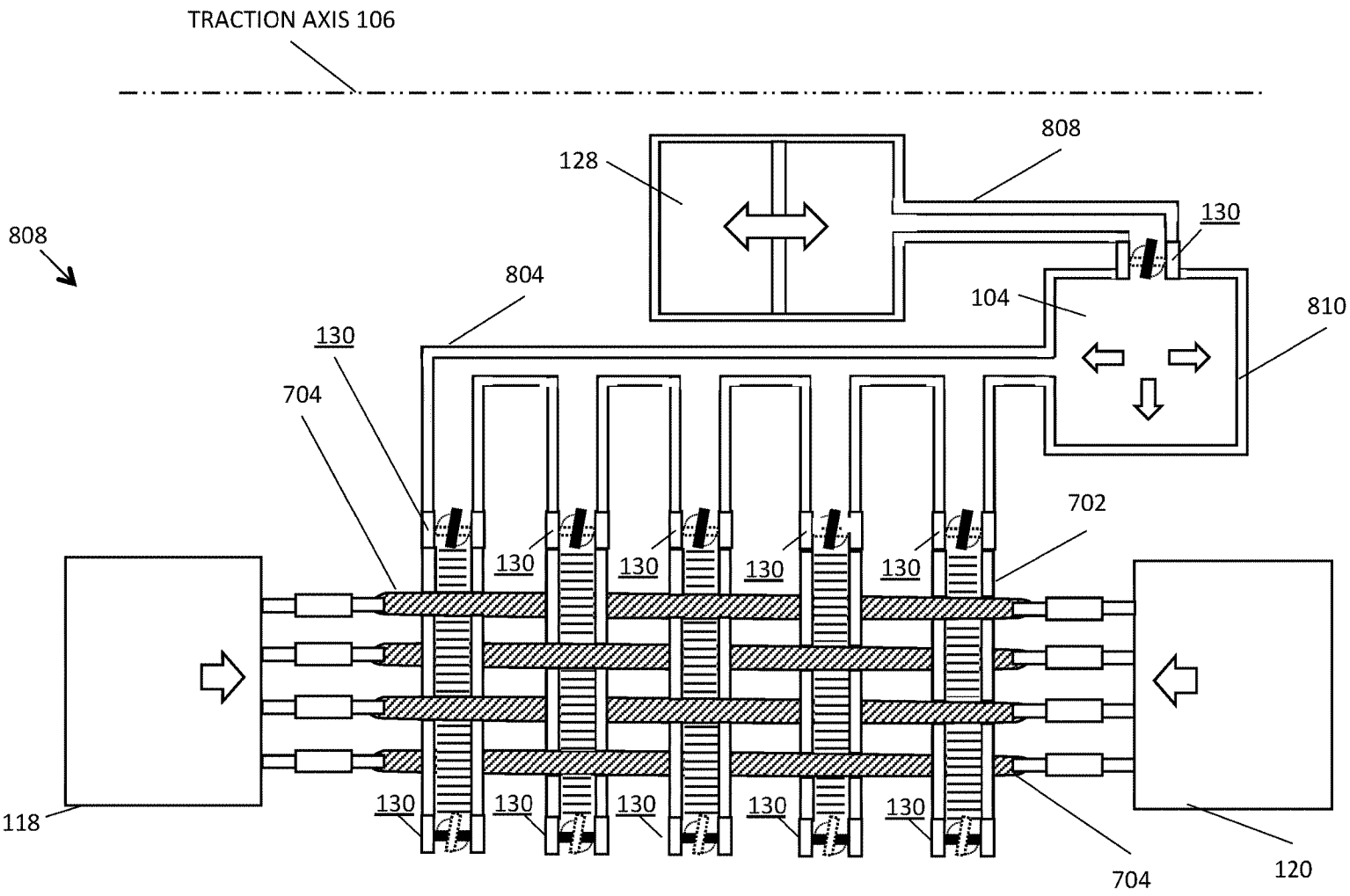
FIGURE 8C: AIRCOMPRESSOR FOR THE WHOLE MUSCLE (PZT PUMP) WITH AIR CAPACITOR

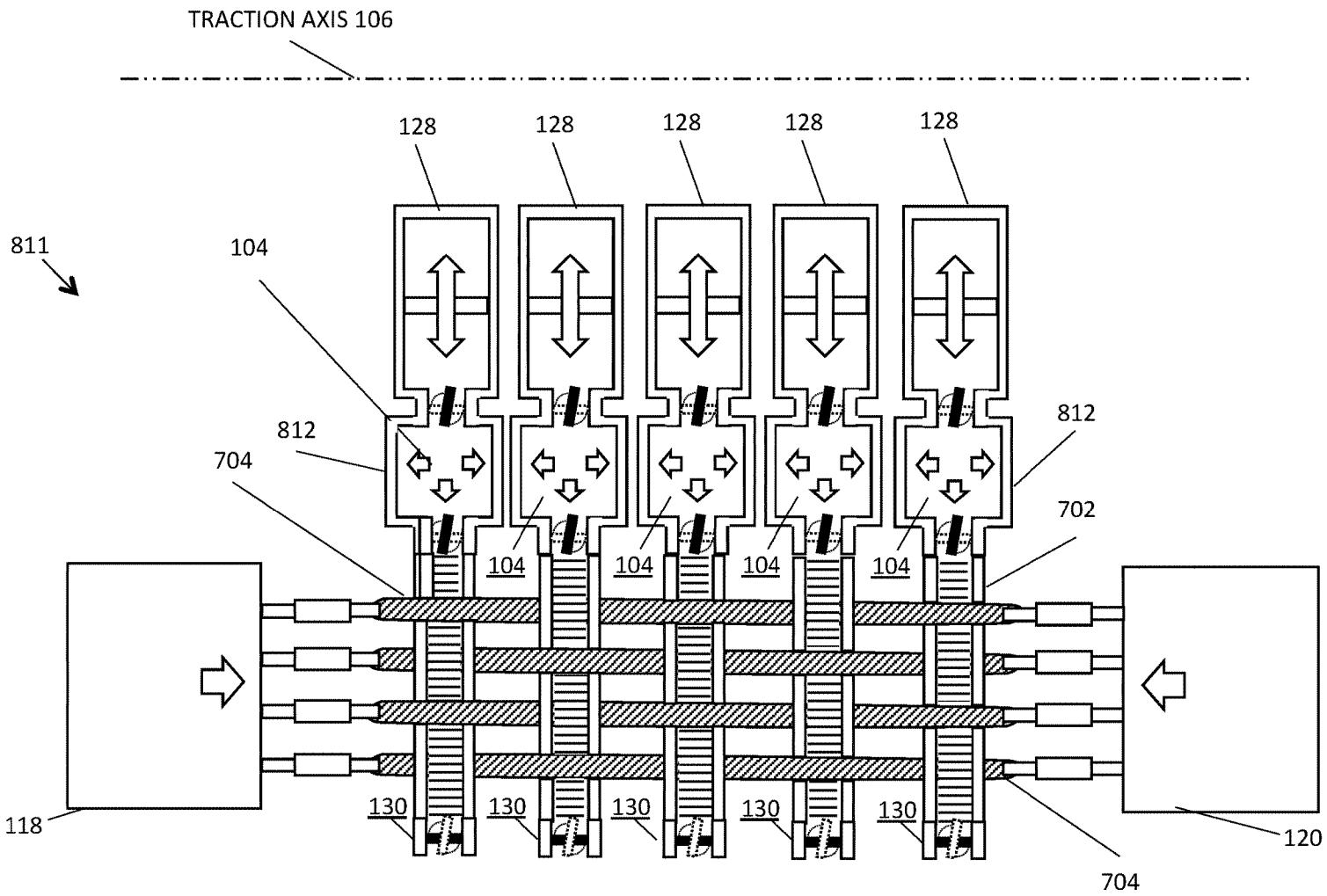
FIGURE 8D: AIR COMPRESSOR FOR EVERY BLADDER (PZT PUMP) WITH AIR CAPACITOR

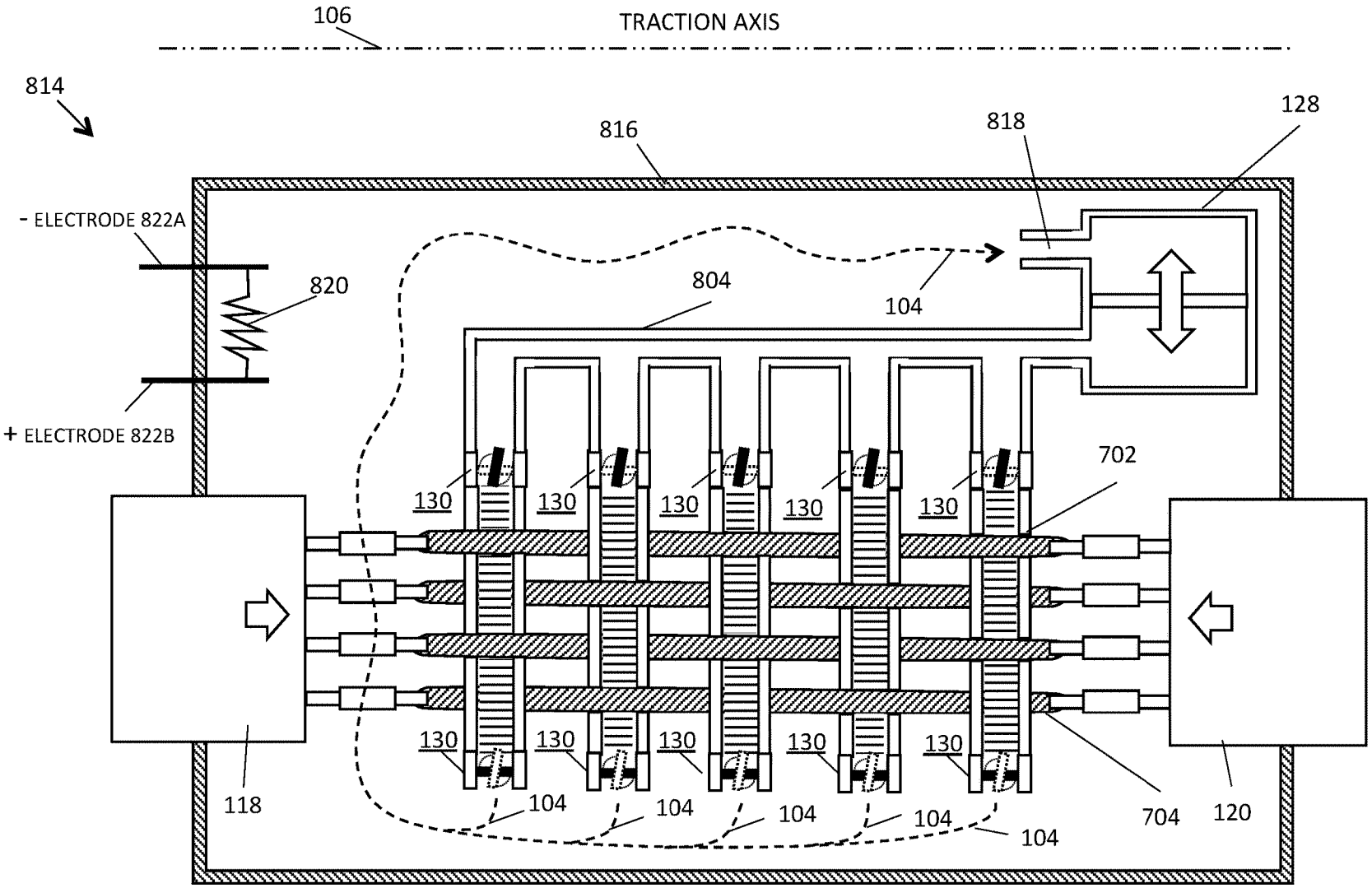
FIGURE 8E: SEALED CLOSED LOOP CIRCULATION MUSCLE WITH INTERNAL PUMP

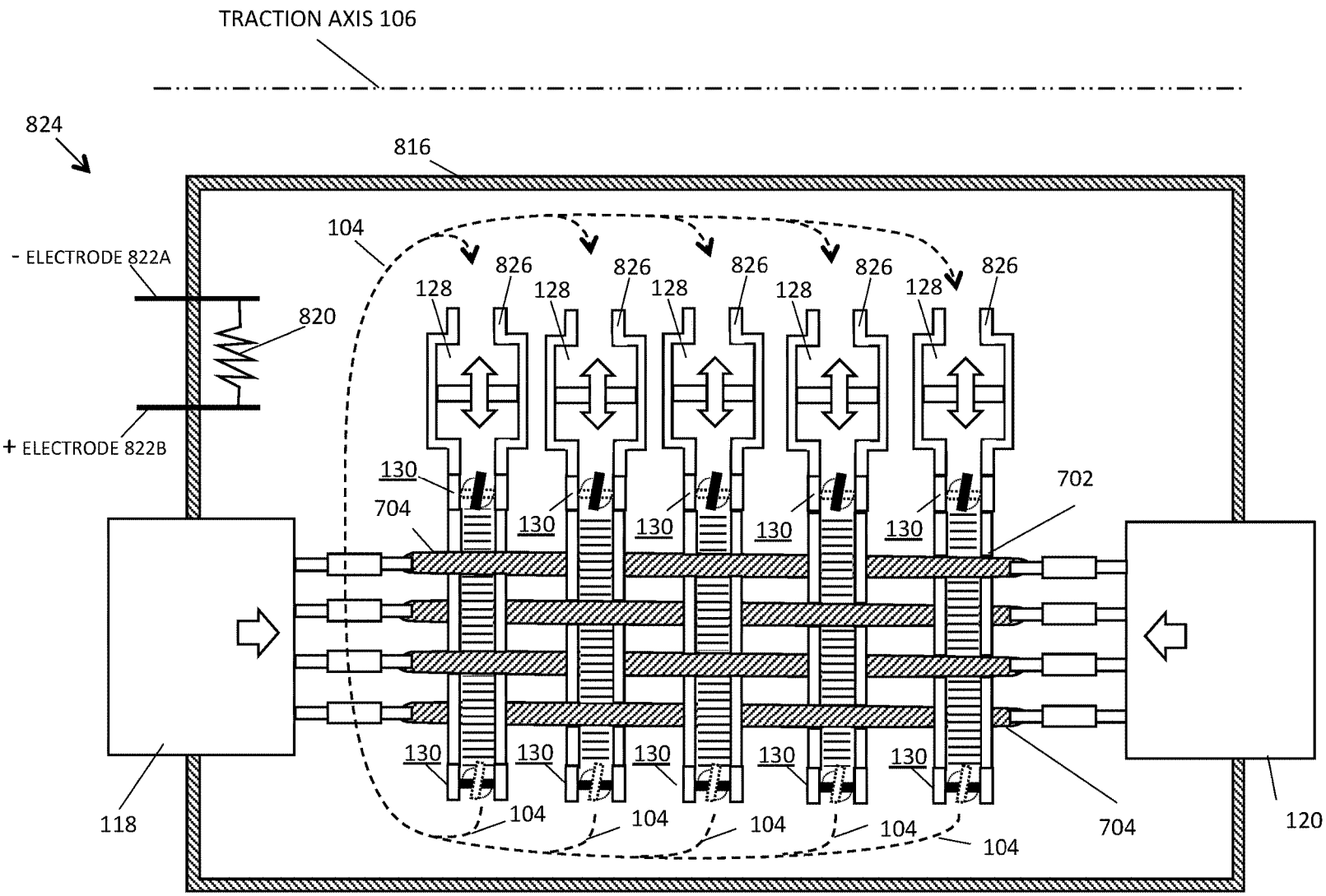
FIGURE 8F: SEALED CLOSED LOOP CIRCULATION MUSCLE WITH INTERNAL PUMPS

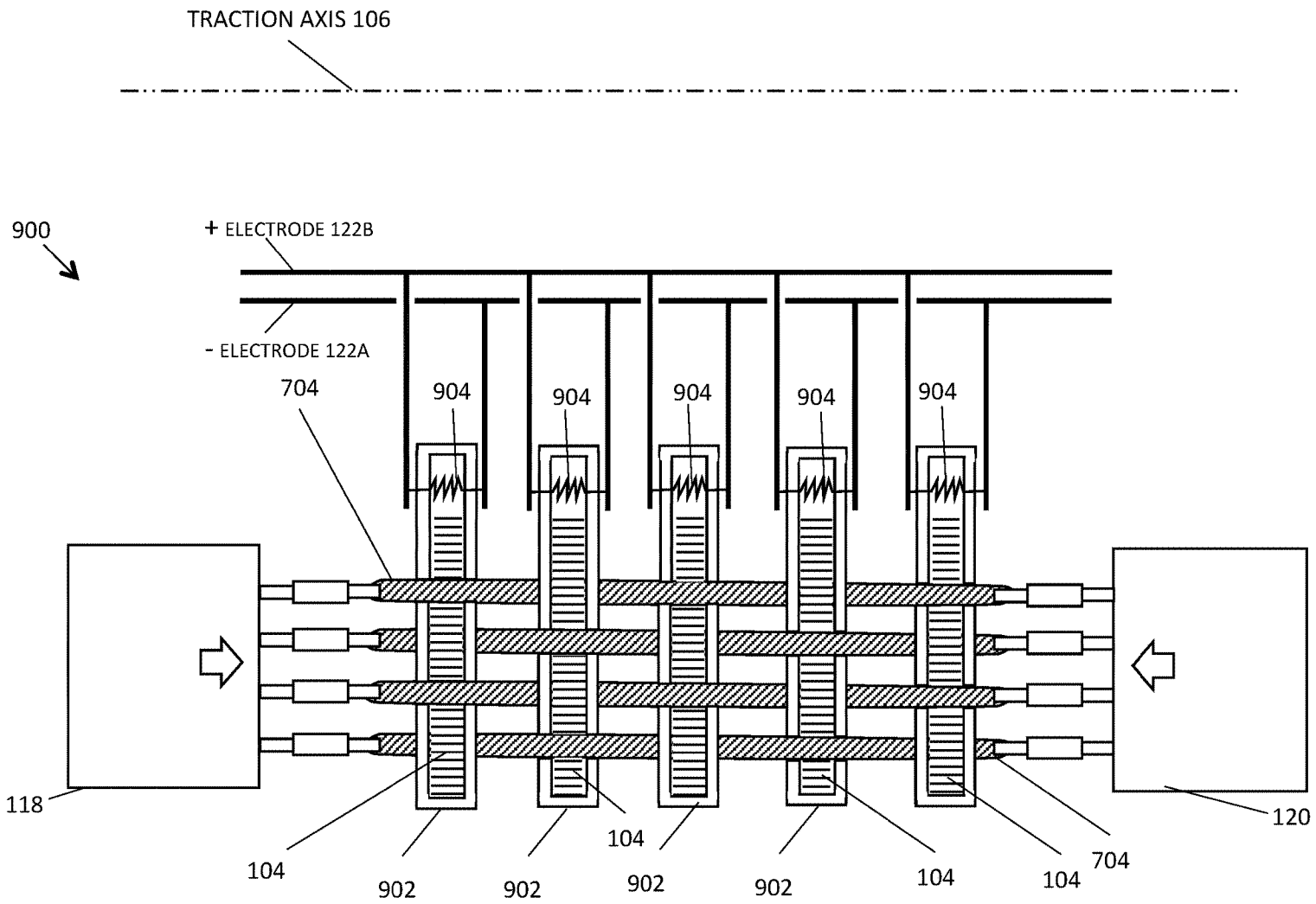
FIGURE 9A: BLADDER WITH ITS OWN STEAM GENERATOR (NANOCARBON THREAD)

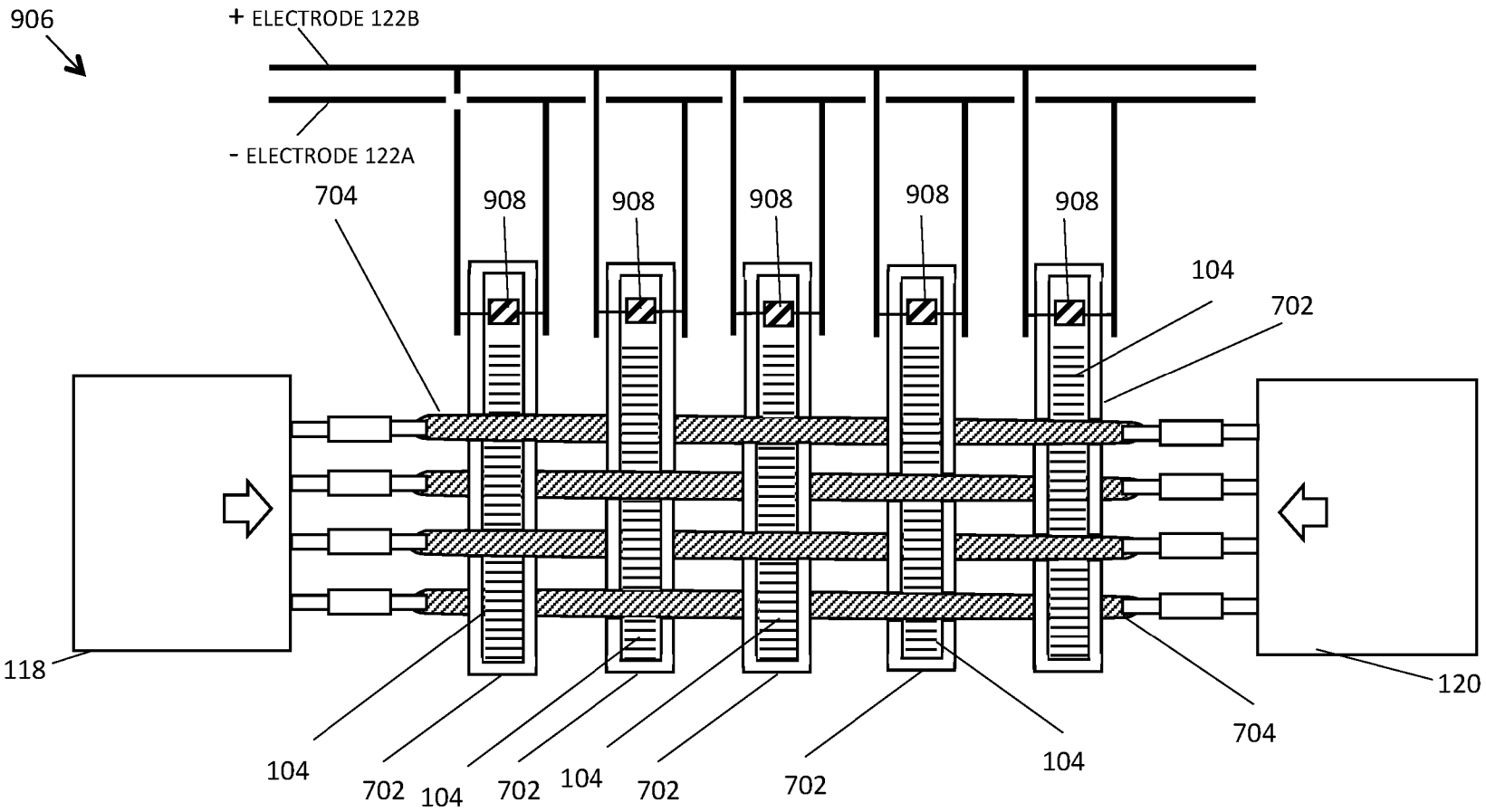
FIGURE 9B: BLADDER WITH ITS OWN STEAM GENERATOR (MICROVAWE TRANSMITTER)

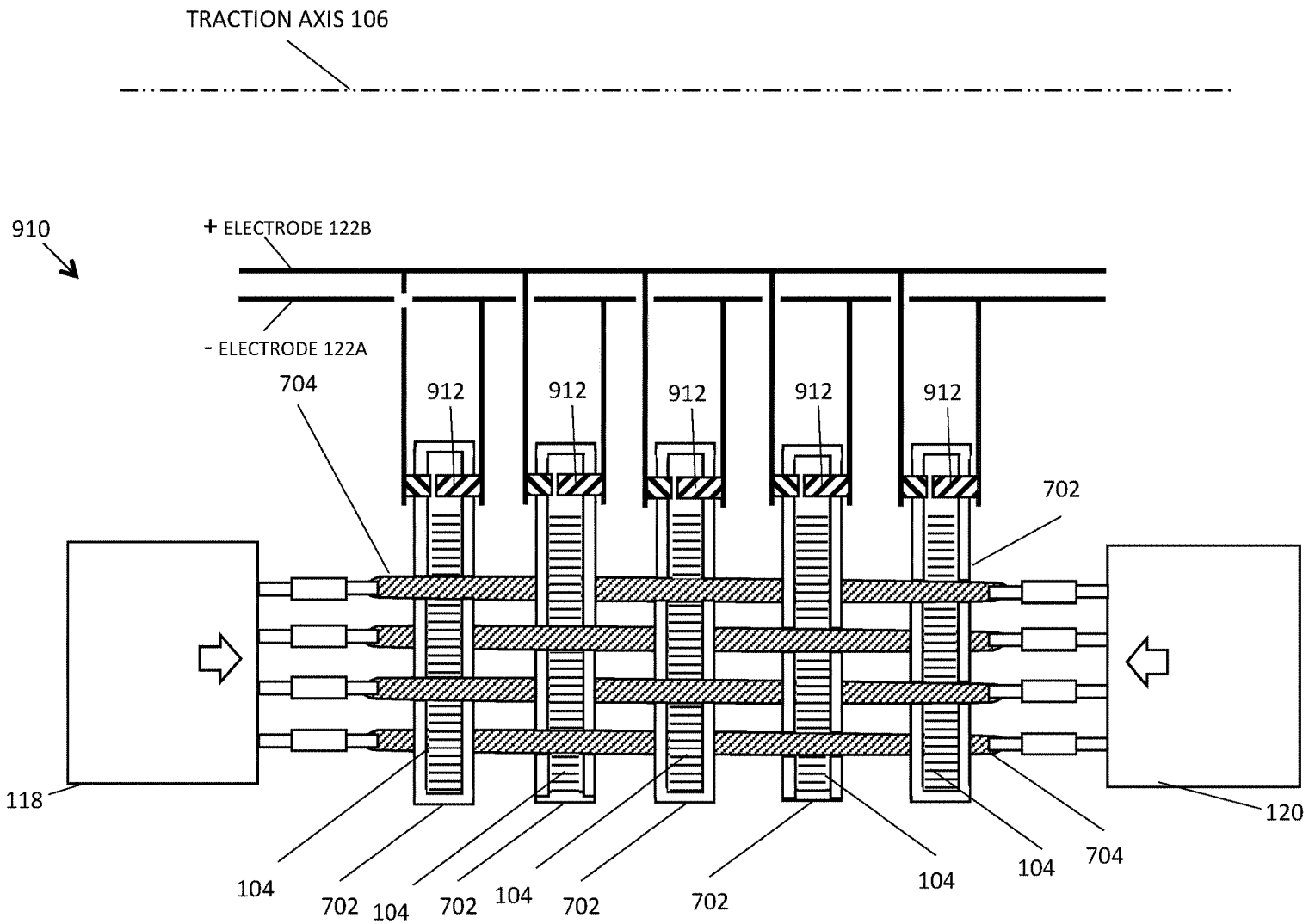
FIGURE 9C: BLADDER WITH ITS OWN STEAM GENERATOR (PELTIER–SEEBECK EFFECT)

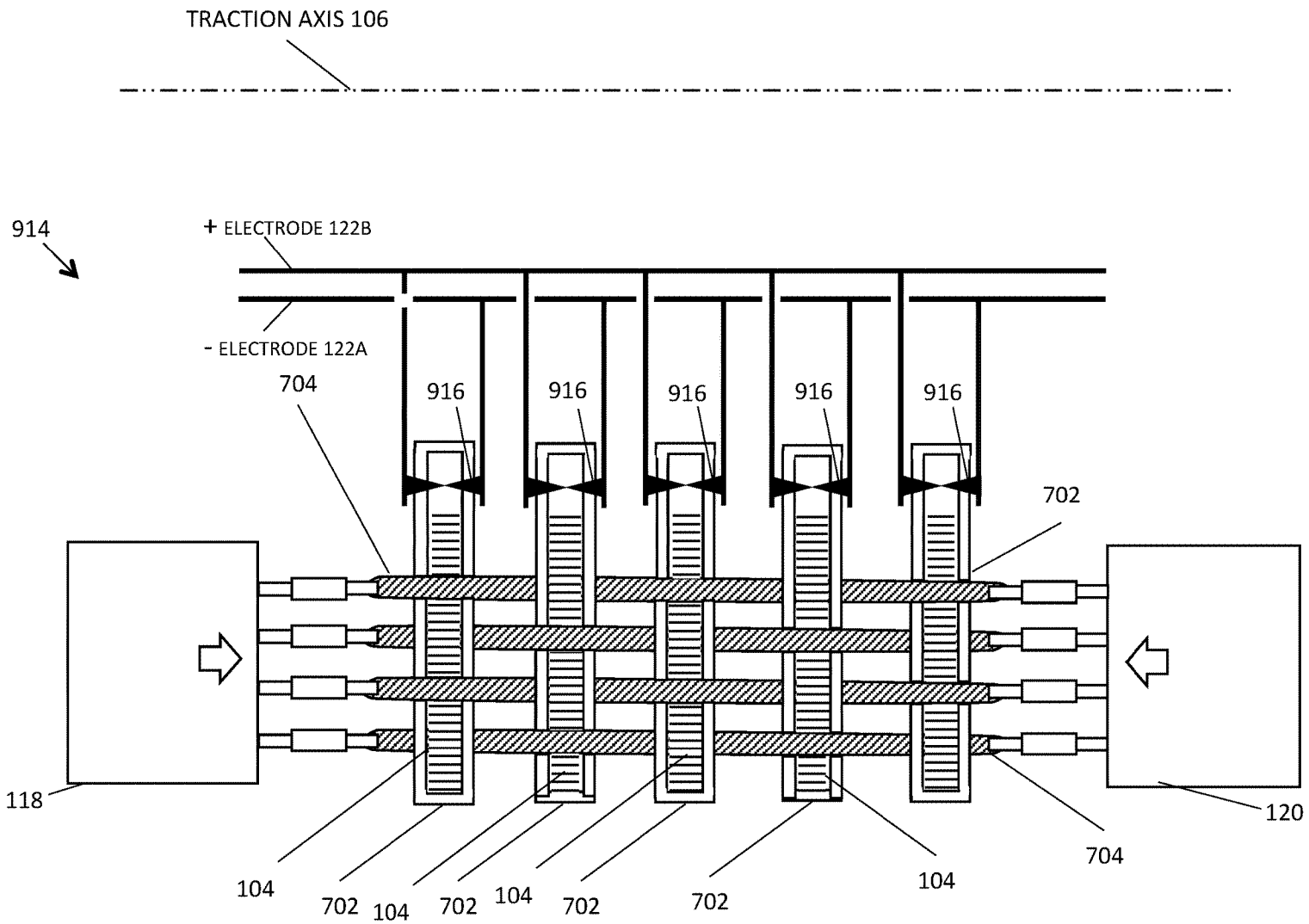
FIGURE 9D: BLADDER WITH ELECTROHYDRAULIC YUTKIN EFFECT (YUTKIN DISCHARGER)

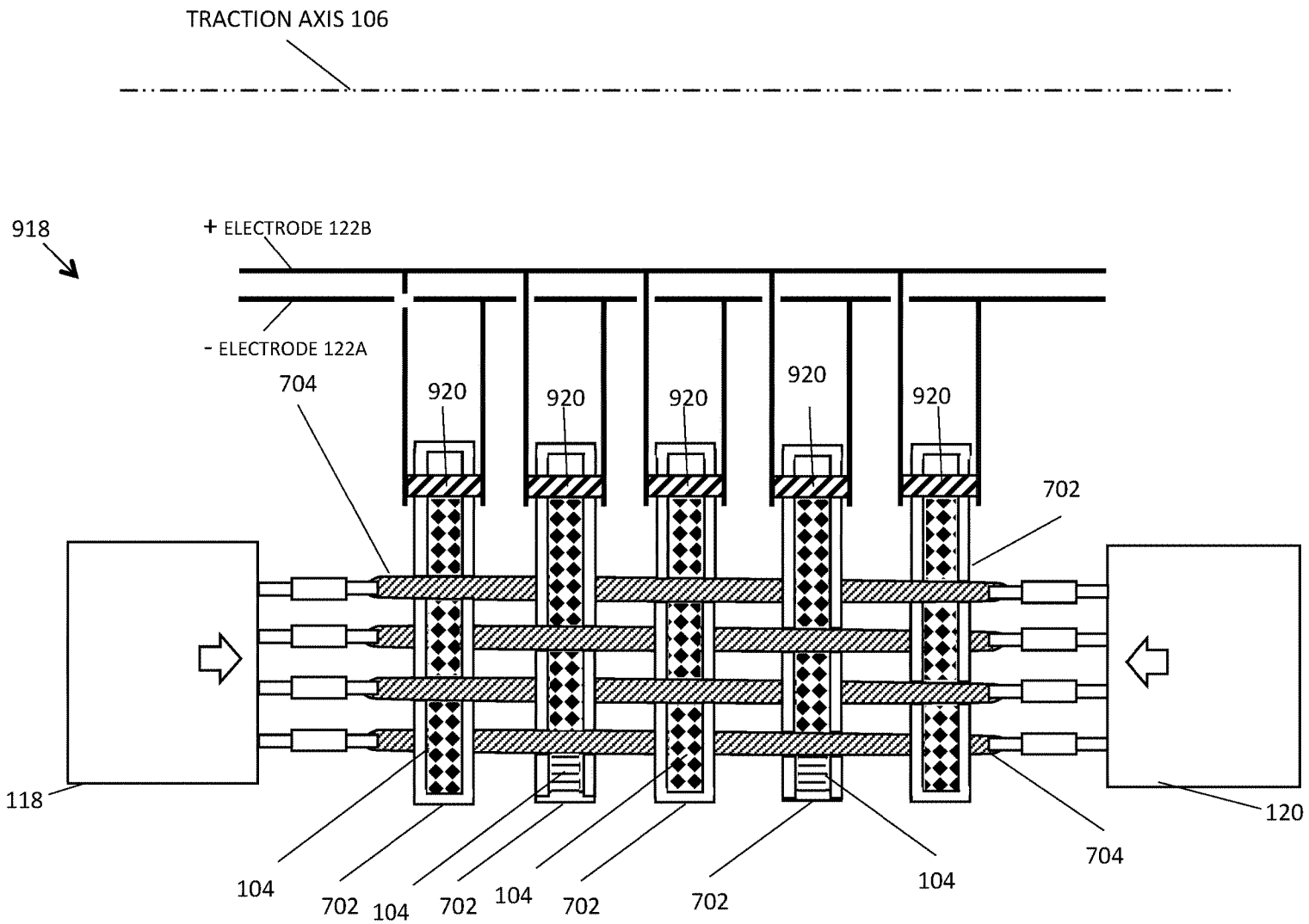
FIGURE 9E: BLADDER WITH MECHANICAL BOILING EFFECT (PIEZO TRANSDUCER)

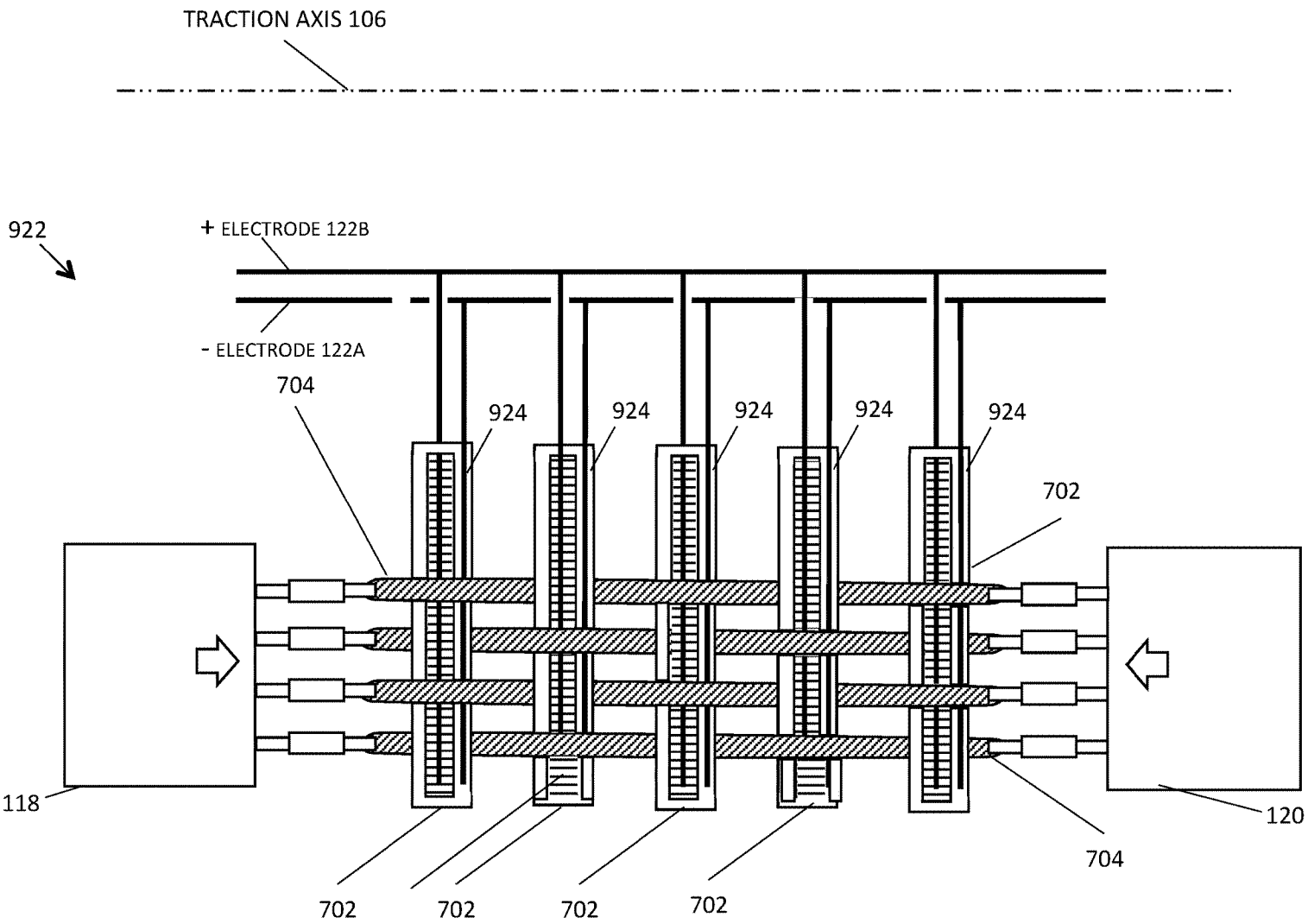
FIGURE 9F: BLADDER WITH HIGH SPEAD TUNEABLE ELECTROACTIVITY HYDROGEL (WITH SEMIPOROUS WALLS)

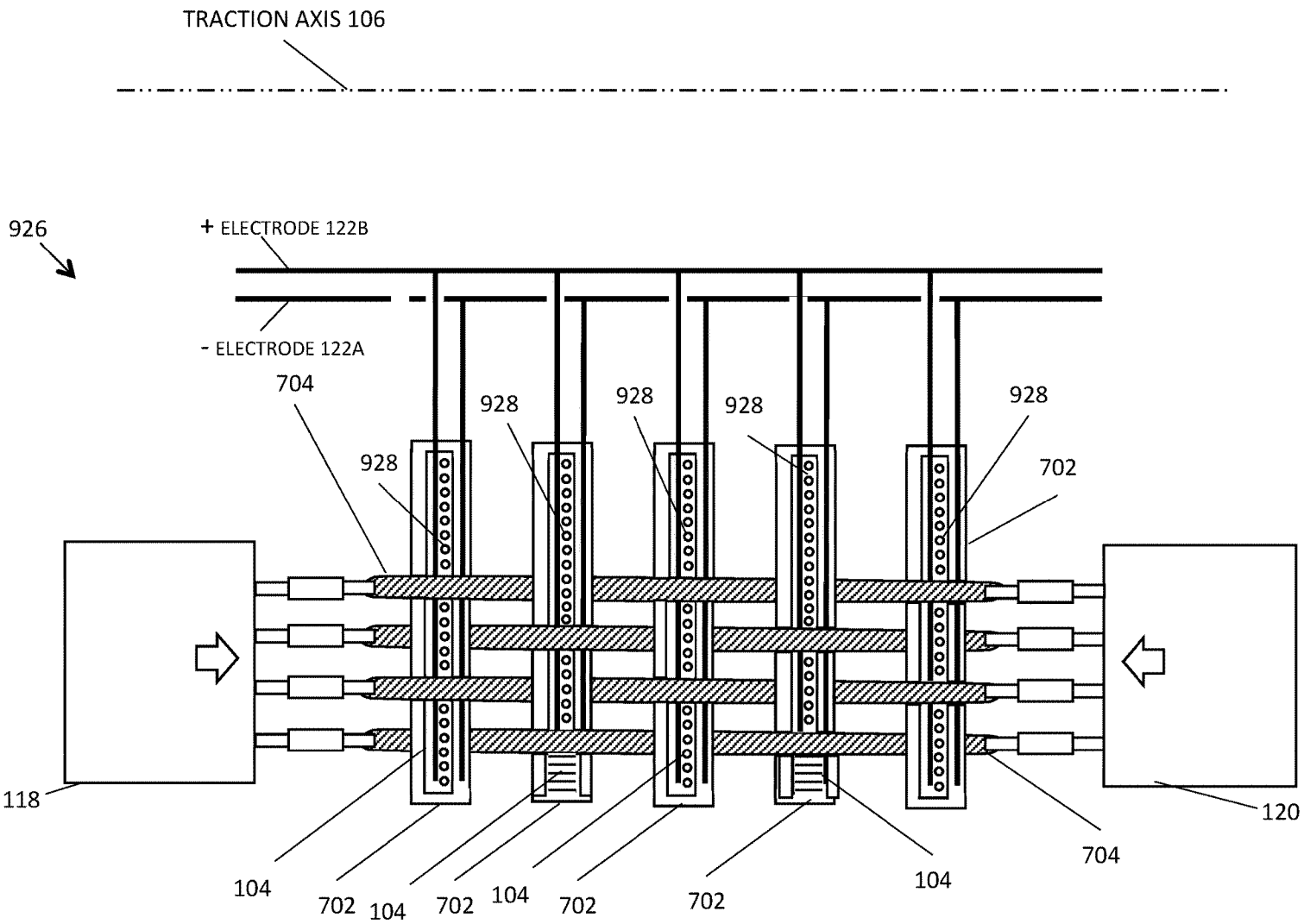
FIGURE 9G: 1-TIME CONTRACTING BLADDER WITH SWELLING PARTICLES COATED WITH A SHELL, DESTRUCTABLE ELECTRICALY

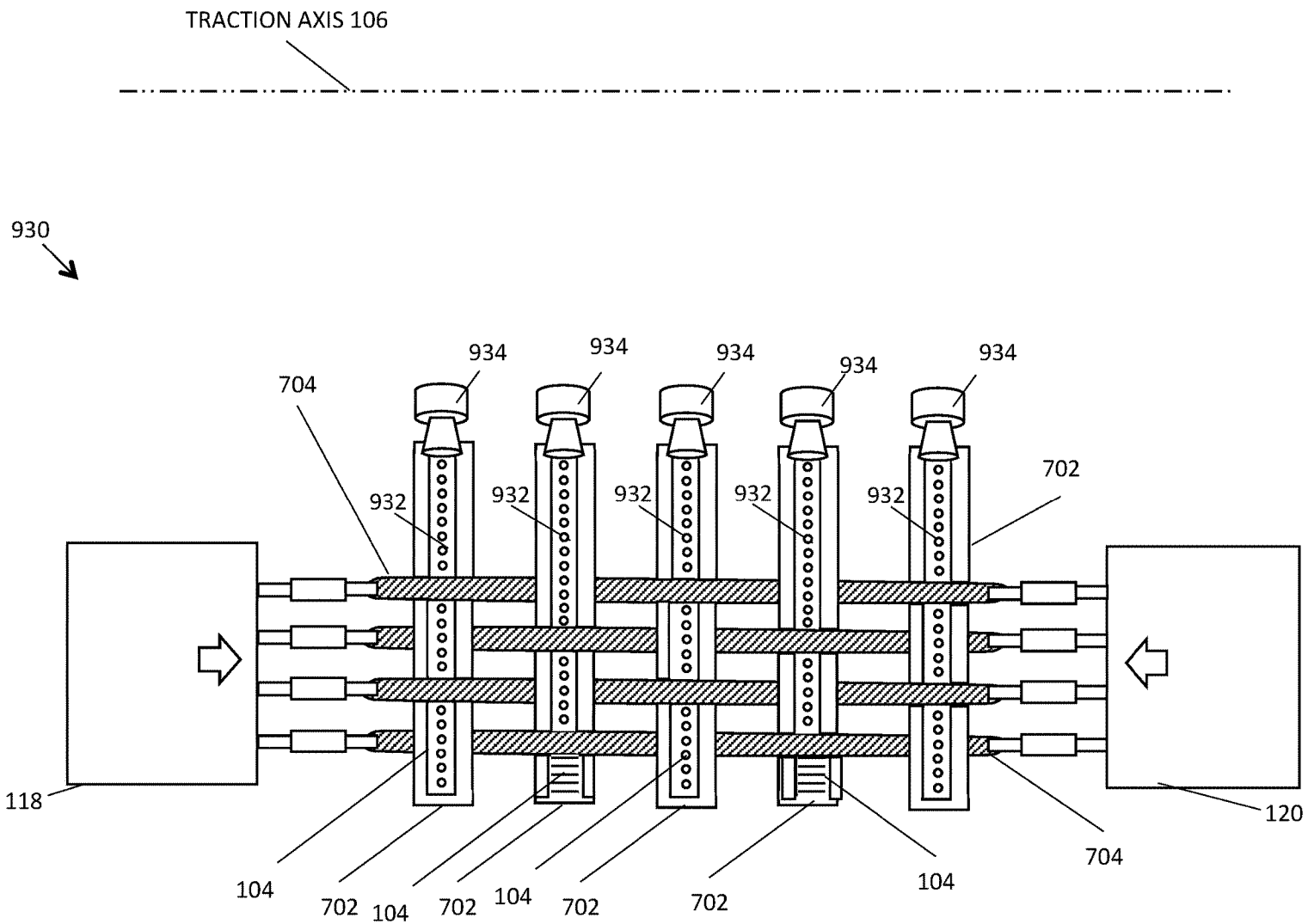
FIGURE 9H: 1-TIME CONTRACTING BLADDER WITH SWELLING PARTICLES COATED WITH A SHELL, DESTRUCTABLE BY A SOUND WAVE

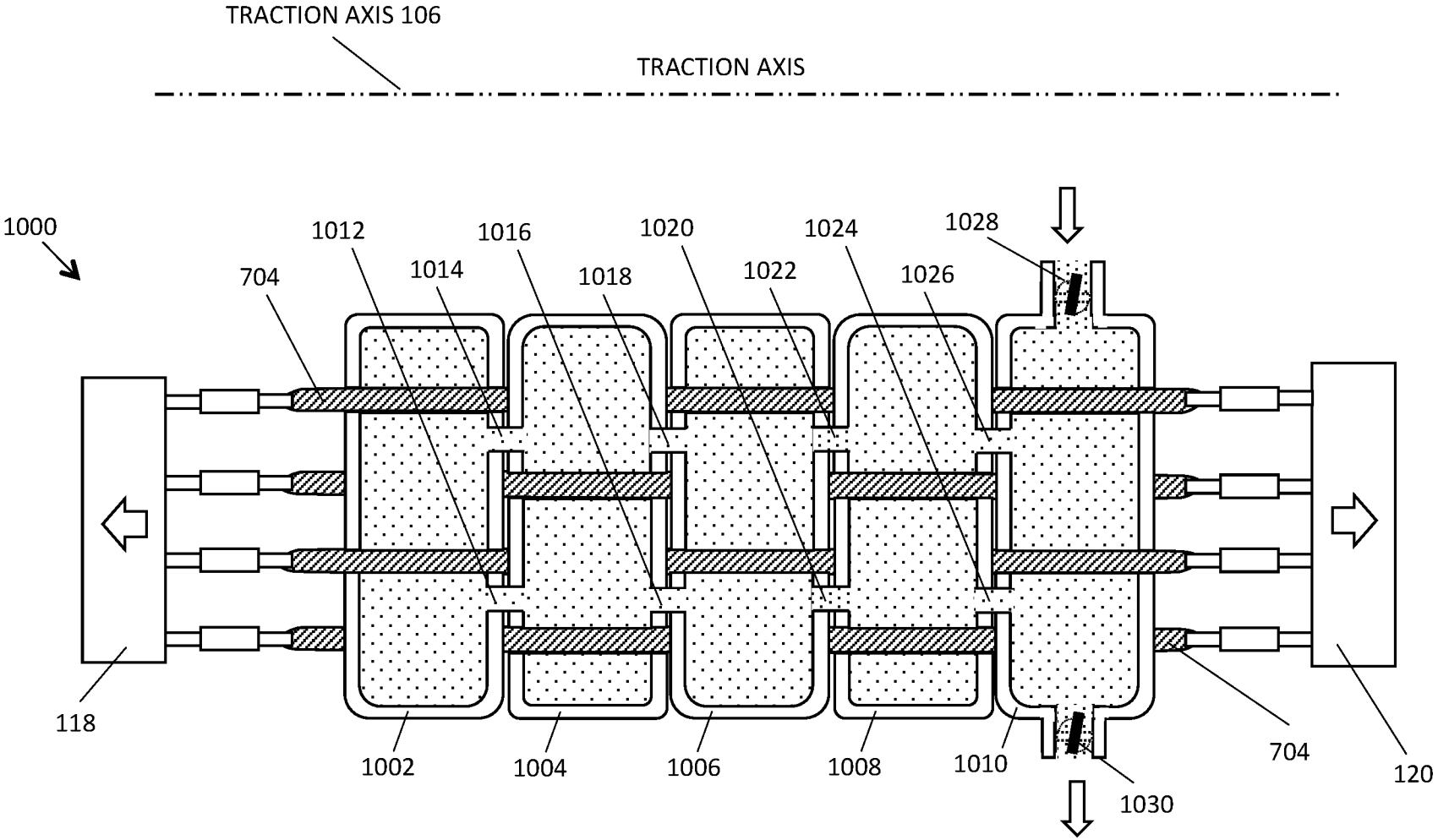
FIGURE 10A: TRUE TOP VIEW, EXTENDED POSITION

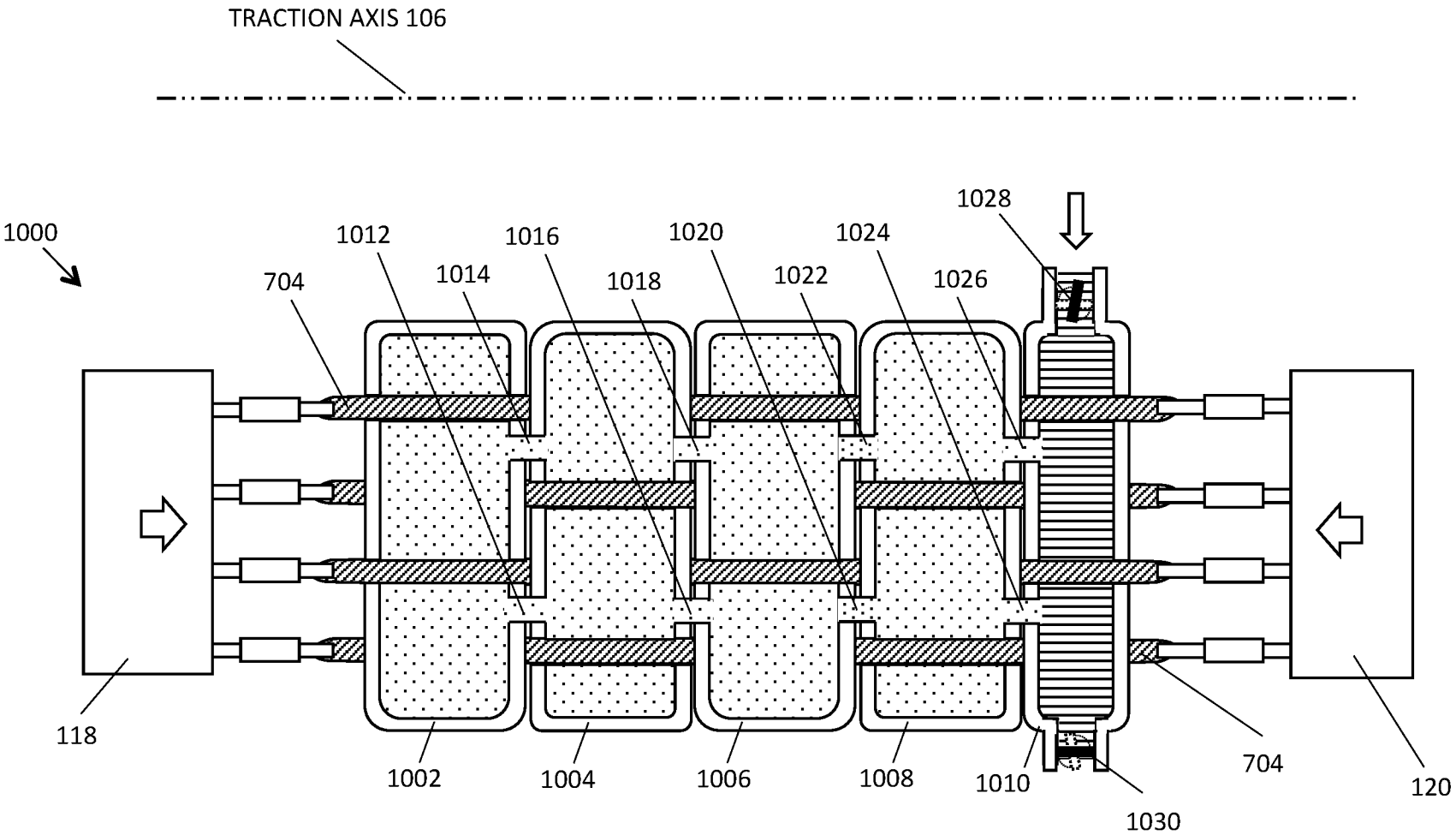
FIGURE 10B: TRUE TOP VIEW, ONE BLADDER COMPRESSED

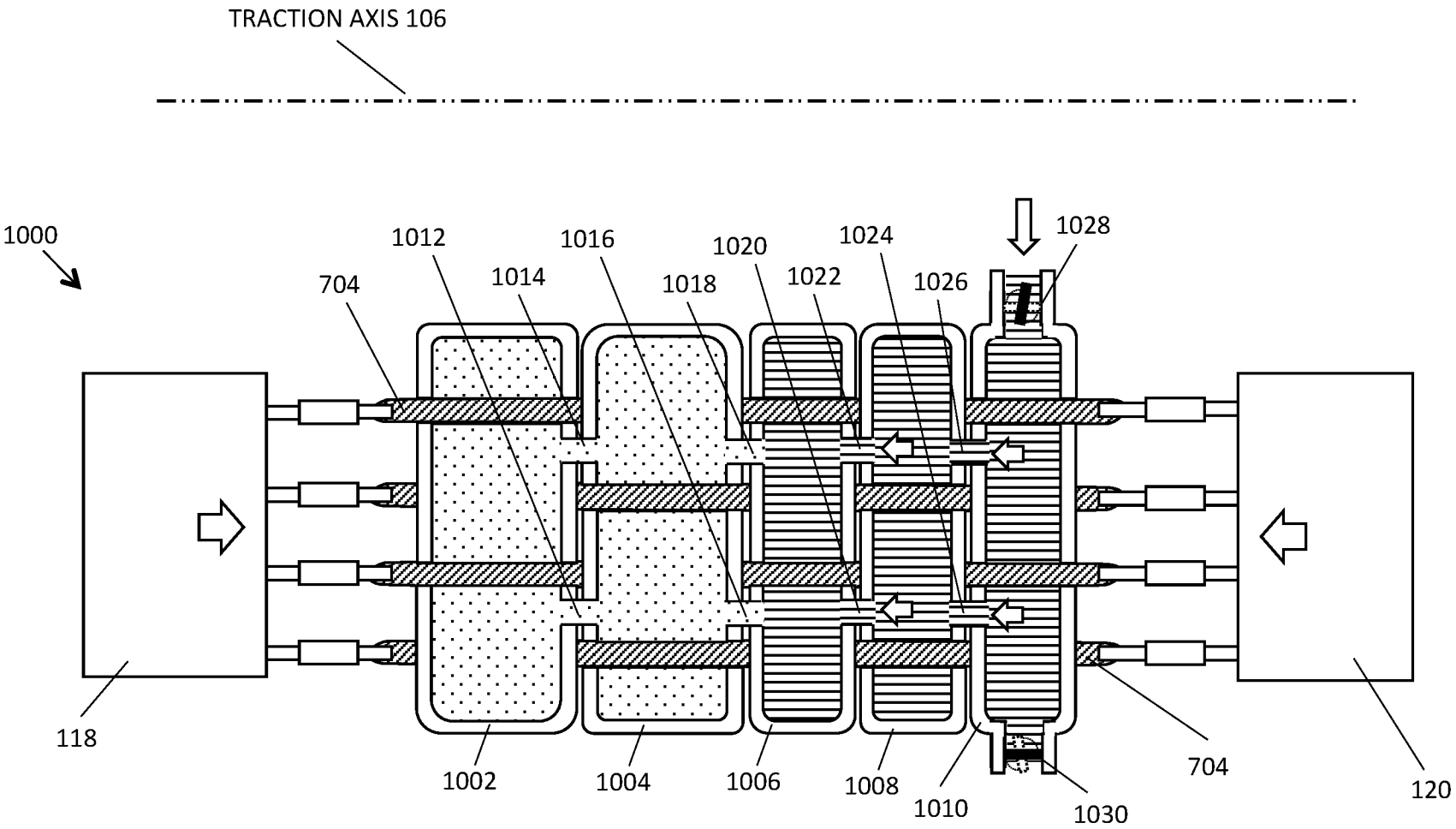
FIGURE 10C: TRUE TOP VIEW, THREE BLADDERS COMPRESSED

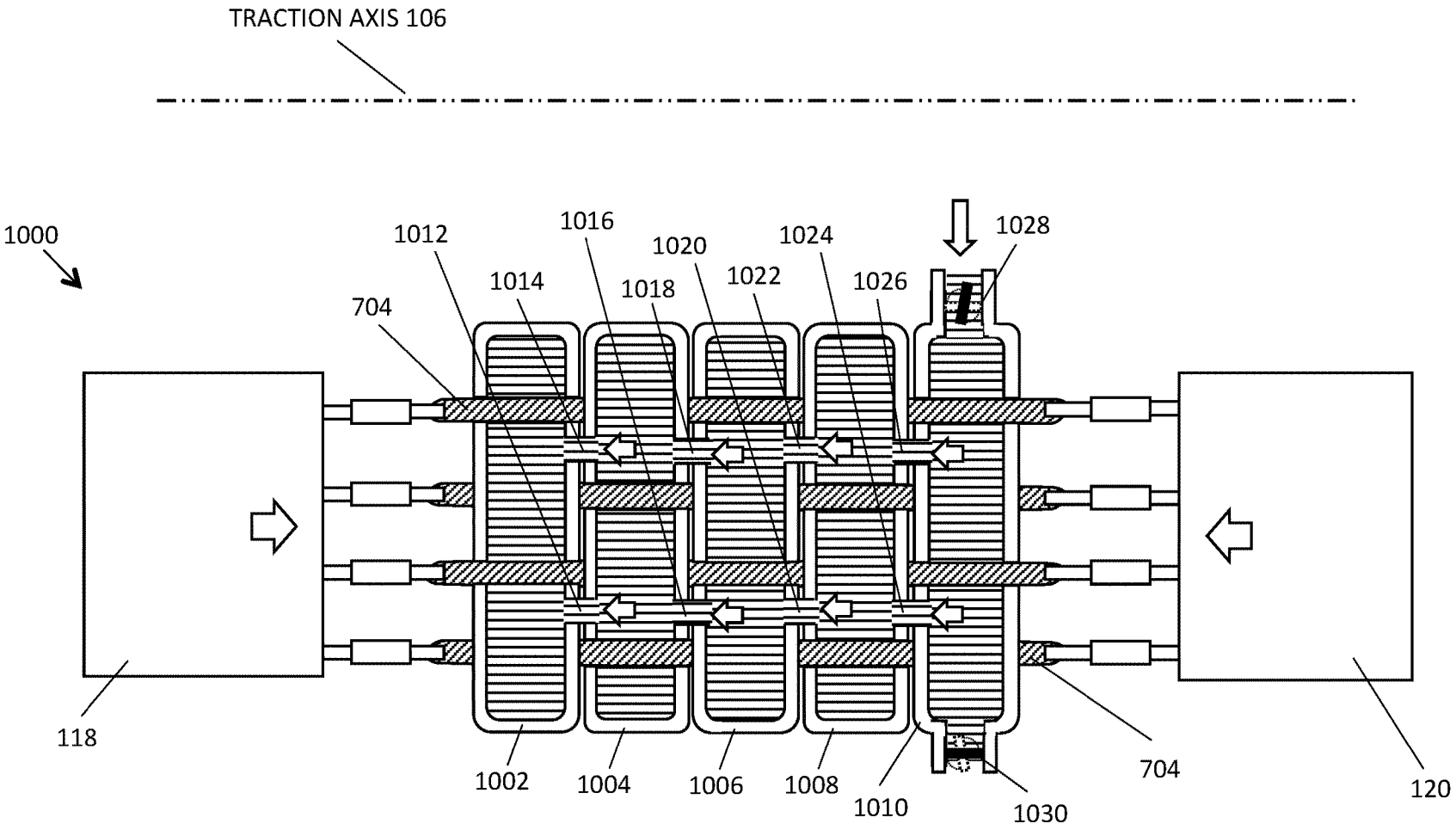
FIGURE 10D: TRUE TOP VIEW, ALL BLADDERS COMPRESSED

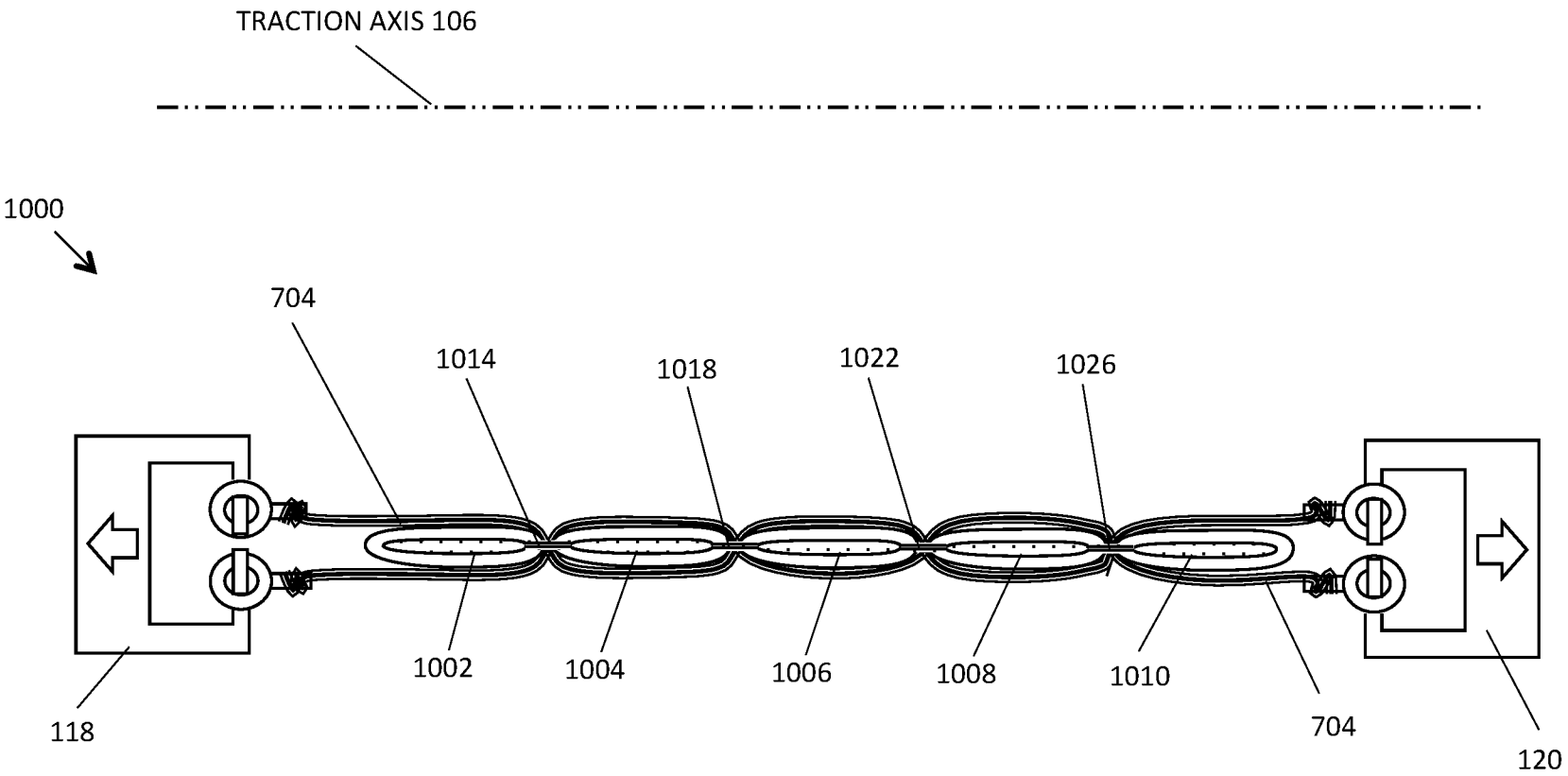
FIGURE 10E: TRUE SIDE VIEW — EXTENDED POSITION

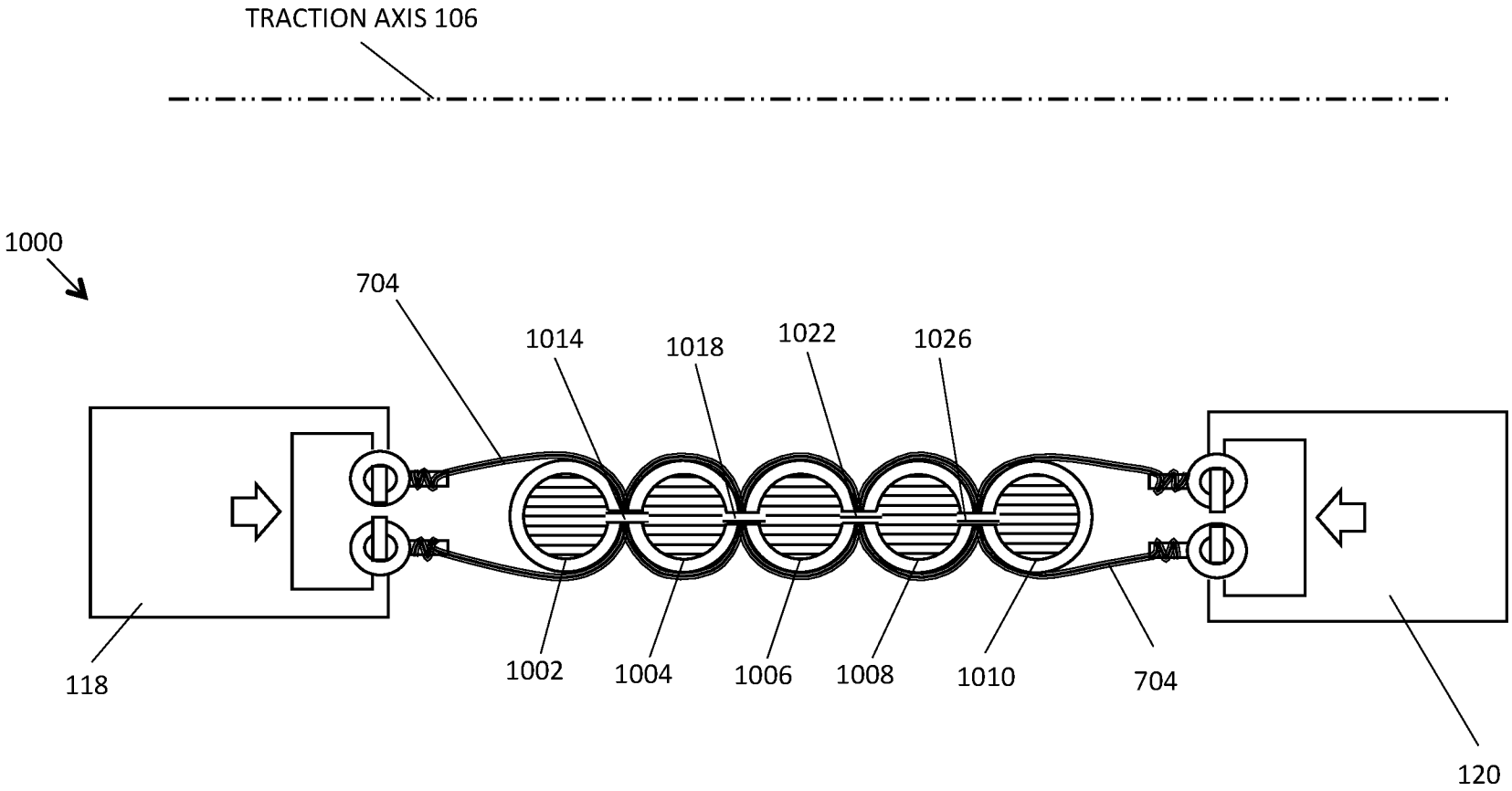
FIGURE 10F: TRUE SIDE VIEW, ALL BLADDERS COMPRESSED

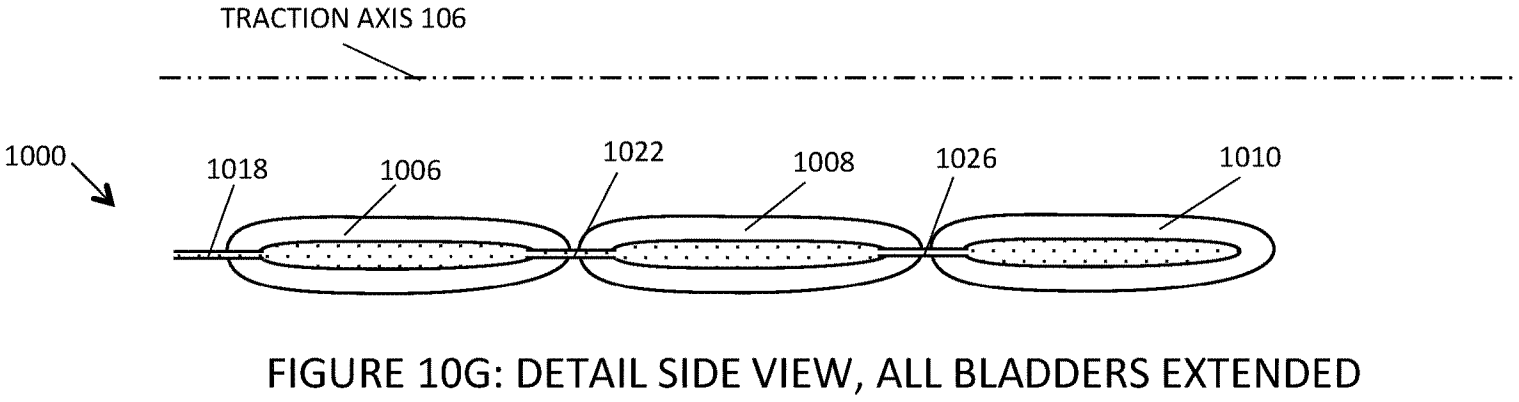
FIGURE 10G: DETAIL SIDE VIEW, ALL BLADDERS EXTENDED
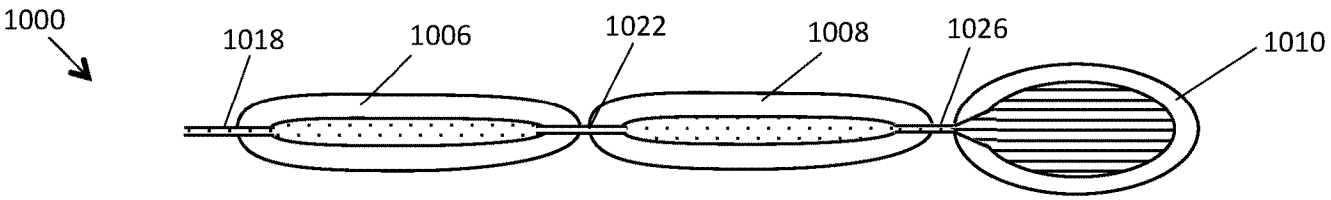
FIGURE 10H: DETAIL SIDE VIEW, ONE BLADDER COMPRESSED
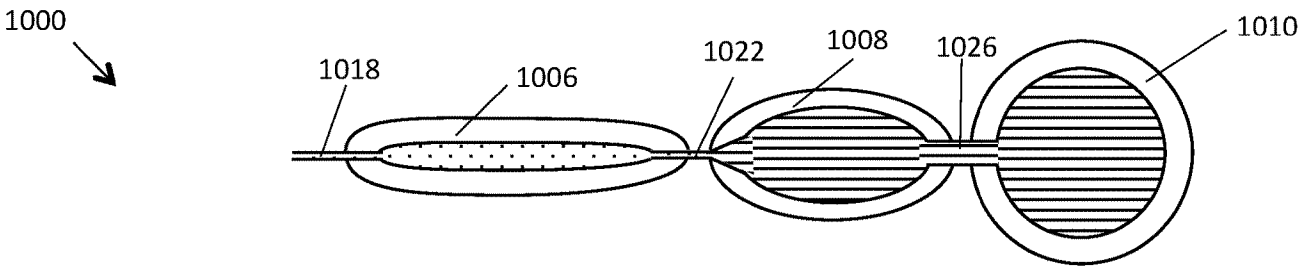
FIGURE 10I: DETAIL SIDE VIEW, TWO BLADDERS COMPRESSED

TENSILE ACTUATOR

CO-PENDING PATENT APPLICATIONS

This Nonprovisional Patent Application is a Continuation-in-Part Application to U.S. Provisional Patent Application Ser. No. 62/456,946 as filed on Feb. 9, 2017 by Inventor Alexander Sergeev and titled TENSILE ACTUATOR. Said U.S. Provisional Patent Application Ser. No. 62/456,946 is incorporated in its entirety and for all purposes into this Continuation-in-Part Nonprovisional Patent Application.

This Nonprovisional Patent Application is additionally a Continuation-in-Part Application to U.S. Nonprovisional Patent Application Ser. No. 15/149,167 as filed on May 8, 2016 by Inventor Alexander Sergeev and titled TENSILE ACTUATOR. Said U.S. Nonprovisional patent application Ser. No. 15/149,167 is incorporated in its entirety and for all purposes into this Continuation-in-Part Nonprovisional Patent Application.

FIELD OF THE INVENTION

The present invention relates to the field of mechanical actuators. More particularly, the present invention relates to actuators adapted for integration with control systems.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

The many possible applications for an electromechanical actuator which responds to the commands of a processor are both economically and scientifically valuable in the fields of robotics, prosthetics, and devices having physical memory. However, previous efforts made to mimic mammalian muscle function have proved inefficient in both cost and ease of production, and these inefficiencies have impeded the availability of such electromechanical actuators.

There is therefore a long-felt need to provide a method and system that provide increased efficiencies in the cost and availability of actuators which mimic muscle functions.

SUMMARY AND OBJECTS OF THE INVENTION

Towards these objects and other objects that will be made obvious in light of the present disclosure, a system and method are provided that enable a tensile actuator, whereby a tensile force is created by means of a medium being introduced into a reservoir having elongate chambers, the medium preferably consisting of either a gas or a liquid. In various alternate preferred embodiments of the method of the present invention, the medium may be compressed or receive and a compressive force that is transferred to generate a tensile force.

In a first preferred embodiment of the method of the present invention (hereinafter the "invented method"), two sheets of a flexible, inelastic substance are sealed together along the periphery thereof. An interior reservoir created by the sealing of the two flexible, inelastic sheets preferably contains two or more elongate chambers, within and between which the medium may flow, organized normal to an axis of traction, whereby the axis of traction is the axis along which the invented device reduces length as the medium is introduced into the reservoir.

In an alternate embodiment of the invented method, one or more bladders of the flexible, inelastic material are woven through two or more strips or strings, also composed of the same or a similar flexible but inelastic material, wherein the bladders may optionally be tubular in shape. The strips or strings preferably run in parallel to one another. The bladders are adapted to receive the preferably compressed gaseous or liquid medium. As the medium is moved into the bladders, the flexible strips or strings are deformed to cause the strips or strings to have a reduced length along the axis of traction.

In a yet further alternate embodiment of the invented method, a textile tissue is used in place of the above-mentioned strips. In this case, two pieces of textile are connected to each other by means of a plurality of stitches. In this embodiment, the bladders are standalone, in a similar way to that of the strips. The stitches are preferably positioned between the bladders along the length of the strips. This embodiment is intended mostly for heavy-weight loading, because the greater strength of the textile tissue enables operation with even very heavy loads.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF THE FIGURES

These, and further features of the invention, may be better understood with reference to the accompanying specification and drawings depicting the preferred embodiment, in which:

FIG. 1A is an overhead view of the invented device when the invented device is in an extended position, having an empty reservoir portion;

FIG. 1B is an overhead view of the invented device when the medium of FIG. 1A has been introduced into the reservoir, substantively filling the reservoir;

FIG. 1C is a top view an alternate preferred embodiment of the invented device comprising a textile material and shown in an extended position;

FIG. 2A is a side view of the invented device when the invented device is extended;

FIG. 2B is a side view of the invented device when a medium has been introduced into the chamber, and the elongate chambers are shown to be distended;

FIG. 2C is a detailed side view of an exemplary first elongate chamber, shown in the extended position, and having a lateral length S;

FIG. 2D is a detailed side view of the exemplary first elongate chamber, shown in the filled position, and having a lateral length of 2/PI S, and a curved extension S;

FIG. 3A is a side view of the die process of the invented device, wherein the top and bottom of the invented device are both imprinted with a designated pattern of chambers;

FIG. 3B is a further side view of the die process of the invented device, wherein only top of the invented device is imprinted with a designated pattern of chambers;

FIG. 3C is a top view of the die process of the invented device;

FIG. 3D is a bottom view of the die process of the invented device;

FIG. 4 is a top view of the invented device, wherein the invented device contains multiple reservoir ports for the introduction and/or removal of the medium of FIG. 1A;

FIG. 5A shows an alternate embodiment of the first device of FIG. 1A, wherein a piston chamber is attached to the reservoir of FIG. 1A, allowing for regulated introduction and removal of the medium of FIG. 1A;

FIG. 5B presents an alternate embodiment of the invented device of FIG. 1A further comprising a membrane chamber in a first operating mode;

FIG. 5C presents the alternate embodiment of the invented device of FIG. 5B further showing the membrane chamber in a second operating mode;

FIG. 6 is a block diagram of the internal control mechanism of the invented device;

FIG. 7A is side view of an additional alternate embodiment of the invented device shown in an extended position, whereby a plurality of bladders are interwoven with two or more flexible strands;

FIG. 7B is a side view of the additional alternate embodiment of the invented device of FIG. 7A, wherein the plurality of bladders interwoven with two or more flexible strands are substantively filled with a greater mass of medium;

FIG. 7C is a top view of the additional alternate embodiment of the invented device of FIG. 7A in the same extended position of FIG. 7A;

FIG. 7D is a top view of the additional alternate embodiment of the invented device of FIG. 7A in the same state of bladders filled with the medium of FIG. 7A;

FIG. 7E is a side view of an additional alternate embodiment of the invented device, wherein two sheets of textile material are stitched together to partially enclose the bladders of FIG. 7A and shown in the extended position of FIG. 7E;

FIG. 7F is a side view of the additional alternate embodiment of the invented device as shown in FIG. 7E, wherein the plurality of bladders are substantively filled with the medium of FIG. 7A;

FIG. 7G is a top view of the additional alternate embodiment of the invented device of FIG. 7E in the extended position of FIG. 7E;

FIG. 7H is a top view of the additional alternate embodiment of the invented device of FIG. 7E in the same state of bladders as filled with the mass of medium as shown in FIG. 7F;

FIG. 7I is a side view of an yet additional alternate embodiment of the invented device, wherein four sheets of textile material are stitched together to partially enclose the bladders of FIG. 7A and shown in the extended position of FIG. 7I;

FIG. 7J is a side view of the additional alternate embodiment of the invented device as shown in FIG. 7I, wherein the plurality of bladders of FIG. 7A are substantively filled with a greater mass of medium than as shown in FIG. 7I;

FIG. 8A is a top view of a fifth additional alternate embodiment of the invented device wherein each of a plurality of bladders of FIG. 7A are each coupled with a pair of valves and a dedicated piston chamber of FIG. 5A;

FIG. 8B is a top view of an sixth additional alternate embodiment of the invented device that is further coupled with a first manifold disposed between and coupled with both a single piston chamber of FIG. 5A and a plurality of bladders of FIG. 7A;

FIG. 8C is a top view of an seventh additional alternate embodiment of the invented device that further comprises the sixth version of FIG. 8B indirectly coupled a tubing that is shaped and adapted to contain a portion of the volume of medium of FIG. 1A and directs the flow of medium between the single piston chamber of FIG. 5A and a medium chamber;

FIG. 8D is a top view of the fifth version wherein an individual dedicated individual medium chamber of a plurality the individual medium chambers is disposed between and separately coupled with an individual bladder of FIG. 7A and the dedicated piston chamber of FIG. 5A of its coupled bladder;

FIG. 8E is a top view of an eighth additional alternate embodiment of the invented device that embodies a sealed closed loop medium circulation muscle having and applying a piston chamber of FIG. 5A as an internal pump;

FIG. 8F is a top view of a ninth additional alternate embodiment of the invented device that embodies a sealed closed loop medium circulation muscle having and applying a plurality of piston chambers of FIG. 5A as internal pumps;

FIG. 9A is a top view of a tenth additional alternate embodiment of the invented device comprises a plurality of enclosing bladders that each encapsulate and house a volume of medium of FIG. 1A, wherein each enclosing bladder is coupled with one of a plurality of individually dedicated steam generating electrical energy sources;

FIG. 9B is a top view of an eleventh additional alternate embodiment of the invented device that comprises the plurality of enclosing bladders of FIG. 9A that each house a volume of medium of FIG. 1A, wherein each enclosing bladder is coupled with one of a plurality of individually dedicated microwave energy emitting steam generating electrical energy sources;

FIG. 9C is a side view of a twelfth additional alternate embodiment of the invented device that comprises the plurality of enclosing bladders of FIG. 9A that each house a volume of medium of FIG. 1A, wherein each enclosing bladder is coupled with one of a plurality of individually dedicated steam generating Peltier-Seebeck modules;

FIG. 9D is a side view of a thirteenth additional alternate embodiment of the invented device that comprises the plurality of enclosing bladders of FIG. 9A that each house a volume of medium of FIG. 1A, wherein each enclosing bladder is coupled with one of a plurality of individually dedicated Yutkin Discharger modules;

FIG. 9E is a side view of a fourteenth additional alternate embodiment of the invented device that comprises the plurality of enclosing bladders of FIG. 9A that each house a volume of medium of FIG. 1A, wherein each enclosing bladder is coupled with one of a plurality of individually dedicated piezo electric modules;

FIG. 9F is a side view of a fifteenth additional alternate embodiment of the invented device that comprises the plurality of enclosing bladders of FIG. 9A that each house a volume of medium of high speed tuneable electroactive gel and the pair of electrodes of FIG. 8 extend into each enclosing bladder;

FIG. 9G is a side view of a sixteenth additional alternate embodiment of the invented device comprises the plurality of enclosing bladders of FIG. 9A that each house a volume of swelling particles; and FIG. 9H is a side view of a seventeenth additional alternate embodiment of the invented device comprises the plurality of enclosing bladders of FIG. 9A that each house a volume of sound energy influenced particles.

FIG. 10A is a top view of a eighteenth additional alternate embodiment of the invented device wherein each of a plurality of bladders of FIG. 7A are each coupled with its closest positioned neighboring bladders modified with a pressure-activated channels.

FIG. 10B is a top view of a eighteenth additional alternate embodiment of the invented device comprises the plurality of enclosing bladders of FIG. 10A wherein a single bladder closest to the medium input valve is filled with a medium;

FIG. 10C is a top view of a eighteenth additional alternate embodiment of the invented device comprises the plurality of enclosing bladders of FIG. 10A wherein the three bladders closest to the medium input valve are filled with a medium;

FIG. 10D is a top view of a eighteenth additional alternate embodiment of the invented device comprises the plurality of enclosing bladders of FIG. 10A wherein all enclosed bladders are filled with a medium;

FIG. 10E is a side view of a eighteenth additional alternate embodiment of the invented device comprises the plurality of enclosing bladders of FIG. 10A wherein all enclosed bladders are in a deflated state;

FIG. 10F is a side view of a eighteenth additional alternate embodiment of the invented device comprises the plurality of enclosing bladders of FIG. 10A wherein all enclosed bladders are filled with a medium;

FIG. 10G is a detail side view of a eighteenth additional alternate embodiment of the invented device comprises the plurality of enclosing bladders of FIG. 10A wherein all shown bladders are in a deflated state;

FIG. 10H is a detail side view of a eighteenth additional alternate embodiment of the invented device comprises the plurality of enclosing bladders of FIG. 10A wherein a single bladder closest to the medium input valve is filled with a medium, and;

FIG. 10I is a detail side view of a eighteenth additional alternate embodiment of the invented device comprises the plurality of enclosing bladders of FIG. 10A wherein the two bladders closest to the medium input valve are filled with a medium.

DETAILED DESCRIPTION

Referring now generally to the Figures and particularly to FIG. 1A, FIG. 1A is an top view of a first alternate preferred embodiment of the invented first device 100 when the first device 100 (hereinafter, "the first device 100") is extended, i.e. when a reservoir 102 of the first device 100 is not filled with a fluid medium 104 under pressure, wherein the fluid medium 104 (hereinafter, "medium") may a gas or a liquid. In the extended position, the reservoir 102 portion of the invented device has a length LA. The length LA of the first device 100 describes the length along a traction x axis 106 of the first device 100 when the first device 100 is in the extended position as presented in FIG. 1A. The traction x axis 106 of the first device 100 is the axis along which the first device 100 contracts and expands when the medium 104 is introduced under pressure into the reservoir 102 and thereafter the medium 104 is removed or permitted to exit from the reservoir 102.

As further presented in FIG. 2A, the first device 100 comprises a top sheet 100A and a bottom sheet 100B comprising a flexible but inelastic material, sealed together along a device periphery 100C of the two sheets 100A & 100B of material forming the internal reservoir 102 into which a compressed or un compressed medium 104 may be introduced. The flexible but inelastic material of which each sheet 100A & 100B is composed may be or comprise polyethylene, polyvinyl chloride, urethane plastic, biaxially oriented polyester such as polyethylene terephthalate ("PET"), polyurethane, polyester, nylon, fiber reinforced polyurethane, fiber reinforced polyester, fiber reinforced nylon, or other suitable inelastic and flexible material known in the art. The reinforcing fiber of the sheets 100 & 100B may be or comprise highly oriented polymer fiber made of polyester, nylon, polyurethane or other suitable flexible and inelastic fiber known in the art. The flexible but inelastic material of the top sheet and the bottom sheet 100A & 100B is further sealed by internal barriers 108 (I which may block air flow between distinct elongate chambers 110A & 110 (hereinafter, "chambers" 110A & 100) of the first device 100, which chambers 110A & 110 are elongate within the device 100, and are substantively normal to the traction x axis 106. The internal barriers 108 are formed by joined portions of the sheets 100A & 100B.

Further within the first device 100 exist apertures which allow limited flow of the medium 103, e.g. gas, or a liquid, between the elongate chambers 110. Positioned along the periphery of the reservoir 102 are preferably one or more valves 114 through which the medium 104 may be controllably introduced and/or removed from the first device 100.

The internal barriers 108 and the device periphery 100C may be formed by, suitable methods known in the art that include aspects such as, but not limited to, (a.) application of pressure against the top sheet 100A and/or the bottom sheet 100B, (b.) a.) application of heat against the top sheet 100A and/or and the bottom sheet 100B, and/or (c.) application and inclusion of an adhesive (not shown). Alternatively or additionally, a portion or all of the reservoir 102, the device periphery 100C, sheets 100A & 10B and/or internal barriers 108 may be formed by application of 3D printing methods and systems.

A first anchor feature 118 and a second anchor feature 120 are separately positioned distal along the traction x axis 106 of the first device 100. At least one of the anchor features 118 & 120 may preferably be moved under direction from a force along the traction x axis 106 of the first device 100, or optionally both the first anchor feature 118 and the second anchor feature 120 may be moved under direction from a force along the traction x axis 106 of the first device 100. The first anchor feature 118 includes a pair of arm elements 118A & 118B are shaped and adapted to detachably coupled with one or more looped features 122. The second anchor feature 120 includes a pair of second arm elements 120A & 120B are enabled to detachably couple with one or more of the looped features 128 of the first invention 100. The looped features 122 & 123 are coupled with the joined sheets 100A & 100B and are adapted to be individually detachably coupled with an arm element 118A, 118B, 120A & 120B of the first anchor feature 118 or the second anchor feature 120. Each looped feature 122 & 123 preferably includes at least one loop element 100E that is adapted to accept traversal of one or more arm elements 118A, 118B, 120A & 120B. Each looped feature 122 & 123 preferably further includes an attachment element 100F that is coupled with both one loop element 100E and with the joined sheets 100A & 100B.

Referring now generally to the Figures and particularly to FIG. 1B, FIG. 1B is a top view of the first device 100 when the medium 104 has been introduced under pressure into the reservoir 102, and the reservoir 102 is substantively filled. In the filled and contracted position of FIG. 1B, the reservoir 102 portion of the invented device 100 has a length 2/PI LA. FIG. 1B shows the reservoir 102, elongate chambers 110, traction x axis 106, one or more valves 116 and the anchor features 118 & 120, wherein the medium 104 has been introduced into the reservoir 102, substantively filling the reservoir 102. When the medium 104 is introduced into the reservoir 102, the length LA of the reservoir 102 has been reduced, without substantively reducing the surface area of the reservoir 102. The elongate chambers 110A & 110 of the first device 100 require substantively less medium 104 for filling the reservoir 102 than the reservoir 102 would necessitate should the reservoir 102 simply be sealed along the edges thereof, creating an uninterrupted chamber into which the medium 104 may be cyclically introduced intro and substantively removed from. The reduced amount of medium 104 allows for shorter response times for contracting and releasing tension along the length LA of the reservoir 102. The allowance of the elongate chambers 110A & 110 for more significant contraction of the reservoir 102, without reduction of the surface area of the reservoir 102, exerts a strong tensile force on the first and second anchor features 118 & 120. The reservoir 102 may contract to 2/PI LA, as further shown in the FIG. 2B, some fraction having a value greater than 2/PI LA, but a lesser value than LA, or some fraction having a value less than 2/PI LA.

Referring now generally to the Figures and particularly to FIG. 2A, FIG. 2A is a side view of the first device 100 when the first device 100 is extended. It is shown that the elongate chambers 110A & 110 appear substantively evenly spaced apart within the reservoir 102, and substantively normal to the traction x axis 106 of the first device 100. The elongate chambers 110A & 110 of the reservoir 102 are further shown as they would appear when not filled with the medium 104, allowing the two sheets 100A & 100B of flexible, inelastic material to rest substantively parallel to one another, and not exerting a tensile force on the first and/or second anchor features 118 & 120. In this Figure, the reservoir 102 has a length LA less any contribution of the thickness of the enclosing two sheets 100A & 100B.

Referring now generally to the Figures and particularly to FIG. 2B, FIG. 2B is a side view of the first device 100 when a medium 104 has been introduced into the reservoir 102, and the reservoir 102 is substantively filled. The medium 104 is shown to have been introduced into the elongate chambers 110A & 110 of the reservoir 102 and delivering a tensile force exerted on the first and second anchor attachment features 118 & 120 along the traction x axis 106 of the first device 100. The medium 104 has been introduced through one or more of the valves 116 along the periphery of the reservoir 102, and having been allowed to flow through the reservoir 102, in the apertures 112 between the elongate chambers 110. The length of the reservoir 102 is shown to have been reduced to approximately 2/PI LA, without substantively reducing surface area of the reservoir 102.

Referring now generally to the Figures and particularly to FIG. 2C, FIG. 2C is a detailed side view of an exemplary first elongate chamber 110A, shown in the extended position, and having a length LA of the sheets 100A & 100B along the traction x axis 106. Each of the elongate chambers 110A & 110 preferably displays a substantively equal chamber length along the x axis 106.

Referring now generally to the Figures and particularly to FIG. 2D, FIG. 2D is a detailed side view of the exemplary first elongate chamber 110A, shown in the filled position, and having a chamber length 2/PI LA along the traction x axis 106, and a curved extension LA. The first elongate chamber 110A is shown being substantively full of the medium 104. The chamber length of the elongate chamber 110 is shown to be approximately 2/PI LA, as compared to the chamber length LA of the unfilled elongate chamber 110 of FIG. 2C, and a curved extension of approximately LA on the distended portion of the elongate chamber 110. FIG. 2D demonstrates the contraction of the length of the reservoir 102, without loss of surface area, allowing for a tensile force to be exerted on the first and/or second anchor attachment features 118 & 120 along the traction x axis 106 of the first device 100.

It is understood that according to the method of the present invention, the formation and application of two or of a plurality of elongate chambers 110A & 110 enables the first device 100, versus the application of a single elongate chamber 110, to contract and expand along the traction x axis as the medium 104 is respectively inserted into and withdrawn from the elongate chambers 110, while reducing the amount of expansion required of the first device 100 along the two geometric Y & Z axes that are orthogonal to the traction axes. In addition, it is understood that given a constant surface area of both the top sheet 100A and the bottom sheet 100B, less medium 104 is required to generate the same degree of contraction of the first device 100 along the traction x axis as the number of elongate chambers 110A & 110 is increased as less expansion of the first device 100 along the Y axis is required.

Referring now generally to the Figures and particularly to FIG. 3A, FIG. 3A is a side view of a die apparatus of the first device 100, wherein sheets 100A & 110B of the reservoir 102 of the first device 100 are both imprinted with a designated chamber pattern created by a top die 124 and a bottom die 126, thereby creating the elongate chambers 110A & 110 within the reservoir 102. In the first preferred die process for the first device 100, the top die 124 and the bottom die 126 preferably each bear complementary designated patterns, whereby the pattern of internal barriers 108 are formed by placing the sheets 100A & 100B between pressing the top die 124 and the bottom die 126 together and then pressing the top die 124 and the bottom die 126. It is understood that the top die 124 and/or the bottom die 126 may be heated an adapted and applied to transfer heat to the top sheet 100A and/or the bottom sheet 100B to increase the quality of the sealing between the top sheet 100A and/or the bottom sheet 100B and the quality of the internal barriers 108.

Referring now generally to the Figures and particularly to FIG. 3B, FIG. 3B is a further side view of an alternate die process of the first device 100, wherein only top of the reservoir 102 of invented device 100 is imprinted with a designated pattern of chambers 110, creating the elongate chambers 110A & 110 within the reservoir 102. In this second preferred die process for the first device 100, only the top die 100A bears a designated pattern of chambers, whereby the pattern of chambers 110 may be imprinted into the top sheet 100A, and such that the chambers 110A & 110 are formed by sealing between the top sheet 100A to the bottom sheet 100B. This allows for a simpler die process. The edges of the top sheet 100A and the bottom sheet 100B forming the periphery 100C may also be sealed together in this process.

Referring now generally to the Figures and particularly to FIG. 3C, FIG. 3C is a view of the top die 100A for the creation of the first device 100, showing a preferred top die feature pattern 125 to be stamped into the reservoir 102 of the first device 100 and to be stamped onto the sheets 100A & 100B arrange to form elongate chambers 110A & 110.

Referring now generally to the Figures and particularly to FIG. 3D, FIG. 3D is a view of the bottom die 100B for the creation of the first device 100, showing a preferred bottom die feature pattern 127 to be stamped into the reservoir 102 of the first device 100 and to be stamped onto the sheets 100A & 100B arrange to form elongate chambers 110A & 110.

Referring now generally to the Figures and particularly to FIG. 4, FIG. 4 is a top view of the first device 100, wherein the first device 100 contains multiple reservoir valves 116 for expedited and/or more controlled introduction and/or removal of the medium 104. The greater number of valves 116 allows a user more refined control over the introduction and/or removal of the medium 104, because the chambers 110A & 110 within the first device 100 restrict the flow of the medium 104; thus, more valves 116 along a the periphery of the reservoir 102 allow a user to bypass the need to wait for the amount of the medium 104 within the reservoir 102 to equalize throughout the reservoir 102 before determining the pressure level. By using valves 116 along the whole distance of the reservoir 102, the user may introduce a substantively equal amount of the medium 104 into the reservoir 102 more quickly than the user would be able to do accomplish with only one or two valve valves 116.

Referring now generally to the Figures and particularly to FIG. 5A, FIG. 5A shows an alternate embodiment of the first device 100, wherein a piston chamber 128 is attached to the reservoir 102 of the first device 100, allowing for highly regulated introduction and removal of the medium 104. The piston chamber 128 may contain a designated amount of the medium 104, which may be introduced and/or removed from the reservoir 102 with enhanced precision by a user one or more two way valves 130 that are each preferably positioned along the periphery 100C of the reservoir 102.

It is understood that the piston chamber 128 may be or comprise a A04™ piston pump as marketed by FMC Technologies, Inc of Stephenville Tex., or other suitable air or liquid pump known in the art.

Referring now generally to the Figures and particularly to FIG. 5B, FIG. 5B shows an alternate embodiment of the first device 100, wherein a membrane chamber 132 is attached to the reservoir 102 of the first device 100, allowing for highly regulated introduction and removal of the medium 104. The membrane chamber 132 may contain a designated amount of the medium 104, which may be introduced and/or removed from the reservoir 102 with enhanced precision by a user via two or more valves 130 preferably positioned along the periphery 100C of the reservoir 102. It is understood that FIG. 5B shows the membrane chamber 132 is in a first operating mode wherein the membrane chamber 132 is generating and applying a pneumatic or hydraulic force tending to (a.) draw the medium 104 away from a first alternate two way valve 130A and (b.) simultaneously push the medium 104 toward the second two way valve 130B and the reservoir 102.

Referring now generally to the Figures and particularly to FIG. 5C, FIG. 5C shows an alternate embodiment of the first device 100, wherein the membrane chamber 132 is in a second operating mode wherein the membrane chamber 132 is generating and applying an alternate pneumatic or hydraulic force tending to (a.) push the medium 104 toward the first two way valve 130A and the first chamber 110A and (b.) draw the medium 104 away from the second alternate two way valve 130B.

Referring now generally to the Figures and particularly to FIG. 6, FIG. 6 is a block diagram of the internal control mechanism 600 of the first device 100. The internal control mechanism 600 of the first device 100 contains a signal and power bus 602 that is bi-directionally communicatively coupled with: a central processing unit ("CPU") 604; a memory 606; a pump 608; a logic 610; an electrical power source 612, e.g., an electrical power battery or capacitive element; a plurality of valve controllers 614; and a sensor 616. It is understood that one or more valve controllers 614 may be, comprise, or be comprised within one or more of the aforementioned valves 114, 116, 130, 130A & 130B.

Referring now generally to the Figures and particularly to FIGS. 7A through 7D, FIG. 7A is a side view of an additional alternate preferred embodiment of the invented device 700 (hereinafter, "the third device" 700), whereby a plurality of bladders 702 having a bladder elongate central axis 703 (hereinafter "bladder axis 703") are interwoven with two or more flexible strands 704, made of a flexible but inelastic material, shown in an extended position.

One or more of the plurality of bladders 702 may be tubular in shape and/or comprise polyvinyl chloride, urethane plastic, biaxially oriented polyester such as PET, polyurethane, polyester, nylon, fiber reinforced polyurethane, fiber reinforced polyester, fiber reinforced nylon, or other suitable inelastic and flexible material known in the art. The reinforcing fiber of one or more bladders 702 may be or comprise glass fibers, and/or highly oriented polymer fiber made of polyester, nylon, polyurethane, and/or other suitable flexible and inelastic fiber known in the art. In addition, one or more bladders 702 may be or comprise a flexible and elastic material, such as latex, silicone or other suitable flexible and elastic material known in the art. The flexible but inelastic material of which the strands 704 are composed may be or comprise polyvinyl chloride, urethane plastic, biaxially oriented polyester such as polyethylene terephthalate ("PET"), polyurethane, polyester, nylon, fiber reinforced polyurethane, fiber reinforced polyester, fiber reinforced nylon, or other suitable inelastic and flexible material known in the art. The strands 704 may be substantively less elastic along the traction x axis 106 than are the bladders 702. It is understood that the bladder axis 703 is normal to the traction x axis 106.

The reinforcing fiber of the strands 704 may be or comprise DYNEEMA™ super-strong fiber made from Ultra-High Molecular Weight Polyethylene (UHMwPE) as marketed by DSM Dyneema LLC of Stanley, N.C., or a highly oriented polymer fiber made of polyester, nylon, polyurethane, or other suitable flexible and inelastic fiber known in the art.

Each strand 704 is preferably coupled with one or more looped features 122 & 123 by adhesion, knotting, gluing or other suitable known attachment method or material known in the art. The looped features 122 & 123 are then preferably applied to detachably couple their attached strand 704 to the first anchor feature 118 or the second anchor feature 120.

Referring now to FIG. 7C, one or more bladders 702 each preferably contain one or more valves 130, through which the medium 104 may be introduced or removed.

Referring now generally to the Figures and particularly to FIG. 7B, FIG. 7B is a side view of the third device 700 as shown in FIG. 7A, whereby the plurality of bladders 702 interwoven with two or more flexible strands 704 and the plurality of bladders 702 are each substantively filled with the medium 104. It is understood that the medium 104 may have been pumped under pressure into the bladders 702 by the piston chamber 128 or the membrane chamber 132 or other suitable means known in the art to deliver compressed gas or liquid into the bladders 702. It is understood that the bladders 702 as shown in FIG. 7B contain an increased mass of medium 104 in comparison with the amount of mass of medium 104 contained within the bladders 702 in the state of the sheet device 706 as shown in FIG. 7A.

When the medium 104 has been introduced into the flexible but inelastic bladders 702, the bladders 702 exert a force on the flexible strands 704, forcing the strands 704 to become curved thus reducing effective length along the traction x axis 106, but not expanding the surface area of the flexible strands 704, thus exerting a tensile force on the first anchor feature 118 and/or the second anchor feature anchor attachment features normal to the bladder axis 703. As the bladders 702 become more substantively filled with medium 104, the bladders 702 exert greater force on the strands 704 in a vector normal to both the bladder axis 703 and the traction x axis 106, thereby pushing the strands 704 to decrease in relative length along the traction x axis 106, and thus exerting tensile force on the first attachment feature 118 and/or the second attachment feature 120 along the x traction x axis 106.

Referring now generally to the Figures and particularly to FIGS. 7A through 7D, FIG. 7C is a top view of the third device 700 in the same extended position of FIG. 7A, wherein the bladders 702, each being elongate along the bladder axis 703 that is normal to the traction x axis 106, and each bladder 702 having a two-way valve 130 through which a medium 104 may be introduced and/or removed from the bladders 702. Woven between the bladders 702 are preferably at least two flexible strands 704, the flexible strands 704 being coupled to the first anchor feature 118 and the second anchor feature 120 by means of the interposed looped features 122 & 123.

Referring now generally to the Figures, and particularly to FIG. 7D, FIG. 7D is a top view of the third device 700 wherein the bladders 702 are elongate along the bladder axis 703 that is normal to the traction x axis 106, and showing each bladder 702 coupled a two-way valve 130 through which the medium 104 may be introduced and/or removed from the bladders 702. Woven between the bladders 702 are two flexible strands 704, the flexible strands 704 being coupled to the first anchor feature 118 and the second anchor feature 120 by means interposed looped features 122 & 123. FIG. 7D further shows the bladders 702 substantively filled with medium 104, whereby the bladders 702 exert force on the strands 704, forcing the strands 704 to decrease in relative length along the x traction x axis 106, thus exerting a tensile force along the traction x axis 106 on the first anchor feature 118 and the second anchor feature 120. It is understood that the bladders 702 as shown in FIG. 7D contain an increased mass of medium 104 in comparison with the amount of mass of medium 104 contained within the bladders 702 in the state of the sheet device 706 as shown in FIG. 7A and FIG. 7C.

The strands 704 may optionally or additionally be formed by one or more threads (not individually shown), wherein the threads preferably overlap every bladder 702. The threads extend from the plastic-coated metal holding rod, and extend between riddle rods and between riddle strips. The riddle is necessary to maintain a preferred shape for an array of bladders 702. During an assembly process each strand 704 is preferably put into place after finishing in order to form an appropriate layer by passing thread over each of the bladders 702.

Each bladder 702 preferably connects to a flexible manifold (not shown) on one end of the bladder 702, and is preferably substantively sealed on the other end; the manifold is preferably flexible such that the geometry of the manifold may be adjusted upon contraction of the muscle without damage to the manifold or to the muscle 100 & 700. The manifold preferably additionally contains at least two valves 114, 116, 130, 130A, 130B, & 614, wherein at least one of the valves is an inlet, which is preferably connected to a pump 608 system for inserting air into the bladders 702 of the third device 700, and at least one of the valves 114, 116, 130, 130A, 130B, & 614 is an outlet, for removing air or liquid from the bladders 702 when the third device 700 needs to be released. The pump 608 preferably additionally connects to the electrical power source 612. One or more strands 704 preferably overlap every bladder 702 of the array of bladders 702. Each strand 704 begins at one of the plastic-coated metal looped element 122 & 123, then overlaps a riddle rod (not shown) between two washers (not shown), wherein the washers maintain a desired shape for the array or bladders 702. The instant strand 704 additionally preferably overlaps alternative bladders 702, and extends again to another riddle rod between washers and reaches another holding rod.

Referring now generally to the Figures and particularly to FIGS. 7E through 7H, FIG. 7E is a side view of an additional alternate embodiment of the invented device 706 (hereinafter, "sheet device" 706), wherein two sheets of a textile material 708A & 708B are stitched together by stitching 710 to partially enclose the bladders 702 of FIG. 7A and the sheet device 706 is shown in the extended position of FIG. 7E. The sheets of textile material 708A & 708B preferably inelastic along the traction x axis 106 and may be or comprise inelastic DYNEEMA™ super-strong fiber made from Ultra-High Molecular Weight Polyethylene (UHMwPE) as marketed by DSM Dyneema LLC of Stanley, N.C., or a highly oriented polymer fiber made of polyester, nylon, polyurethane, or other suitable flexible and inelastic fiber known in the art, wherein the inelastic fibers extend in their elongate length dimension substantively in parallel to the traction x axis 106. The stitching 710 preferably comprises an inelastic fiber, such as DYNEEMA™ super-strong fiber made from Ultra-High Molecular Weight Polyethylene (UHMwPE) as marketed by DSM Dyneema LLC of Stanley, N.C., or a highly oriented polymer fiber made of polyester, nylon, polyurethane, or other suitable flexible and inelastic fiber known in the art. It is noted the relatively empty bladders 702 are shown in FIG. 7E to be flattened by the pulling force of each strand 708A & 708B.

Each sheet 708A & 708B is preferably coupled with one or more looped features 122 & 123 by adhesion, knotting, gluing or other suitable known attachment method or material known in the art. Either or both sheets 708A & 708B may be coupled with one or more at least one loop element 100E by means of one or more attachment strips 712 that are each both disposed between and coupled at least one sheet 708A & 708B and at least one at least one loop element 100E. Alternatively or additionally, either or both sheets 708A & 708B may be coupled with one or more looped features 122 & 123 by piercing of the sheet(s) 708A & 708B as shown in FIG. 7E wherein the two looped features 122 & 123 both are (a.) coupled with the second anchor feature 120, and (b.) additionally pierce through each sheet 708A & 708B.

Referring now generally to the Figures and particularly to FIGS. 7E through 7H FIG. 7F is a side view of the sheet device 706 as shown in FIG. 7E, wherein the plurality of bladders 702 are substantively filled with a greater mass of the medium 104 and the sheets 708A & 708B receive a force from the bladders 702 to cause a shortening of the length of the linear extension of the sheets 708A & 708B along the traction x axis 106. It is understood that the bladders 702 as shown in FIG. 7G contain an increased mass of medium 104 in comparison with the amount of mass of medium 104 contained within the bladders 702 in the state of the sheet device 706 as shown in FIG. 7E.

Referring now generally to the Figures and particularly to FIGS. 7E through 7H FIG. 7G is a top view of the sheet device 706 in the extended position of FIG. 7E, wherein the bladders 702 are shown to be flattened by the weight of the sheets 708A & 708B.

Referring now generally to the Figures and particularly to FIGS. 7E through 7H, FIG. 7H is a top view of the sheet device 706 in in the extended position of FIG. 7E wherein the bladders 702 contain an increased mass of medium 104 in comparison with the amount of mass of medium 104 contained within the bladders 702 in the state of the sheet device 706 as shown in FIG. 7E and FIG. 7G.

Referring now generally to the Figures and particularly to FIGS. 7I through 7J, FIG. 7I is a side view of an yet additional alternate embodiment of the invented device 714 (hereinafter, "multiple sheet version" 714), wherein four sheets of textile material 708A-708D are stitched together in layers by to partially enclose the plurality of bladders 702. Multiple sheet version 714 is shown in the extended position along the traction x axis 106.

Referring now generally to the Figures and particularly to FIGS. 7I through 7J, FIG. 7J is a side view of the multiple sheet version 714, wherein the plurality of bladders 702 are substantively filled with a greater mass of medium 104 than as shown in FIG. 7I, wherein the bladders 702 contain an increased mass of medium 104 in comparison with the amount of mass of medium 104 contained within the bladders 702 in the state of the multiple sheet version 714 as shown in FIG. 7I and FIG. 7J.

Additional optional preferred embodiments of the present invention may include one or more of the following elements. The anchor features 118 & 120 and/or the attachment strips 712 may be or comprise metal holding rods, wherein the metal holding rods preferably have a plastic coating in order to prevent damage to the two or more sheets 708A & 708B. The bladders 702 may optionally be presented in array of bladders 702, and may optionally be comprised of plastic tubes, and each bladder 702 may preferably be closed on one side thereof and connected to a flexible manifold on the other side or at any suitable place of one of the bladders 702.

Flexibility of the manifold is significant because a "muscle" is contracting, which substantively changes the geometry of the manifold. The manifold additionally preferably contains at least two valves 114, 116, 130, 130A, 130B, & 614, wherein at least one of the valves 114, 116, 130, 130A, 130B, & 614 is an inlet valve and at least one of the valves 130, 130A, 130B, & 614 is an outlet valve. The inlet valve 130, 130A, 130B, & 614 preferably connects to a pump 608 system, which additionally preferably attaches to a battery (not shown), and the outlet valve 116, 130, 130A, 130B, & 614 preferably disposes of air or other medium into the atmosphere when a "muscle", i.e., a preferred embodiment of the unvented device 100, 700 or 706, needs to be released.

Referring now generally to the Figures and particularly to FIG. 8A, FIG. 8A is a side view of an fifth additional alternate embodiment of the invented device 800 (hereinafter, "fifth version" 800) wherein each of a plurality of bladders 702 are each coupled with a pair of valves 130 and a dedicated piston chamber 128. It is understood that the dedicated piston chamber 128 is replaced with a commercially available PZT pump or an equivalent in certain additional alternate preferred embodiments of the method of the present invention of the devices of FIGS. 8A through 8F.

One of each pair of valves 130 is optionally disposed between its coupled bladder 702 and the dedicated piston chamber 128 or PZT pump (not shown). The piston chamber 128 alternately forces medium 104 into its coupled bladder 702 and thereafter releases said compressive force and accepts medium 104 exiting from its coupled bladder 702. It is understood that the strands 704 are interlaced through the plurality of bladders 702 as configured in the third device 700.

Referring now generally to the Figures and particularly to FIG. 8B, FIG. 8B is a side view of an sixth additional alternate embodiment of the invented device 802 (hereinafter, "sixth version" 802) that is further coupled with a first manifold 804 disposed between and coupled with both a single piston chamber 128 and a plurality of bladders 702. The first manifold 804 is shaped and adapted to contain a volume of medium 104 and enables the flow of medium 104 to and from single piston chamber 128 and each bladder 702 of the plurality of bladders.

Referring now generally to the Figures and particularly to FIG. 8C, FIG. 8C is a side view of an seventh additional alternate embodiment of the invented device 806 (hereinafter, "seventh version" 806) that further comprises the sixth version 802 that indirectly couples a tubing 808. The tubing 808 is shaped and adapted to contain a portion of the volume of medium 104 and directs the flow of medium 104 between the single piston chamber 128 and a medium chamber 810. The medium chamber 810 is disposed between and coupled with both the tubing 808 and the first manifold 804, wherein the medium chamber 810 is shaped and adapted to contain a volume of medium 104 and enables the flow of medium 104 between the tubing 808 and the first manifold 804. The medium chamber 810 contains the medium 104 under high pressure allowing faster contraction of the bladder.

Referring now generally to the Figures and particularly to FIG. 8D, FIG. 8D is a side view of the fifth version 811 wherein an individual dedicated individual medium chamber 812 of a plurality the individual medium chambers 812 is disposed between and separately coupled with an individual bladder 702 and the dedicated piston chamber 128 of its coupled bladder 702. Each dedicated individual medium chamber 810 is shaped and adapted to contain a volume of medium 104 and enables the flow of medium 104 between the dedicated piston chamber 128 of its coupled bladder 702. It is understood that an additional valve 130 is disposed between each coupled individual medium chamber 810 and dedicated piston chamber 128.

Referring now generally to the Figures and particularly to FIG. 8E, FIG. 8E is a side view of an eighth additional alternate embodiment of the invented device 814 (hereinafter, "eighth version" 814). The eighth version 814 embodies a sealed closed loop medium circulation muscle having and applying a piston chamber 128 as an internal pump.

The eighth version 814 comprises a system chamber 816 substantively enclosing the sixth version 802 coupled with the first manifold 804 and the internal piston chamber 128 adapted with an inlet port 818. An inlet port 818 accepts medium 104 received from within the system chamber 816, wherein medium 104 alternately exits the plurality of valves 130 of the sixth version 802 that are coupled with individual bladders 702 of the sixth version 802.

The eighth version 814 further comprises an electric heater 820 that is positioned with the system chamber 816 and delivers thermal energy to the medium 104. The voltage source 820 is disposed between and coupled with a negative electrode 822A and a positive electrode 822B from which the heater 820 receives electrical energy and heats the medium 104 allowing the muscle acting during a cold season Referring now generally to the Figures and particularly to FIG. 8F, FIG. 8F is a side view of a ninth additional alternate embodiment of the invented device 824 (hereinafter, "ninth version" 824). The ninth version 824 embodies a sealed closed loop medium circulation muscle having and applying a plurality of piston chambers 128 as internal pumps.

The ninth version 824 comprises the system chamber 816 substantively enclosing the fifth version 800 coupled with the first manifold 804 and each dedicated piston chamber 128 adapted with a dedicated inlet port 826. It is understood that the fifth version couples the plurality of bladders 702 that are each individually and separately coupled with one pair of valves 130 and one dedicated piston chamber 128.

Each dedicated inlet port 826 accepts medium 104 received from within the system chamber 816, wherein medium 104 alternately exits the plurality of valves 130 of first version 800 that are coupled with individual bladders 702 of the fifth version 800 distally from the dedicated piston chamber 128 of the bladder 702 to which the medium exiting valve 130 is coupled.

The ninth version 824 may further comprise the heater 820 that is positioned with the system chamber 816 and heats the medium 104.

Referring now generally to the Figures and particularly to FIG. 9A, FIG. 9A is a side view of a tenth additional alternate embodiment of the invented device 900 (hereinafter, "tenth version" 900) that comprises a plurality of enclosing bladders 702 that each encapsulate and house a volume of medium 104, wherein each enclosing bladder 702 is coupled with one of a plurality of individually dedicated steam generating electrical energy sources 904. Each individually dedicated steam generating electrical energy source 904 draws electrical energy from the two electrodes 822A & 822B and delivers electrical energy to its coupled enclosing bladder 702 whereby at least a portion of the medium 104 housed in the energy receiving enclosing bladder 702 is driven into a phase shift into a gaseous state. One or more of the dedicated steam generating electrical energy sources 904 may be or comprise a nanocarbon thread or other suitable material known in the art.

One or more of the plurality of enclosing bladders 702 may be tubular in shape and/or comprise polyvinyl chloride, urethane plastic, biaxially oriented polyester such as PET, polyurethane, polyester, nylon, fiber reinforced polyurethane, fiber reinforced polyester, fiber reinforced nylon, or other suitable inelastic and flexible material known in the art. The reinforcing fiber of one or more enclosing bladders 702 may be or comprise glass fibers, and/or highly oriented polymer fiber made of polyester, nylon, polyurethane, and/or other suitable flexible and inelastic fiber known in the art. In addition, one or more enclosing bladders 702 may be or comprise a flexible and elastic material, such as latex, silicone or other suitable flexible and elastic material known in the art.

Referring now generally to the Figures and particularly to FIG. 9B, FIG. 9B is a side view of an eleventh additional alternate embodiment of the invented device 906 (hereinafter, "eleventh version" 906) that comprises the plurality of enclosing bladders 702 that each house a volume of medium 104, wherein each enclosing bladder 702 is coupled with one of a plurality of individually dedicated microwave energy emitting steam generating electrical energy sources 908. Each individually dedicated microwave energy emitting steam generating electrical energy element 906 draws electrical energy from the two electrodes 822A & 822B and delivers microwave energy to the portion of medium 104 enclosed in its coupled enclosing bladder 702 whereby at least a portion of the medium 104 housed in the energy receiving enclosing bladder 702 is driven into a phase shift and into a gaseous state.

Referring now generally to the Figures and particularly to FIG. 9C, FIG. 9C is a side view of a twelfth additional alternate embodiment of the invented device 910 (hereinafter, "twelfth version" 910) that comprises the plurality of enclosing bladders 702 that each house a volume of medium 104, wherein each enclosing bladder 702 is coupled with one of a plurality of individually dedicated steam generating Peltier-Seebeck modules 912. Each individually dedicated steam generating Peltier-Seebeck module 912 draws electrical energy from the two electrodes 822A & 822B and delivers electrical energy to the portion of medium 104 enclosed in its coupled enclosing bladder 702 in accordance with the Peltier-Seebeck effect whereby at least a portion of the medium 104 housed in the energy receiving enclosing bladder 702 is driven into a phase shift and into a gaseous state.

Referring now generally to the Figures and particularly to FIG. 9D, FIG. 9D is a side view of a thirteenth additional alternate embodiment of the invented device 914 (hereinafter, "thirteenth version" 914) that comprises the plurality of enclosing bladders 702 that each house a volume of medium 104, wherein each enclosing bladder 702 is coupled with one of a plurality of individually dedicated Yutkin Discharger modules 916. Each individually dedicated Yutkin Discharger module 916 draws electrical energy from the two electrodes 822A & 822B and delivers electrical energy to the portion of medium 104 enclosed in its coupled enclosing bladder 702 in accordance with the Yutkin electro hydraulic effect whereby at least a portion of the medium 104 housed in the energy receiving enclosing bladder 702 is momentarily expanded in volume.

Referring now generally to the Figures and particularly to FIG. 9E, FIG. 9E is a side view of a fourteenth additional alternate embodiment of the invented device 918 (hereinafter, "fourteenth version" 918) that comprises the plurality of enclosing bladders 702 that each house a volume of medium 104, wherein each enclosing bladder 702 is coupled with one of a plurality of individually dedicated piezo electric modules 920. Each individually dedicated piezo electric module 920 draws electrical energy from the two electrodes 822A & 822B and delivers electrical energy to the portion of medium 104 enclosed in its coupled enclosing bladder 702 in accordance with the piezo-electric effect whereby at least a portion of the medium 104 housed in the energy receiving enclosing bladder 702 is driven into a phase shift and into a gaseous state. The markings of medium 104 in FIG. 9E are meant to indicate that the medium 104 is in a state of boiling.

Referring now generally to the Figures and particularly to FIG. 9F, FIG. 9F is a side view of a fifteenth additional alternate embodiment of the invented device 922 (hereinafter, "fifteenth version" 922) that comprises the plurality of enclosing bladders 702 that each house a volume of medium high speed tuneable electroactive gel 924 (hereinafter, "gel" 924), wherein the pair of electrodes 822A & 822B extend into each enclosing bladder 702. The pair of electrodes 822A & 822B are in contact with the volume of gel 924 and are adapted to deliver sufficient electrical energy to energize the state of the gel 924 to change the state and shape of the gel 924. The change the state and shape of the gel 924 causes the bladders 702 to transfer force to the strands 704; the strands thereupon transfer a tensile force to the anchor features 118 & 120.

It is understood that the enclosing bladders 702 of the fifteenth version may be modified to be porous or be constructed of porous material.

Referring now generally to the Figures and particularly to FIG. 9G, FIG. 9G is a side view of a sixteenth additional alternate embodiment of the invented device 926 (hereinafter, "sixteenth version" 926) that comprises the plurality of enclosed bladders 702 that each house a volume of swelling particles 928 (hereinafter, "particles" 928), wherein the pair of electrodes 822A & 822B extend into each enclosing bladder 702. The pair of electrodes 822A & 822B are in contact with the particles 928 and are adapted to deliver sufficient electrical energy to modify the state of the particles 928 wherein the volume of the particles 928 is increased. One or more particles 928 might comprise a compressed inner core of a first material that is encapsulated by a second material, wherein the second material when in a first state securely maintains the first material under compression. The second material is affected by receipt of electrical energy, and the pair of electrodes 822A & 822B are adapted to deliver sufficient electrical energy to the particles 928 affect the second material to cause the first material to be released from the compressive state and expand. The expansion of the particles 928 causes the bladders 702 to expand and thereby transfer force to the strands 704; the strands thereupon transfer a tensile force to the anchor features 118 & 120.

Referring now generally to the Figures and particularly to FIG. 9H, FIG. 9H is a side view of a seventeenth additional alternate embodiment of the invented device 930 (hereinafter, "seventeenth version" 930) that comprises the plurality of enclosed bladders 702 that each house a volume of sound energy influenced particles 932 (hereinafter, "sound particles" 932). The seventeenth version 930 further comprises a plurality of sound energy emitters 934 that are each coupled with an individual enclosing bladder 702, wherein each sound energy emitter 934 is adapted deliver sufficient sound energy to modify the state of at least a portion of the sound particles 932 enclosed within a single enclosing bladder 702, whereby the volume of the sound particles 932 is increased when the sound energy emitters deliver sufficient sound energy to an enclosing bladder 702 to which the emitting sound energy emitter 934 is coupled. One or more sound particles 932 might comprise a compressed inner core of a first compressed material that is encapsulated by a second sound energy susceptible material, wherein the second sound energy susceptible material when in a first state securely maintains the first compressed material under compression. The second sound energy susceptible material is affected by receipt of sound wave energy, and each sound energy emitter 934 is adapted to deliver sufficient electrical energy to the sound particles 932 to affect the second sound energy susceptible material to cause the first compressed material to be released from the compressive state and expand. The expansion of the sound particles 932 causes the bladders 702 to expand and thereby transfer force to the strands 704; the strands thereupon transfer a tensile force to the anchor features 118 & 120.

Referring now generally to the Figures and particularly to FIG. 10A, FIG. 10A is a top view of an eighteenth additional alternate embodiment of the invented device 1000 (hereinafter, "eighteenth version" 1000) wherein each of a plurality of bladders 1002 through 1010 are each coupled with their closest positioned neighboring bladders through a one or more of a pressure-activated channels 1012 through 1026. The pressure-activated channels 1012 through 1026 are configured to allow the flow though of the medium as a result of a sufficient pressure created at the end of the pressure-activated channel as a condition of the closest neighboring bladder becoming fully inflated. Therefore the pressure-activated channels 1012 through 1026 remain closed to the flow of the medium in all other conditions whenever their closest neighboring bladders are either fully deflated or a partially inflated with the medium.

It is understood that the bladders 1002 and 1004 are comprised of a pressure-regulating channels 1012 and 1014, wherein the bladders 1004 and 1006 are comprised of a pressure-regulating channels 1016 and 1018, wherein the bladders 1006 and 1008 are comprised of a pressure-regulating channels 1020 and 1022, and the bladders 1008 and 1010 are comprised of a pressure-regulating channels 1024 and 1026. Furthermore the pressure-activated channels 1012 through 1026 enable the partial activation of any portion of the enclosed bladders 1002 through 1010 in correspondence with the amount of the medium supplied to the first bladder 1010 through the incoming medium flow valve 1028.

Whereupon all enclosed bladders are in the deflated state the opening of the incoming flow valve 1028 allows the flow of the medium into the bladder 1010 while the pressure-regulating channels 1012 through 1026 remain closed. After the bladder 1010 becomes fully inflated the pressure of the compressed medium applied to the pressure-regulating channels 1024 and 1026 causes the pressure-regulating channels 1024 and 1026 to open and allow the flow of the medium to the bladder 1008, causing the inflation of the bladder 1008. After the bladder 1008 becomes fully inflated the pressure of the compressed medium applied to the pressure-regulating channels 1020 and 1022 causes the pressure-regulating channels 1020 and 1022 to open and allow the flow of the medium to the bladder 1006, causing the inflation of the bladder 1006. After the bladder 1006 becomes fully inflated the pressure of the compressed medium applied to the pressure-regulating channels 1016 and 1018 causes the pressure-regulating channels 1016 and 1018 to open and allow the flow of the medium to the bladder 1004, causing the inflation of the bladder 1004. After the bladder 1004 becomes fully inflated the pressure of the compressed medium applied to the pressure-regulating channels 1012 and 1014 causes the pressure-regulating channels 1012 and 1014 to open and allow the flow of the medium to the bladder 1002, causing the inflation of the bladder 1002, at which point all enclosed bladders become inflated. Whereupon all enclosed bladders are in the inflated state the opening of the outgoing flow valve 1030 allows the exit of the medium from the bladders 1002 through 1010 and the closure of the pressure-regulating channels 1012 through 1026.

Referring now generally to the Figures and particularly to FIG. 10B, FIG. 10B is a top view of the eighteenth version of the invented device 1000 wherein the bladder 1010 is shown to be in the inflated state.

Referring now generally to the Figures and particularly to FIG. 10C, FIG. 10C is a top view of the eighteenth version of the invented device 1000 wherein the bladders 1006, 1008 and 1010 are shown to be in the inflated state.

Referring now generally to the Figures and particularly to FIG. 10D, FIG. 10D is a top view of the eighteenth version of the invented device 1000 wherein the bladders 1002 through 1010 are shown to be in the inflated state.

Referring now generally to the Figures and particularly to FIG. 10E, FIG. 10E is a side view of the eighteenth version of the invented device 1000 wherein the bladders 1002 through 1010 are shown to be in the deflated state.

Referring now generally to the Figures and particularly to FIG. 10F, FIG. 10F is a side view of the eighteenth version of the invented device 1000 wherein the bladders 1002 through 1010 are shown to be in the inflated state.

Referring now generally to the Figures and particularly to FIG. 10G through FIG. 10I, FIG. 10G through FIG 10I are a detail side views of the eighteenth version of the invented device 1000 wherein in FIG. 10G the bladders 1006, 1008 and 1010 are shown to be in the deflated state. Whereupon in FIG. 10H the bladder 1010 is shown as partially inflated the pressure-activated channel 1026 is shown as closed where in FIG. 10I the bladder 1010 is shown as fully inflated and the pressure-activated channel 1026 is shown as open.

The foregoing disclosures and statements are illustrative only of the Present Invention, and are not intended to limit or define the scope of the Present Invention. The above description is intended to be illustrative, and not restrictive. Although the examples given include many specificities, they are intended as illustrative of only certain possible configurations or aspects of the Present Invention. The examples given should only be interpreted as illustrations of some of the preferred configurations or aspects of the Present Invention, and the full scope of the Present Invention should be determined by the appended claims and their legal equivalents. Those skilled in the art will appreciate that various adaptations and modifications of the just-described preferred embodiments can be configured without departing from the scope and spirit of the Present Invention. Therefore, it is to be understood that the Present Invention may be practiced other than as specifically described herein. The scope of the present invention as disclosed and claimed should, therefore, be determined with reference to the knowledge of one skilled in the art and in light of the disclosures presented above.

I claim:

1. An apparatus comprising:

a tensile element comprising at least two substantively inelastic elongate strands ("strands") and at least one of the strands having a first strand end and a second strand end, the tensile element substantively inelastic along a traction axis, the tensile element comprising a first end and a second end;

a first object coupled with the first strand end;

a second object coupled with the the second strand end; and an expandable means coupled with the tensile element, the expandable means adapted to expand and thereby deliver a force to the tensile element, the force initially being normal to the traction axis, whereby the force is transferred from the expandable means to the tensile element and causes the tensile element to pull the first object and the second object together along the traction axis.

2. The apparatus of claim 1, wherein the tensile element comprises a plurality of substantively inelastic elongate strands ("strands").

3. The apparatus of claim 2, wherein each strand of the plurality of strands each comprise a first strand end and a second strand end, and wherein each first strand end is coupled to the first object and each second strand end is coupled to the second object.

4. The apparatus of claim 1, wherein the expandable means includes at least one bladder, a medium, and means to alternately force the medium into and out from the at least one bladder.

5. The apparatus of claim 4, wherein the at least two strands in combination substantively encompass the at least one bladder within a plane that includes the traction axis.

6. The apparatus of claim 5, wherein the at least two strands are interweaved around the at least one bladder.

7. The apparatus of claim 5, wherein the at least two strands are coupled together at two locations along the traction axis, whereby the at least two strands are maintained in position around the at least one bladder.

8. The apparatus of claim 7, wherein the at least one bladder maintains a tubular shape along an elongate axis normal to the traction axis.

9. The apparatus of claim 8, wherein the expandable means includes a plurality of bladders, a medium, and means to alternately force the medium into and out from each bladder of the plurality of bladders.

10. The apparatus of claim 9, wherein the at least two strands in combination substantively encompass a selection of bladders of the plurality of bladders within a plane that includes the traction axis.

11. The apparatus of claim 10, wherein the at least two strands are interweaved around at least one bladder of the plurality of bladders.

12. The apparatus of claim 10, wherein the at least two strands are interweaved around the selection of bladders of the plurality of bladders.

13. The apparatus of claim 10, wherein the at least two strands are coupled together at two locations along the traction axis, whereby the at least two strands are maintained in position around at least one bladder of the plurality of bladders.

14. The apparatus of claim 9, wherein the at least one bladder of the plurality of bladders maintains a tubular shape along an elongate axis normal to the traction axis.

15. The apparatus of claim 9, wherein the medium is in a gaseous state.

16. The apparatus of claim 9, wherein the medium is in a liquid state.

17. The apparatus of claim 9, wherein the expandable means further comprises a reservoir and a two way valve, wherein the reservoir is adapted to partially contain the medium and the two way valve is disposed between the reservoir and the plurality of bladders, whereby the two way valve alternately inhibits the medium from transferring to and from the reservoir and the plurality of bladders.

18. A method comprising:

a. Coupling the apparatus of claim 1, wherein wherein the first strand end is attached to the first object and the second strand end is attached to the second object along a traction axis; and b. Forcing a medium into an expandable bladder, the bladder adapted and positioned to deliver a pressing force toward the strand as the medium is forced into the bladder, wherein the pressing force is normal to the traction axis, whereby the pressing force when applied to the strand causes the strand to deliver a tensile force to both the first object and the second object along the traction axis.

19. The method of claim 18, wherein the medium is in a gaseous state.

20. The method of claim 18, wherein the medium is in a liquid state.

* * * * *